US009315748B2

(12) United States Patent
DiBiase et al.

(10) Patent No.: US 9,315,748 B2
(45) Date of Patent: Apr. 19, 2016

(54) COLD FLOW ADDITIVES

(75) Inventors: Stephen A. DiBiase, Willowbrook, IL (US); Syed Q. A. Rizvi, Painesville, OH (US); S. Alexander Christensen, Northwoods, IL (US)

(73) Assignee: Elevance Renewable Sciences, Inc., Bolingbrook, IL (US)

( * ) Notice: Subject to any disclaimer, the term of this patent is extended or adjusted under 35 U.S.C. 154(b) by 892 days.

(21) Appl. No.: 13/081,588

(22) Filed: Apr. 7, 2011

(65) Prior Publication Data

US 2012/0255222 A1 Oct. 11, 2012

(51) Int. Cl.

| | |
|---|---|
| ***C10L 1/19*** | (2006.01) |
| ***C10L 1/183*** | (2006.01) |
| ***C10L 1/185*** | (2006.01) |
| ***C10L 1/188*** | (2006.01) |
| ***C10L 1/24*** | (2006.01) |

(Continued)

(52) U.S. Cl.

CPC ..... *C10L 1/1802* (2013.01); *C10L 1/18* (2013.01); *C10L 1/1817* (2013.01); *C10L 1/1881* (2013.01); *C10L 1/1883* (2013.01); *C10L 1/19* (2013.01); *C10L 1/195* (2013.01); *C10L 1/1905* (2013.01); *C10L 1/1915* (2013.01); *C10L 1/1963* (2013.01); *C10L 1/1973* (2013.01); *C10L 1/221* (2013.01); *C10L 1/224* (2013.01); *C10L 1/2493* (2013.01); *C10L 10/14* (2013.01); *C10L 10/16* (2013.01); *C11C 3/00* (2013.01); *C11C 3/14* (2013.01); *C10L 1/191* (2013.01); *C10L 2200/043* (2013.01); *C10L 2200/0415* (2013.01); *C10L 2200/0438* (2013.01); *C10L 2200/0446* (2013.01); *C10L 2200/0469* (2013.01); *C10L 2200/0476* (2013.01); *C10L 2200/0484* (2013.01); *C10L 2200/0492* (2013.01)

(58) Field of Classification Search

USPC ..... 560/218; 60/274; 44/393, 307, 334, 44/339, 353, 354, 385, 388, 389, 403, 411

See application file for complete search history.

(56) References Cited

U.S. PATENT DOCUMENTS

| | | | |
|---|---|---|---|
| 2,188,887 A | 1/1940 | Clocker | 134/24 |
| 2,964,545 A | 12/1960 | Harrison | 260/407 |

(Continued)

FOREIGN PATENT DOCUMENTS

| | | |
|---|---|---|
| DE | 188909 | 4/1906 |
| DE | 57961 | 9/1967 |

(Continued)

OTHER PUBLICATIONS

Vogel et al.; "New Organic Chemistry of Sulfur Dioxide"; Accounts of Chemical Research, vol. 40, No. 10, 2007; pp. 931-942.

(Continued)

*Primary Examiner* — Ellen McAvoy
*Assistant Examiner* — Chantel Graham
(74) *Attorney, Agent, or Firm* — Renner, Otto, Biosselle & Sklar, LLP

(57) ABSTRACT

This invention relates to a fuel composition, comprising: (A) a normally liquid fuel; and (B) a cold flow improving amount of (i) a metathesized natural oil; (ii) a metathesized natural oil derivative; or (iii) a mixture of (i) and (ii). The invention also relates to metathesized derivatives formed by the reaction of a metathesized natural oil with a nucleophile, oxidizer, aromatic compound, enophilic acid reagent, or a mixture of two or more thereof.

54 Claims, 1 Drawing Sheet

(51) Int. Cl.

| | |
|---|---|
| ***C10L 1/232*** | (2006.01) |
| ***C10L 1/18*** | (2006.01) |
| ***C10L 1/224*** | (2006.01) |
| ***C10L 1/195*** | (2006.01) |
| ***C10L 1/196*** | (2006.01) |
| ***C10L 1/197*** | (2006.01) |
| ***C10L 1/22*** | (2006.01) |
| ***C10L 10/14*** | (2006.01) |
| ***C10L 10/16*** | (2006.01) |
| ***C11C 3/00*** | (2006.01) |
| ***C11C 3/14*** | (2006.01) |

(56) References Cited

U.S. PATENT DOCUMENTS

| | | | | |
|---|---|---|---|---|
| 3,293,201 | A | 12/1966 | Shahade et al. | 260/23 |
| 3,776,866 | A | 12/1973 | Nakayama | 260/18 |
| 4,376,068 | A | 3/1983 | Mookherjee et al. | 252/522 |
| 4,390,444 | A | 6/1983 | Mookherjee et al. | 252/174.11 |
| 4,446,125 | A | 5/1984 | Mookherjee et al. | 424/49 |
| 4,505,934 | A | 3/1985 | Gut et al. | 514/762 |
| 4,518,757 | A | 5/1985 | Schulz et al. | 526/329 |
| 4,545,939 | A | 10/1985 | Sekiguchi et al. | 260/400 |
| 4,690,767 | A | 9/1987 | DiBiase | 252/47 |
| 5,425,789 | A | 6/1995 | Lewtas et al. | 44/391 |
| 5,484,542 | A | 1/1996 | Cahoon et al. | 252/18 |
| 5,730,029 | A | 3/1998 | Stoldt et al. | 44/389 |
| 5,773,391 | A | 6/1998 | Lawate et al. | 508/257 |
| 5,814,110 | A | 9/1998 | Bartz et al. | 44/370 |
| 6,224,642 | B1 | 5/2001 | Daly et al. | 44/434 |
| 6,458,175 | B1 | 10/2002 | Lehmann et al. | 44/398 |
| 6,503,285 | B1 | 1/2003 | Murphy | 44/275 |
| 6,645,261 | B2 | 11/2003 | Murphy et al. | 44/275 |
| 6,727,357 | B2 | 4/2004 | Polovsky et al. | 536/123.13 |
| 6,770,104 | B2 | 8/2004 | Murphy | 44/275 |
| 6,773,469 | B2 | 8/2004 | Murphy | 44/275 |
| 6,797,020 | B2 | 9/2004 | Murphy | 44/275 |
| 7,022,637 | B2 | 4/2006 | Song et al. | 502/64 |
| 7,128,766 | B2 | 10/2006 | Murphy et al. | 44/275 |
| 7,192,457 | B2 | 3/2007 | Murphy et al. | 44/275 |
| 7,217,301 | B2 | 5/2007 | Murphy et al. | 44/275 |
| 7,247,742 | B2 | 7/2007 | McMahon et al. | 56/100 |
| 7,309,817 | B2 | 12/2007 | Green et al. | 800/295 |
| 7,399,323 | B2 | 7/2008 | Renninger et al. | 44/385 |
| 7,462,205 | B2 | 12/2008 | Murphy | 44/275 |
| 7,465,835 | B2 | 12/2008 | Zones et al. | 564/479 |
| 7,473,284 | B2 | 1/2009 | Krull | 44/393 |
| 7,476,264 | B2 | 1/2009 | Krull | 44/393 |
| 7,494,961 | B2 | 2/2009 | Small et al. | 508/542 |
| 7,531,082 | B2 | 5/2009 | Mukherjee et al. | 208/57 |
| 7,592,295 | B1 | 9/2009 | Fisher et al. | 507/110 |
| 7,637,968 | B2 | 12/2009 | Murphy | 44/275 |
| 7,655,739 | B1 | 2/2010 | McPhee et al. | 526/72 |
| 7,659,097 | B2 | 2/2010 | Renninger et al. | 435/157 |
| 7,691,792 | B1 | 4/2010 | Fisher et al. | 508/110 |
| 7,759,444 | B1 | 7/2010 | McPhee | 526/335 |
| 7,812,185 | B2 | 10/2010 | Burdett et al. | 554/27 |
| 7,833,294 | B2 | 11/2010 | Murphy et al. | 44/275 |
| 7,846,222 | B2 | 12/2010 | Renninger et al. | 44/385 |
| 7,854,774 | B2 | 12/2010 | Renninger et al. | 44/451 |
| 7,868,114 | B1 | 1/2011 | McPhee | 526/340.3 |
| 7,868,115 | B1 | 1/2011 | McPhee | 526/340.3 |
| 2003/0136046 | A1 | 7/2003 | Jackson et al. | 44/385 |
| 2005/0154221 | A1 | 7/2005 | Lysenko et al. | 554/174 |
| 2007/0039237 | A1 | 2/2007 | Murphy et al. | 44/275 |
| 2007/0227400 | A1 | 10/2007 | Zullo et al. | 106/15.05 |
| 2007/0270621 | A1 | 11/2007 | Millis et al. | 585/253 |
| 2007/0282000 | A1 | 12/2007 | Murphy et al. | 514/558 |
| 2007/0283681 | A1* | 12/2007 | Makkee et al. | 60/274 |
| 2008/0016755 | A1* | 1/2008 | Siggelkow et al. | 44/393 |
| 2008/0027194 | A1 | 1/2008 | Schrodi | 526/171 |
| 2008/0033026 | A1 | 2/2008 | Zullo et al. | 514/373 |
| 2008/0064891 | A1 | 3/2008 | Lee | 554/124 |
| 2008/0119377 | A1 | 5/2008 | Delvin et al. | 508/371 |
| 2008/0141580 | A1 | 6/2008 | Tack | 44/351 |
| 2008/0194443 | A1 | 8/2008 | Stohr et al. | 508/469 |
| 2009/0005610 | A1 | 1/2009 | Hassan et al. | 568/852 |
| 2009/0048459 | A1 | 2/2009 | Tupy et al. | 554/146 |
| 2009/0119977 | A1 | 5/2009 | Murphy | 44/275 |
| 2009/0126602 | A1 | 5/2009 | Murphy et al. | 106/251 |
| 2009/0137014 | A1 | 5/2009 | Tsuruta et al. | 435/157 |
| 2009/0158641 | A1* | 6/2009 | Hayes et al. | 44/309 |
| 2009/0163729 | A1* | 6/2009 | Li et al. | 554/8 |
| 2009/0217568 | A1 | 9/2009 | Murphy et al. | 44/275 |
| 2009/0220443 | A1* | 9/2009 | Braksmayer et al. | 424/64 |
| 2009/0259065 | A1 | 10/2009 | Abraham et al. | 558/340 |
| 2009/0264672 | A1 | 10/2009 | Abraham et al. | 560/190 |
| 2010/0024281 | A1 | 2/2010 | Lemke et al. | 44/275 |
| 2010/0047499 | A1 | 2/2010 | Braksmayer et al. | 428/40.5 |
| 2010/0056714 | A1 | 3/2010 | McPhee | 524/579 |
| 2010/0056743 | A1 | 3/2010 | McPhee | 526/346 |
| 2010/0094034 | A1 | 4/2010 | Kaido et al. | 554/145 |
| 2010/0112672 | A1 | 5/2010 | Keasling et al. | 435/252.33 |
| 2010/0132250 | A1 | 6/2010 | Uptain et al. | 44/275 |
| 2010/0145086 | A1 | 6/2010 | Schrodi et al. | 554/124 |
| 2010/0160506 | A1 | 6/2010 | Wu et al. | 524/114 |
| 2010/0190671 | A1 | 7/2010 | Stoehr et al. | 508/469 |
| 2010/0191008 | A1 | 7/2010 | Olson | 554/170 |
| 2010/0267971 | A1 | 10/2010 | Ohler et al. | 549/512 |
| 2011/0015436 | A1 | 1/2011 | Aoki et al. | 562/606 |
| 2011/0287989 | A1 | 11/2011 | Filippini | 508/110 |
| 2013/0006012 | A1* | 1/2013 | Firth et al. | 560/218 |
| 2014/0323784 | A1* | 10/2014 | Joshi et al. | 585/326 |

FOREIGN PATENT DOCUMENTS

| | | | |
|---|---|---|---|
| EP | 0130753 | | 9/1985 |
| EP | 0 079 906 | B1 | 1/1987 |
| EP | 0 266 822 | B1 | 5/1991 |
| EP | 0 531 842 | B1 | 6/1992 |
| EP | 0 656 414 | A2 | 6/1995 |
| EP | 1 681 338 | A1 | 7/2006 |
| FR | 2757535 | | 6/1998 |
| GB | 1 215 075 | | 12/1970 |
| IT | 91MI0462 | | 8/1992 |
| JP | 61060703 | | 3/1986 |
| JP | 8-208537 | | 8/1996 |
| WO | 97/11098 | | 3/1997 |
| WO | 02/086031 | A1 | 10/2002 |
| WO | 2004/101634 | A1 | 11/2004 |
| WO | 2004/113403 | A1 | 12/2004 |
| WO | 2005/071050 | A1 | 8/2005 |
| WO | 2007/140339 | A2 | 12/2007 |
| WO | 2008/008420 | A1 | 1/2008 |
| WO | 2008/039499 | A2 | 4/2008 |
| WO | 2008/045555 | A2 | 4/2008 |
| WO | 2008/124390 | A2 | 10/2008 |
| WO | 2009003052 | | 12/2008 |
| WO | 2009/006527 | A1 | 1/2009 |
| WO | 2009/067384 | A1 | 5/2009 |
| WO | 2009/080489 | A1 | 7/2009 |
| WO | 2009080489 | | 7/2009 |
| WO | 2009113711 | | 9/2009 |
| WO | 2010/027463 | A1 | 3/2010 |
| WO | 2010/027464 | A1 | 3/2010 |
| WO | 2010/033183 | A2 | 3/2010 |
| WO | 2010/042208 | A2 | 4/2010 |
| WO | 2010/051293 | A1 | 5/2010 |
| WO | 2010/074738 | A1 | 7/2010 |
| WO | 2010/103223 | A1 | 9/2010 |
| WO | 2010/115097 | A2 | 10/2010 |
| WO | 2011/002831 | A1 | 1/2011 |
| WO | 2011/022317 | A1 | 2/2011 |
| WO | 2011/031659 | A1 | 3/2011 |
| WO | 2011/034829 | A1 | 3/2011 |
| WO | 2011/037585 | A1 | 3/2011 |
| WO | 2011/038331 | A1 | 3/2011 |
| WO | 2011/149789 | A1 | 12/2011 |
| WO | 2012006324 | | 1/2012 |

(56) References Cited

OTHER PUBLICATIONS

Hartel et al.; Zur Charakterisierung der Reaktionsprodukte bei der Umsetzung Hohemiolekularer ungesattigter Fettsaureester mit Schwefelwasserstoff bei Anwesenheit von elementarem Schwefel; Fette, Seifen, Anstrichmittel, 88. Jahrgang, Nr.8, 1984, pp. 300-303.
Zheng et al.; "Au Catalyzed Piperidine Synthesis via Tandem Acyloxy Migration/Intramolecular [3+2] Cycloaddition of Enynyl Esters"; Organic Letters (2011), 13(24), 6448-6451.
Singh et al.; "H-Halosuccinimide-mercaptoethanol cohalogenation of olefinic fatty methyl esters: synthesis of β-halo thioethoxylates"; Journal of Surfactants and Detergents (2006), 9(2), 191-195.
Samuelsson et al.; "Thiol-ene coupling reaction of fatty acid monomers"; Journal of Polymer Science, Part A: Polymer (2004), (42), 6346-6352.
Trost et al.; "A new Ru catalyst for alkene-alkyne coupling"; Tetrahedron Letters (1999), (40), 7739-7743.
Yang et al.; "Chiral Lewis Acid-Catalyzed Enantioselective Intramolecular Carbonyl Ene REactions of Unsaturated α-Keto Esters"; Organic Letters (2003), 5(20), 3749-3752.
Li et al.; "Synthesis and biological activity of hydroxylated derivatives of linoleic acid and conjugated linoleic acids"; Chemistry and Physics of Lipids 158 (2009), 158(1), 39-45.
International Search Report and Written Opinion, Application No. PCT/US11/57713, mailed Mar. 14, 2012.
V.V. Solov'ev et al.; "Study of Sulfuration of C18 for obtaining surface active agents"; Izvestiya Vysshikh Uchebnykh Zavedenii, Khimiya i Khimicheskaya Tekhnologiya (2003), 49(9), 121-123. (Abstract).
Meng et al.; "Sulfonation of undecylenic acid"; XXXI Jornadas Amuales, DEL CED, (2001), pp. 299-311.
Dorinson; "Influence of Chemical Structures in Sulfurized Fats on Antiwear Behavior"; Asle Transactions 14, 124-134. Date, 1970.
Holser et al.; "Metathesis of methyl soyate with ruthenium catalysts"; Fuel 85 (2006), pp. 393-395.
Tamayo et al.; "Le Adicion Sustituyente en Esteres Olefinicos"; Anales De La Real Sociedad Espanola De Fisica Y Quimica, Serie B: Quimica, Madrid, ES, vol. 51, Jan. 1, 1955.
Quesada et al.; "Preparation of Alkenyl Succinic Anhydrides from Vegetable Oil FAME"; JAOCS, vol. 80, No. 3; 2003, pp. 281-286.
Reivik et al.; "The Chemistry of Metathesized Soybean Oil"; JAOCS, vol. 76, No. 1, 1999, pp. 99-102.
Ross et al.; "The Addition of Olefinic Esters to Maleic Anhydride"; Journal of the American Chemical Society, vol. 68, No. 7, Jul. 19, 1946, pp. 1373-1376.
Rybak et al.; "Metathesis as a versatile tool in oleochemistry"; Eur. J. Lipid Sci. Technol., 2008, 110, 797-804.
Warwel et al.; "Polymers and polymer building blocks from meadow foam oil"; Industrial Crops and Products 20, 2004, 301-309.
Warwel et al.; "Copolymerization of Ethylene with ω-Unsaturated Fatty Acid Methyl Esters Using a Cationic Palladium Complex"; Macromol. Chem. Phys., 2001, 202, 849-855.
Wang et al.; "Synthesis and antitumor activity of C-9 epimers of the tetrahydrofuran containing acetogenin 4-deoxyannoreticuin"; Bioorganic & Medicinal Chemistry 16, 2008, 8413-8418.
Wu et al.; "The Study of Epoxidized Rapseed Oil Used as a Potential Biodegradable Lubricant"; JAOCS, vol. 77, No. 5, 2000, pp. 561-563.
International Search Report and Written Opinion, Application No. PCT/US2012/030823, mailed Sep. 24, 2012.
International Search Report and Written Opinion, Application No. PCT/US2012/030316, mailed Sep. 24, 2012.
International Search Report and Written Opinion, Application No. PCT/US2012/030282, mailed Aug. 27, 2012.
International Search Report and Written Opinion, Application No. PCT/US2012/030296, mailed Sep. 14, 2012.
International Search Report and Written Opinion, Application No. PCT/US2012/030291, mailed 14, 2012.
Li et al.; "Synthesis and biological activity of hydroxylated derivatives of linoleic acid and conjugated linoleic acids"; Chemistry and Physics of Lipids (2009), 158(1), 39. (Abstract).
Singh et al.; "H-Halosuccinimide-mercaptoethanol cohalogenation of olefinic fatty methyl esters: synthesis of β-halo thioethoxylates"; Journal of Surfactants and Detergents (2006), 9(2), 191-195. (Abstract).
Samuelsson et al.; "Thiol-ene coupling reaction of fatty acid monomers"; Journal of Polymer Science, Part A: Polymer (2004), 42(24), 6346-6352. (Abstract).
Dean et al.; "New Organic Chemistry of Sulfur Dioxide"; Accounts of Chemical Research (2007), 40(10), 931. (Abstract).
Trost et al.; "A new Ru catalyst for alkene-alkyne coupling"; Tetrahedron Letters (1999), 40(44), 7739-7743. (Abstract).
Zheng et al.; "Au Catalyzed Piperidine Synthesis via Tandem Acyloxy Migration/Intramolecular [3 + 2] Cycloaddition of Enynyl Esters"; Organic Letters (2011), 13(24), 6448-6451. (Abstract).
Yang et al.; "Chiral Lewis Acid-Catalyzed Enantioselective Intramolecular Carbonyl Ene REactions of Unsaturated α-Keto Esters"; Organic Letters (2003), 5(20), 3749-3752. (Abstract).
Aminova et al.; "Preparation and study of the properties of products of the sulfonation of cotton soapstock fatty acids"; Deposited Doc. (1975), VINITI 732-75, 7 pp. (Abstract).
Meng et al.; "Sulfonation of undecylenic acid"; Comunicaciones presentadas a la Jornadas del Comite Espanol de la Detergencia (2001), 31, 299-312. (Abstract).
Swann Jr. et al.; "They Hydroxylation of Double Bonds"; University of Illinois Bulletin; vol. XXVII, No. 31, Apr. 1, 1930, pp. 1-16.
U.S. Appl. No. 13/081,588, filed Apr. 7, 2011.
U.S. Appl. No. 13/281,108, filed Oct. 25, 2011.
U.S. Appl. No. 13/428,458, filed Mar. 23, 2012.
U.S. Appl. No. 13/428,257, filed Mar. 23, 2012.
U.S. Appl. No. 13/428,284, filed Mar. 23, 2012.
U.S. Appl. No. 13/428,268, filed Mar. 23, 2012.
U.S. Appl. No. 13/407,850, filed Feb. 29, 2012.
International Application PCT/US2012/30823, filed Mar. 28, 2012.
International Application PCT/US2011/057713, filed Oct. 25, 2011.
International Application PCT/US2012/030316, filed Mar. 23, 2012.
International Application PCT/US2012/30282, filed Mar. 23, 2012.
International Application PCT/US2012/30296, filed Mar. 23, 2012.
International Application PCT/US2012/30291, filed Mar. 23, 2012.
European Office Action, Application No. EP 12 714 138.0, mailed Sep. 2, 2014.

* cited by examiner

COLD FLOW ADDITIVES

TECHNICAL FIELD

This invention relates to cold flow additives and, more particularly, to cold flow additives comprising metathesized oil or metathesized oil derivatives.

BACKGROUND

Diesel fuels typically contain wax and when subjected to low temperatures these fuels often undergo wax crystallization, gelling and/or viscosity increase. This reduces the ability of the fuel to flow and creates filter plugging which adversely affects the operability of vehicles using these fuels. Flow improvers have been used to modify the wax structure as it builds during cooling. These additives are typically used to keep the wax crystals small so that they can pass through fuel filters. Also, pour point dispersants are sometimes used in diesel fuel to ensure that it can be pumped at low temperatures.

SUMMARY

The protection of normally liquid fuels, such as diesel fuels and the like, from cold flow problems continues to be a problem in the art. This invention provides a solution to this problem. With the present invention, it has been unexpectedly discovered that cold flow additives in the form of metathesized natural oils, and/or their derivatives (the derivatives including those obtained by the reaction of a metathesized natural oil with one or more nucleophiles, oxidizers, aromatic compounds, enophilic acid reagents, or a mixture of two or more thereof) provide significant improvements with respect to modifying the low temperature flow behavior of normally liquid fuels, especially biofuels, petroleum middle distillates, and mixtures thereof. The improvements include lowering the cloud point, pour point and/or cold filter plugging point of these fuels. The metathesized natural oils employed herein provide the advantage of being derived from renewable sources (e.g., vegetable oils, animal fats or oils, and the like) and are made using environmentally friendly production techniques with less energy than processes for making fuel additives derived from petrochemicals. This technology may be referred to as "green" technology.

This invention relates to a fuel composition, comprising: (A) a normally liquid fuel (e.g., biofuel, petroleum middle distillate, or mixture thereof); and (B) a cold flow improving amount of (i) a metathesized natural oil; (ii) a metathesized natural oil derivative; or (iii) a mixture of (i) and (ii).

In an embodiment, the invention relates to a fuel composition, comprising: (A) a biofuel; and (B) a cold flow improving amount of (i) a metathesized soybean oil; (ii) a metathesized soybean oil derivative; or (iii) a mixture of (i) and (ii).

In an embodiment, the invention relates to a fuel composition, comprising: (A) a normally liquid fuel comprising a mixture of a biofuel and a petroleum middle distillate; and (B) a cold flow improving amount of (i) a metathesized soybean oil; (ii) a metathesized soybean oil derivative; or (iii) a mixture of (i) and (ii).

In an embodiment, the invention relates to a composition comprising a metathesized natural oil derivative comprising the reaction product of (a) a metathesized natural oil with (b) a nucleophile, oxidizer, aromatic compound, enophilic acid reagent, or a mixture of two or more thereof. This composition may be used as a cold flow additive.

In an embodiment, the normally liquid fuel (A) comprises a natural oil, a natural oil derived unsaturated carboxylic acid, salt and/or ester, or a mixture thereof.

In an embodiment, the normally liquid fuel (A) is derived from petroleum or crude oil; or from a Fischer-Tropsch process; or from coal, natural gas, oil shale, biomass, or a mixture of two or more thereof.

In an embodiment, the normally liquid fuel (A) comprises a synthetic fuel; or a middle distillate fuel; or a biofuel; or a mixture of a biofuel and a hydrocarbon fuel; or a biodiesel/bioalcohol blend, a biodiesel/petroleum middle distillate blend, or a mixture thereof; or a mixture of natural oil derived (e.g., rapeseed oil derived) methyl ester and a petroleum middle distillate.

In an embodiment, the normally liquid fuel (A) comprises kerosene, jet fuel, diesel fuel, fuel oil, heating oil, naphtha, or a mixture of two or more thereof.

In an embodiment, the metathesized natural oil is the product of a self-metathesis process or a cross-metathesis process.

In an embodiment, the metathesized natural oil is made by reacting one or more natural oils and/or natural oil derived unsaturated carboxylic acids, salts and/or esters in the presence of a metathesis catalyst to form the metathesized natural oil.

In an embodiment, the metathesized natural oil is made by reacting (a) one or more natural oils and/or natural oil derived unsaturated carboxylic acids, salts and/or esters with (b) another olefinic compound in the presence of a metathesis catalyst.

In an embodiment, the natural oil comprises vegetable oil, algae oil, fungus oil, animal oil or fat, tall oil, or a mixture of two or more thereof.

In an embodiment, the natural oil comprises canola oil, rapeseed oil, coconut oil, corn oil, cottonseed oil, olive oil, palm oil, peanut oil, safflower oil, sesame oil, soybean oil, sunflower seed oil, linseed oil, palm kernel oil, tung oil, jatropha oil, mustard oil, camellina oil, pennycress oil, castor oil, coriander oil, almond oil, wheat germ oil, bone oil, lard, tallow, poultry fat, algal oil, yellow grease, fish oil, or a mixture of two or more thereof.

In an embodiment, the natural oil comprises refined, bleached and/or deodorized natural oil (e.g., soybean oil).

In an embodiment, the natural oil derived unsaturated carboxylic acid, salt and/or ester comprises an unsaturated fatty acid with an alkene chain in the carboxylic acid portion of the molecule of from about 4 to about 30 carbon atoms, or from about 10 to about 24 carbon atoms, or from about 16 to about 24 carbon atoms, or from about 16 to about 22 carbon atoms, or about 18 carbon atoms, a terminal carboxylic acid group, and at least one carbon-carbon double bond in the alkene chain. In an embodiment, the alkene chain contains one, two, three or four carbon-carbon double bonds.

In an embodiment, the natural oil derived unsaturated carboxylic acid, salt and/or ester comprises a metal salt of an unsaturated fatty acid with an alkene chain in the carboxylic acid portion of the molecule of from about 4 to about 30 carbon atoms, or from about 10 to about 24 carbon atoms, or from about 16 to about 24 carbon atoms, or from about 16 to about 22 carbon atoms, or about 18 carbon atoms, and at least one carbon-carbon double bond in the alkene chain, the metal being an alkali metal, an alkaline earth metal, a group IIIA metal, a group IVA metal, a group VA metal, a transition metal, a metal from the lanthanide series, a metal from the actinide series, or a mixture of two or more thereof. In an embodiment, the alkene chain contains one, two, three or four carbon-carbon double bonds.

In an embodiment, the natural oil derived unsaturated carboxylic acid, salt and/or ester comprises an unsaturated fatty ester with an alkene chain in the carboxylic acid portion of the molecule of from about 4 to about 30 carbon atoms, or from about 10 to about 24 carbon atoms, or from about 16 to about 24 carbon atoms, or from about 16 to about 22 carbon atoms, or about 18 carbon atoms, a terminal ester group, and at least one carbon-carbon double bond in the alkene chain. In an embodiment, the alkene chain contains one, two, three or four carbon-carbon double bonds.

In an embodiment, the natural oil derived unsaturated carboxylic acid, salt and/or ester comprises a polyunsaturated fatty acid, a carboxylate salt of a polyunsaturated fatty acid, a polyunsaturated fatty ester, or a mixture of two or more thereof.

In an embodiment, the unsaturated fatty ester comprises an unsaturated monoester, an unsaturated polyol ester, or a mixture thereof.

In an embodiment, the unsaturated polyol ester is derived from a polyol containing from 2 to about 10 carbon atoms, and from 2 to about 6 hydroxyl groups.

In an embodiment, the unsaturated fatty ester comprises an unsaturated glyceride.

In an embodiment, the unsaturated glyceride comprises an unsaturated monoglyceride, an unsaturated diglyceride, an unsaturated triglyceride, or a mixture of two or more thereof.

In an embodiment, the natural oil derived unsaturated carboxylic acid, salt and/or ester comprises an unsaturated fatty acid, carboxylate salt of an unsaturated fatty acid and/or an unsaturated fatty ester with an alkene chain in the carboxylic acid portion of the molecule of from about 10 to about 24 carbon atoms, or about 16 to about 24 carbon atoms; and: a carbon-carbon double bond between the $C_9$ and $C_{10}$ carbon atoms in the alkene chain; or a carbon-carbon double bond between the $C_6$ and $C_7$ carbon atoms in the alkene chain; or a carbon-carbon double bond between the $C_{12}$ and $C_{13}$ carbon atoms in the alkene chain; or a carbon-carbon double bond between the $C_{15}$ and $C_{16}$ carbon atoms in the alkene chain; or carbon-carbon double bonds between the $C_9$ and $C_{10}$ carbon atoms and between the $C_{12}$ and $C_{13}$ carbon atoms in the alkene chain; or carbon-carbon double bonds between the $C_9$ and $C_{10}$ carbon atoms, between the $C_{12}$ and $C_{13}$ carbon atoms, and between $C_{15}$ and $C_{16}$ carbon atoms in the alkene chain; or carbon-carbon double bonds between the $C_6$ and $C_7$ carbon atoms, between the $C_9$ and $C_{10}$ carbon atoms, between the $C_{12}$ and $C_{13}$ carbon atoms, and between the $C_{15}$ and $C_{16}$ carbon atoms in the alkene chain.

In an embodiment, the natural oil or natural oil derived unsaturated carboxylic acid, salt and/or ester is partially hydrogenated prior to the reaction in the presence of the metathesis catalyst.

In an embodiment, the metathesized natural oil comprises from 1 to about 100, or from 2 to about 50, or from 2 to about 30, or from 2 to about 10 bonded groups derived from unsaturated compounds in the natural oil, natural oil derivative and/or another olefinic compound used in the metathesis process.

In an embodiment, the metathesized natural oil comprises a metathesis dimer, metathesis trimer, metathesis tetramer, metathesis pentamer, metathesis hexamer, metathesis heptamer, metathesis octamer, metathesis nonamer, metathesis decamer, or a mixture of two or more thereof.

In an embodiment, the metathesized natural oil derivative comprises the reaction product of the metathesized natural oil with a nucleophile, for example, a nucleophilic nitrogen reagent or a nucleophilic oxygen reagent.

In an embodiment, the metathesized natural oil derivative comprises the reaction product of the metathesized natural oil with an enophilic acid reagent.

In an embodiment, the metathesized natural oil derivative comprises the reaction product of the metathesized natural oil with an oxidizing agent.

In an embodiment, metathesized natural oil derivative comprises the alkylation reaction product of the metathesized natural oil with an aromatic compound.

In an embodiment, the metathesized natural oil is made by: reacting a natural oil and/or natural oil derived unsaturated carboxylic acid, salt and/or ester in the presence of a metathesis catalyst to form a first metathesized natural oil; and then reacting the first metathesized natural oil in a self-metathesis reaction to form another metathesized natural oil; or reacting the first metathesized natural oil in a cross-metathesis reaction with a natural oil derived unsaturated carboxylic acid, salt and/or ester to form another metathesized natural oil.

DETAILED DESCRIPTION

Figure 1:
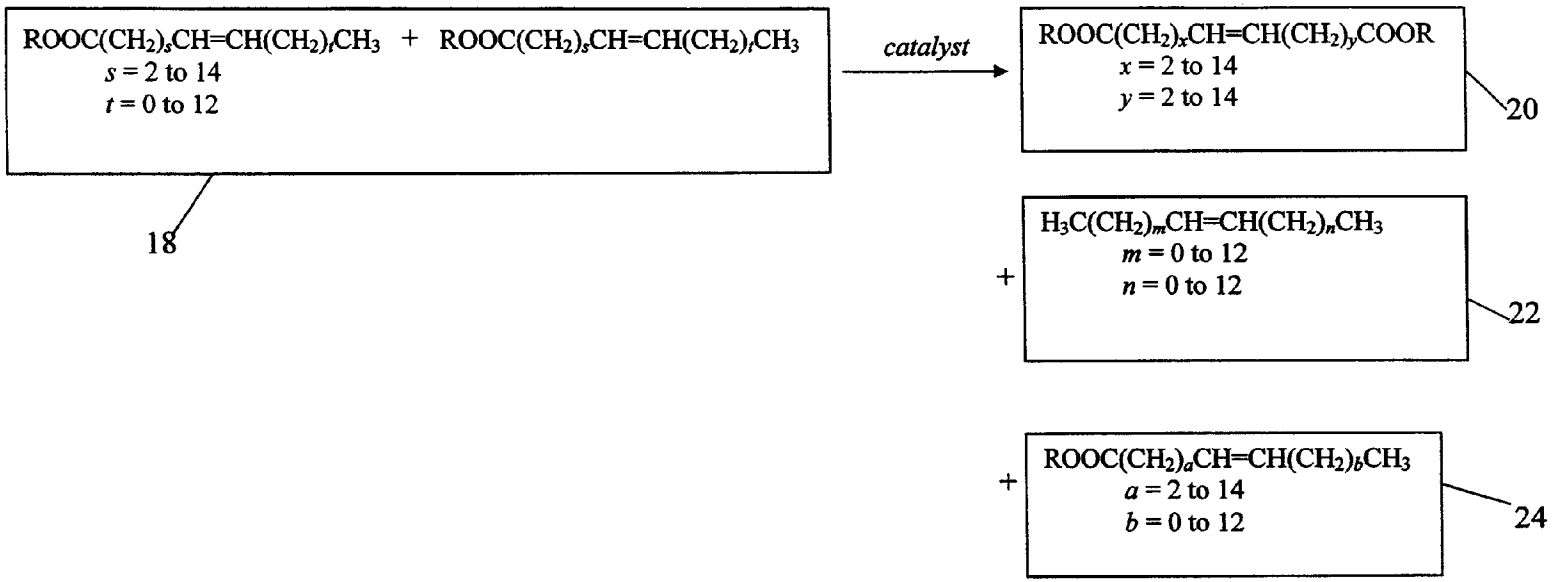
FIG. 1 illustrates an exemplary self-metathesis reaction scheme.

All ranges and ratio limits disclosed in the specification and claims may be combined in any manner. It is to be understood that unless specifically stated otherwise, references to "a," "an," and/or "the" may include one or more than one, and that reference to an item in the singular may also include the item in the plural. All combinations specified in the claims may be combined in any manner.

The term "normally liquid fuel" is used herein to refer to a fuel that is liquid at atmospheric pressure and at the temperature at which it is likely to be stored or used. This distinguishes it from solid fuels such as coal and gaseous fuels such as natural gas.

The term "biofuel" refers to a normally liquid fuel that comprises a natural oil or a natural oil derivative.

The term "biodiesel" refers to a diesel fuel that comprises a natural oil or natural oil derivative.

The term "natural oil" refers to oils or fats derived from plants or animals. The term "natural oil" includes natural oil derivatives, unless otherwise indicated, and such natural oil derivatives may include one or more natural oil derived unsaturated carboxylic acids, salts and/or esters as further described below. Non-limiting examples of natural oils may include vegetable oils, algae oils, fungus oils, animal oils or fats, tall oils, derivatives of these oils, combinations of two or more of these oils, and the like. The natural oils may include, for example, canola oil, rapeseed oil, coconut oil, corn oil, cottonseed oil, olive oil, palm oil, peanut oil, safflower oil, sesame oil, soybean oil, sunflower seed oil, linseed oil, palm kernel oil, tung oil, jatropha oil, mustard oil, camellina oil, pennycress oil, castor oil, coriander oil, almond oil, wheat germ oil, bone oil, lard, tallow, poultry fat, yellow grease, fish oil, mixtures of two or more thereof, and the like. The natural oil (e.g., soybean oil) may be refined, bleached and/or deodorized.

The term "natural oil derived unsaturated carboxylic acid, salt and/or ester" refers to compounds or mixtures of compounds derived from natural oil. The methods used to form these natural oil derivatives may include one or more of addition, neutralization, overbasing, saponification, transesterification, esterification, amidification, hydrogenation (partial or full), isomerization, oxidation, alkylation, acylation, rearrangement, reduction, or a combination of two or more thereof. Examples of natural oil derived unsaturated carboxylic acids, salts and/or esters may include gums, phospholipids, soapstock, acidulated soapstock, distillate or distillate sludge, unsaturated fatty acids, unsaturated fatty acid salts, unsaturated fatty acid esters, as well as hydroxy substituted variations thereof. The unsaturated fatty acid, salt or ester may comprise an alkene chain in the carboxylic acid portion of the molecule from about 4 to about 30 carbon atoms, or from about 10 to about 24 carbon atoms, or from about 16 to about 22 carbon atoms, or about 18 carbon atoms, with a terminal carboxylic acid, salt or ester group, and at least one carbon-carbon double bond in the alkene chain. The fatty acid, salt or ester may be a polyunsaturated fatty acid, salt or ester with 2 to 4 carbon-carbon double bonds in the alkene chain. The natural oil derived unsaturated carboxylic acid, salt and/or ester may comprise an unsaturated fatty acid alkyl (e.g., methyl) ester derived from a glyceride of natural oil. The natural oil may comprise a refined, bleached and/or deodorized natural oil, for example, a refined, bleached, and/or deodorized soybean oil (i.e., RBD soybean oil). Soybean oil typically comprises about 95% by weight or greater (e.g., 99% weight or greater) triglycerides of fatty acids. The fatty acids in the polyol esters of soybean oil may include saturated fatty acids, including palmitic acid (hexadecanoic acid) and stearic acid (octadecanoic acid), and unsaturated fatty acids, including oleic acid (9-octadecenoic acid), linoleic acid (9,12-octadecadienoic acid), and linolenic acid (9,12,15-octadecatrienoic acid).

The term "another olefinic compound" is used herein to refer to a natural oil, a natural oil derived unsaturated carboxylic acid, salt and/or ester, or a short chain olefin of from 2 to about 16 carbon atoms, or from 2 to about 10 carbon atoms, or from 2 to about 6 carbon atoms, or from 2 to about 4 carbon atoms. The short chain olefin may comprise an alpha olefin, an internal olefin, or a mixture thereof. The internal olefin may be symmetric or asymmetric. The short chain olefin may comprise one or more of 2-butene, 3-hexene, 4-octene, 2-pentene, 2-hexene, 2-heptene, 3-heptene, 2-octene, 3-octene, 2-nonene, 3-nonene, 4-nonene, ethylene, 1-propene, 1-butene, 1-pentene, 1-hexene, 1-heptene, 1-octene, 1-nonene, decene, undecene, dodecene, tridecene, tetradecene, pentadecene, hexadecene, or a mixture of two or more thereof.

The term "metathesis reaction" refers to a catalytic reaction which involves the interchange of alkylidene units among compounds containing one or more carbon-carbon double bonds (e.g., olefinic compounds) via the formation and cleavage of the carbon-carbon double bonds. Metathesis may occur between two like molecules (often referred to as self-metathesis) and/or between two different molecules (often referred to as cross-metathesis).

The term "metathesis catalyst" refers to any catalyst or catalyst system that catalyzes a metathesis reaction.

The terms "metathesize" and "metathesizing" refer to the reacting of one or more reactant compounds (e.g., a natural oil or natural oil derived unsaturated carboxylic acid, salt and/or ester) in the presence of a metathesis catalyst to form a metathesized product (e.g., metathesized natural oil) comprising one or more metathesis monomers, oligomers and/or polymers. Metathesizing may refer to self-metathesis or cross-metathesis. For example, metathesizing may refer to reacting two triglycerides present in a natural oil (self-metathesis) in the presence of a metathesis catalyst, wherein each triglyceride has an unsaturated carbon-carbon double bond, thereby forming a monomer, oligomer and/or polymer containing bonded groups derived from the triglycerides. The number of metathesis bonded groups in the metathesized monomers, oligomers and/or polymers may range from 1 to about 100, or from 2 to about 50, or from 2 to about 30, or from 2 to about 10. These may include metathesis monomers, metathesis dimers, metathesis trimers, metathesis tetramers, metathesis pentamers, as well as high order metathesis oligomers (e.g., metathesis hexamers, heptamers, octamers, nonamers, decamers, and the like).

The term "metathesized natural oil" refers to the product formed from the metathesis reaction of a natural oil (or a natural oil derived unsaturated carboxylic acid, salt and/or ester) in the presence of a metathesis catalyst to form a mixture of olefins comprising one or more metathesis monomers, oligomers and/or polymers derived from the natural oil. The number of metathesis bonded groups in the metathesized natural oil monomers, oligomers and/or polymers may range from 1 to about 100, or from 2 to about 50, or from 2 to about 30, or from 2 to about 10. These may include one or more metathesis monomers, metathesis dimers, metathesis trimers, metathesis tetramers, metathesis pentamers, and higher order metathesis oligomers or polymers (e.g., metathesis hexamers, heptamers, octamers, nonamers, decamers, and the like). The metathesized natural oil may be partially to fully hydrogenated, forming a "hydrogenated metathesized natural oil." The hydrogenation step may be conducted prior to or subsequent to the metathesis reaction. The metathesized natural oil may be epoxidized. The metathesized natural oil may be formed from the metathesis reaction of a natural oil comprising more than one natural oil (e.g., a mixture of soybean oil and palm oil). The metathesized natural oil may be formed from the metathesis reaction of a natural oil comprising a mixture of one or more natural oils and one or more natural oil derivatives. The metathesized natural oil may be in the form of a liquid or a solid. The solid may comprise a wax.

The term "metathesized natural oil derivative" refers to the product made by the reaction of a metathesized natural oil with nucleophile (e.g., a nucleophilic nitrogen reagent or a nucleophilic oxygen reagent), an oxidizing agent, an aromatic compound or an enophilic acid reagent. The term "nucleophile" is used herein to refer to a chemical reagent that forms a chemical bond to its reaction partner by donating both bonding electrons. The metathesized natural oil derivative may be in the form of a liquid or a solid. The solid may comprise a wax.

The term "metathesis monomer" refers to a single entity that is the product of a metathesis reaction which comprises a molecule of a compound with one or more carbon-carbon double bonds which has undergone an alkylidene unit interchange via one or more of the carbon-carbon double bonds either within the same molecule (intramolecular metathesis) and/or with a molecule of another compound containing one or more carbon-carbon double bonds such as an olefin (intermolecular metathesis).

The term "metathesis dimer" refers to the product of a metathesis reaction wherein two molecules of two reactant compounds, which can be the same or different and each with one or more carbon-carbon double bonds, are bonded together via one or more of the carbon-carbon double bonds in each of the reactant compounds as a result of the metathesis reaction.

The term "metathesis trimer" refers to the product of one or more metathesis reactions wherein three molecules of two or more reactant compounds, which can be the same or different and each with one or more carbon-carbon double bonds, are bonded together via one or more of the carbon-carbon double bonds in each of the reactant compounds as a result of the one or more metathesis reactions, the trimer containing three bonded groups derived from the reactant compounds.

The term "metathesis tetramer" refers to the product of one or more metathesis reactions wherein four molecules of two or more reactant compounds, which can be the same or different and each with one or more carbon-carbon double bonds, are bonded together via one or more of the carbon-carbon double bonds in each of the reactant compounds as a result of the one or more metathesis reactions, the tetramer containing four bonded groups derived from the reactant compounds.

The term "metathesis pentamer" refers to the product of one or more metathesis reactions wherein five molecules of two or more reactant compounds, which can be the same or different and each with one or more carbon-carbon double bonds, are bonded together via one or more of the carbon-carbon double bonds in each of the reactant compounds as a result of the one or more metathesis reactions, the pentamer containing five bonded groups derived from the reactant compounds.

The term "metathesis hexamer" refers to the product of one or more metathesis reactions wherein six molecules of two or more reactant compounds, which can be the same or different and each with one or more carbon-carbon double bonds, are bonded together via one or more of the carbon-carbon double bonds in each of the reactant compounds as a result of the one or more metathesis reactions, the hexamer containing six bonded groups derived from the reactant compounds.

The term "metathesis heptamer" refers to the product of one or more metathesis reactions wherein seven molecules of two or more reactant compounds, which can be the same or different and each with one or more carbon-carbon double bonds, are bonded together via one or more of the carbon-carbon double bonds in each of the reactant compounds as a result of the one or more metathesis reactions, the heptamer containing seven bonded groups derived from the reactant compounds.

The term "metathesis octamer" refers to the product of one or more metathesis reactions wherein eight molecules of two or more reactant compounds, which can be the same or different and each with one or more carbon-carbon double bonds, are bonded together via one or more of the carbon-carbon double bonds in each of the reactant compounds as a result of the one or more metathesis reactions, the octamer containing eight bonded groups derived from the reactant compounds.

The term "metathesis nonamer" refers to the product of one or more metathesis reactions wherein nine molecules of two or more reactant compounds, which can be the same or different and each with one or more carbon-carbon double bonds, are bonded together via one or more of the carbon-carbon double bonds in each of the reactant compounds as a result of the one or more metathesis reactions, the nonamer containing nine bonded groups derived from the reactant compounds.

The term "metathesis decamer" refers to the product of one or more metathesis reactions wherein ten molecules of two or more reactant compounds, which can be the same or different and each with one or more carbon-carbon double bonds, are bonded together via one or more of the carbon-carbon double bonds in each of the reactant compounds as a result of the one or more metathesis reactions, the decamer containing ten bonded groups derived from the reactant compounds.

The term "metathesis oligomer" refers to the product of one or more metathesis reactions wherein two or more molecules of two or more reactant compounds, which can be the same or different and each with one or more carbon-carbon double bonds, are bonded together via one or more of the carbon-carbon double bonds in each of the reactant compounds as a result of the one or more metathesis reactions, the oligomer containing a few (e.g., 2 to about 10, or 2 to about 4) bonded groups derived from the reactant compounds.

The term "metathesis polymer" refers to the product of one or more metathesis reactions wherein many molecules of two or more reactant compounds, which can be the same or different and each with one or more carbon-carbon double bonds, are bonded together via one or more of the carbon-carbon double bonds in each of the reactant compounds as a result of the one or more metathesis reactions, the polymer containing more than one (e.g., 2 to about 100, or 2 to about 50, or 2 to about 10, or 2 to about 4) bonded groups derived from the reactant compounds.

The term "hydrocarbyl," when referring to groups attached to the remainder of a molecule, refers to groups having a purely hydrocarbon or predominantly hydrocarbon character. These groups include: (1) purely hydrocarbon groups (i.e., aliphatic, alicyclic, aromatic, aliphatic- and alicyclic-substituted aromatic, aromatic-substituted aliphatic and alicyclic groups, as well as cyclic groups wherein the ring is completed through another portion of the molecule (that is, any two indicated substituents may together form an alicyclic group)); (2) substituted hydrocarbon groups (i.e, groups containing non-hydrocarbon substituents such as hydroxy, amino, nitro, cyano, alkoxy, acyl, etc.); and (3) hetero groups (i.e., groups which contain atoms, such as N, O or S, in a chain or ring otherwise composed of carbon atoms). In general, no more than about three substituents or hetero atoms, or no more than one, may be present for each 10 carbon atoms in the hydrocarbyl group.

The term "cold flow additive" is used herein to refer to a composition comprising a metathesized natural oil, a metathesized natural oil derivative, and/or a mixture thereof. The cold flow additive may be in the form of a liquid or a solid. The cold flow additive may be fuel soluble.

The term "cold flow improving amount" is used herein to refer to the amount of cold flow additive required to reduce the cloud point (as determined by the procedure in ASTM D2500-05), pour point (as determined by the procedure in ASTM D97-08) and/or cold filter plugging point (as determined by the procedure in ASTM D6371) of a normally liquid fuel.

The term "fuel soluble" is used herein to refer to a material which is soluble in a petroleum middle distillate to the extent of at least about 100 milligram (mg) of the material per liter of the petroleum middle distillate at a temperature of 20° C.

The term "dropping point," "drop point," or "melting point" are synonymous terms that refer to the temperature at which the cold flow additive itself begins to melt. The drop point may be measured using ASTM-D127-08 or the Mettler Drop Point FP80 system.

The term "needle penetration" may refer to the relative hardness of the cold flow additive itself. The needle penetration may be measured using ASTM-D1321-02a.

The Fuel Composition

The fuel composition may comprise (A) from about 0.1 to about 99.9999 wt %, or from about 5 to about 99.95 wt %, or from about 10 to about 99.9 wt %, or from about 20 to about 99.9 wt %, or from about 30 to about 99.9 wt %, or from about 50 to about 99.9 wt %, or from about 60 to about 99.9 wt %, or from about 70 to about 99.9 wt %, or from about 80 to about 99.9 wt %, or from about 90 to about 99.9 wt %, or from about 95 to about 99.9 wt % of the normally liquid fuel; (B) from about 0.0001 to about 70 wt %, or from about 0.001 to about 50 wt %, or from about 0.01 to about 30 wt %, or from about 0.1 to about 10 wt %, or from about 0.1 to about 5 wt %, or from about 0.1 to about 2 wt %, of a cold flow additive in the form of a metathesized natural oil, metathesized natural oil derivative, or a mixture thereof; and, optionally, additional fuel additives.

The fuel composition may comprise a diesel fuel composition, kerosene, jet fuel, fuel oil composition, heating oil composition or naphtha fuel composition, or a mixture of two or more thereof. The diesel fuel composition may comprise a normally liquid fuel with a boiling range and viscosity suitable for use in a diesel-type engine. The fuel may have an initial boiling point of about 200° C. The fuel may have a 95% point distillation temperature below about 370° C., or below about 350° C., or below about 330° C. The viscosity for the diesel fuel may range from about 1.3 to about 24 centiStokes at 40° C. The diesel fuel may be classified as any of Grade Nos. 1-D, 2-D or 4-D as specified in ASTM D 975 entitled "Standard Specification for Diesel Fuel Oils." In addition to the cold flow additive (B), the diesel fuel may contain one or more additives for increasing horsepower and improving fuel economy, lubricating and reducing wear of injectors and other engine components, cleaning and preventing deposit buildup, reducing smoke and particulate emissions, removing water, fighting rust and corrosion, upgrading and stabilizing the fuel, and the like. The diesel fuel composition may have a sulfur content of up to about 0.05 wt %, or up to about 0.02 wt %, or up to about 0.01 wt %, or up to about 0.005 wt %, or up to about 0.001 wt %, or up to about 500 ppm, or up to about 350 ppm, or up to about 200 ppm, or up to about 100 ppm, or up to about 50 ppm, or less. The diesel fuel composition may be sulfur free.

Kerosene is a thin, clear liquid formed from hydrocarbons with carbon chains typically in the range from about 6 to about 16 carbon atoms per molecule. Kerosene may be obtained from the fractional distillation of petroleum at a temperature in the range from about 150° C. to about 275° C. Kerosene may have a flash point in the range from about 37 to about 65° C., and an autoignition temperature of about 220° C. Kerosene fuel compositions may include, in addition to the cold flow additive (B), additives for improving storage and combustion capabilities. Kerosene is sometimes referred to as paraffin, and may be used to power jet-engine aircraft (jet fuel), rockets, and may also be used as a heating oil.

Jet fuel is a type of aviation fuel designed for use in aircraft powered by gas-turbine engines. The jet fuel may include Jet A and Jet A-1 which are produced to a standardized international specification. The jet fuel may also be Jet B which is used for enhanced cold-weather performance. Jet A and Jet-1 may have carbon number distributions between about 8 and about 16 carbon atoms. Jet B may have a carbon atom distribution of about 5 to about 15 carbon atoms. Jet A and Jet A-1 have flash points of greater than about 38° C. with autoignition temperatures of about 210° C. Jet A has a freezing point of −40° C., and Jet A-1 has a freezing point of −47° C. Jet B is a fuel in the naphtha-kerosene region that is used for enhanced cold-weather performance. In addition to the cold flow additive (B), the jet fuel compositions may include one or more antioxidants, antistatic agents, corrosion inhibitors, fuel system icing inhibitors, biocides, metal deactivators, mixtures of two or more thereof, and the like.

Fuel oil may comprise any liquid fuel that is burned in a furnace or boiler for the generation of heat or used in an engine for the generation of power. Diesel fuel is a type of fuel oil. The American Society for Testing and Materials (ASTM) has published specification for six grades of fuel oil, numbered 1 through 6. Number 1 fuel oil is a volatile distillate oil intended for vaporizing pot-type burners. It is the kerosene refinery cut that boils off right after the heavy naphtha cut used for gasoline. Number 2 fuel oil is a distillate home heating oil. Number 3 fuel oil is used for burners requiring low-viscosity fuel. ASTM merged Number 3 fuel oil into the Number 2 specification and as a result this term is rarely used. Number 4 fuel oil is a commercial heating oil for burner installations not equipped with preheaters. Number 5 fuel oil is a residual-type industrial heating oil requiring preheating for proper atomization at the burners. Number 6 fuel oil is a high-viscosity residual oil requiring preheating. The term "residual" refers to material remaining after the more valuable cuts of crude oil have boiled off. Number 6 fuel oil may be referred as residual fuel oil. Fuel oils also include bunker fuel which may be any type of fuel oil used aboard ships. In addition to the cold flow additive (B), the fuel oil composition may include one or more additives for reducing sludge formation; reducing fuel line and filter clogging; improving fuel atomization; reducing deposits on burner nozzles; enhancing flame stabilization; improving combustion; reducing soot formation; neutralizing vanadium and sodium; improving heat transfer; reducing the formation of sulfur trioxide; reducing stack temperatures; reducing carbon monoxide, oxygen and unburnt hydrocarbon in stack gases; reducing fuel consumption; and the like.

Heating oil is a low viscosity, flammable liquid fuel product which may be used as a fuel for furnaces or boilers in buildings. Heating oil is similar to diesel fuel. Heating oil may have a boiling point in the range of about 250° C. to about 350° C. and may consist of a mixture of hydrocarbons in the 14 to 20 carbon atom range. Heating oil compositions may include, in addition to the cold flow additive (B), additives for improving storage and combustion capabilities.

Naphtha refers to a number of different flammable liquid mixtures of hydrocarbons. Naphtha may include full range naphtha which consists of a fraction of hydrocarbons boiling in the range of about 30° C. to about 200° C., light naphtha which is a fraction boiling between about 30° C. and about 90° C., and heavy naphtha which boils between about 90° C. and about 200° C. Full range naphtha may comprise hydrocarbons containing from about 5 to about 12 carbon atoms, while light naphtha may consist of molecules of about 5 to about 6 carbon atoms, and heavy naphtha may consist of molecules of about 6 to about 12 carbon atoms. In addition to the cold flow improver (B), naphtha fuel compositions may include one or more antioxidants, demulsifiers, biocides, and the like.

The cold flow additives (B) of the invention may be introduced into the normally liquid fuel (A) using known methods. When more than one additive component or co-additive components are to be used (e.g., a cold flow additive and another additive with a different function), these additives may be introduced into the normally liquid fuel together or separately in any desired combination.

To prepare additive packages for specific solutions to problems, the cold flow additives (B) may also be used together with one or more additives which may improve the cold flow properties and/or other properties of the normally liquid fuel. Examples of such co-additives may include those referred to above as well as polar compounds which effect paraffin dispersion (paraffin dispersants), oil-soluble amphiphiles, other pour point depressants or dewaxing additives, corrosion inhibitors, antioxidants, sludge inhibitors, dehazers, additional additives for reducing the cloud point, and the like.

The paraffin dispersants may be used to reduce the size of paraffin crystals in the normally liquid fuel (A). The paraffin dispersants may be used to effect colloidal dispersions of the paraffin crystals and reduce sedimentation. The paraffin dispersants may comprise oil-soluble polar compounds having ionic or polar groups, for example, amine salts and/or amides, obtained by reacting aliphatic and/or aromatic amines, for example, long-chain aliphatic amines, with aliphatic or aromatic mono-, di-, tri- or tetracarboxylic acids or their anhydrides. The paraffin dispersants may comprise copolymers of maleic anhydride and alpha, beta unsaturated compounds which may optionally be reacted with primary monoalkylamines and/or aliphatic alcohols.

The specific composition of the inventive cold flow additive (B) may be tailored based on the particular normally liquid fuel (A) that is employed in order to optimize the desired low temperature flow modification behavior.

The cold flow additive (B), as well as other additives, may be added directly to the normally liquid fuel (A), or they may be diluted with a substantially inert, normally liquid organic diluent such as naphtha, benzene, toluene, xylene, or a normally liquid fuel as described above, to form an additive concentrate, which may then be added to the normally liquid fuel. These concentrates may contain from about 0.1 to about 99 wt %, or from about 10% to about 90% by weight, of the cold flow additive (B), and may also contain one or more of other additives known in the art or described hereinabove.

(A) The Normally Liquid Fuel

The normally liquid fuel may comprise any normally liquid fuel, including any normally liquid fuel having a cloud point and/or pour point within the temperature at which the fuel is to be used. The term "cloud point" refers to the temperature at which wax crystals appear when a normally liquid fuel is cooled. The cloud point is indicative of the tendency of the fuel to plug filters or small orifices under cold weather conditions. A test method for measuring cloud point is provided in ASTM D2500-05. The term "pour point" refers to the lowest temperature at which a normally liquid fuel will flow when cooled. The pour point is indicative of the ability of a normally liquid fuel to flow at cold operating temperatures. A test for measuring pour point is provided in ASTM D97-08.

The normally liquid fuel may comprise a natural oil, natural oil derivative, or a mixture thereof. The natural oil may comprise a vegetable oil, animal fat or oil, or a mixture thereof. These may be referred to as biofuels or biodiesel fuels.

The normally liquid fuel may comprise a hydrocarbon oil (e.g., a petroleum or crude oil distillate), or a mixture of a hydrocarbon oil and a natural oil or natural oil derivative.

The normally liquid fuel may comprise a synthetic fuel. The synthetic fuel may be derived from coal, natural gas, oil shale, biomass, or a mixture of two or more thereof. The synthetic fuel may be derived from a Fischer-Tropsch process.

The normally liquid fuel may comprise a middle distillate fuel. The term "middle distillate fuel" is used herein to refer to the source of the fuel (e.g., middle distillate derived from petroleum or crude oil, i.e., a "petroleum middle distillate"), or to a normally liquid fuel that is not necessarily derived from petroleum or crude oil (e.g., a natural oil, a natural oil derivative, a synthetic fuel, and the like) but has properties (e.g., boiling point range, etc.) comparable to a petroleum middle distillate. The middle distillate fuel may comprise kerosene, jet fuel, diesel fuel, fuel oil, heating oil, naphtha, or a mixture of two or more thereof, and the like.

The petroleum middle distillates may comprise hydrocarbon oils obtained by distilling petroleum or crude oil. The middle distillates may have boiling points in the range from about 120° to about 450° C. These may include kerosene, jet fluid, diesel oil, fuel oil, heating oil, naphtha, and the like. The petroleum middle distillates may be subjected to refining under hydrogenating conditions to reduce the level of polyaromatic and/or polar compounds in the fuel.

The natural oils useful as the normally liquid fuel may comprise one or more oils or fats derived from plants or animals. These may include vegetable oils, algae oils, fungus oils, animal oils or fats, tall oils, derivatives of these oils, combinations of two or more of these oils, and the like. The natural oils may include canola oil, rapeseed oil, coconut oil, corn oil, cottonseed oil, olive oil, palm oil, peanut oil, safflower oil, sesame oil, soybean oil, sunflower seed oil, linseed oil, palm kernel oil, tung oil, jatropha oil, mustard oil, camellina oil, pennycress oil, castor oil, coriander oil, almond oil, wheat germ oil, bone oil, lard, tallow, poultry fat, yellow grease, fish oil, mixtures of two or more thereof, and the like. The natural oil may be refined, bleached and/or deodorized.

The natural oil derived unsaturated carboxylic acids, salts and/or esters useful as the normally liquid fuel may include fatty acid alkyl esters made from fatty acids having from about 4 to about 30 carbon atoms, or from about 10 to about 24 carbon atoms, or from about 16 to about 24 carbon atoms, or from about 16 to about 22 carbon atoms, or about 18 carbon atoms, and alcohols having from 1 to 4 carbon atoms. Useful alkyl esters of fatty acids may include methyl, ethyl, propyl and/or butyl esters of fatty acids having from about 4 to about 30 carbon atoms, or from about 10 to about 24 carbon atoms, or from about 16 to about 22 carbon atoms, or about 18 carbon atoms. These may include decenoic acid, undecenoic acid, dodecenoic acid, octadecanedioic acid, lauric acid, myristic acid, palmitic acid, palmitoleic acid, stearic acid, oleic acid, elaidic acid, petroseliric acid, ricinoleic acid, eleostearic acid, linoleic acid, linolenic acid, eicosanoic acid, gadoleinic acid, docosanoic acid, erucic acid, or a mixture of two or more thereof. The fatty acids may contain one, two, three or four carbon-carbon double bonds. These may have iodine numbers in the range from about 50 to about 150, or from about 90 to about 125. The term "iodine number" refers to the mass of iodine in grams consumed by 100 grams of a chemical substance and may be used as a measure of unsaturation in fatty acids. A test for determining iodine numbers is provided in ASTM D5768.

The natural oil derived unsaturated carboxylic acids, salts and/or esters may comprise one or more alkyl fatty acids and/oresters derived from one or more of natural oils, including canola oil, rapeseed oil, coconut oil, corn oil, cottonseed oil, olive oil, palm oil, peanut oil, safflower oil, sesame oil, soybean oil, sunflower seed oil, linseed oil, palm kernel oil, tung oil, jatropha oil, mustard oil, camellina oil, pennycress oil, castor oil, coriander oil, almond oil, wheat germ oil, bone oil, lard, tallow, poultry fat, algal oil, yellow grease, fish oil, or a mixture of two or more thereof. The natural oil derived unsaturated carboxylic acids, salts and/or esters may be derived from canola oil, rapeseed oil, coconut oil, corn oil, cottonseed oil, olive oil, palm oil, peanut oil, safflower oil, sesame oil, soybean oil, sunflower seed oil, linseed oil, palm kernel oil, tung oil, jatropha oil, mustard oil, camellina oil, pennycress oil, castor oil, coriander oil, almond oil, wheat germ oil, bone oil, lard, tallow, poultry fat, algal oil, yellow grease, fish oil or a mixture of two or more thereof. These may include rapeseed oil fatty acid methyl ester, sunflower seed oil fatty acid methyl ester, soybean oil fatty acid methyl ester, or a mixture of two or more thereof. The fatty acid alkyl esters may be derived from these oils by processes known in the art.

Although many of the above oils may be used to provide useful biofuels, as the normally liquid fuel, alkyl ester derivatives of canola oil, rapeseed oil, coconut oil, corn oil, cottonseed oil, olive oil, palm oil, peanut oil, safflower oil, sesame oil, soybean oil, sunflower seed oil, linseed oil, palm kernel oil, tung oil, jatropha oil, mustard oil, camellina oil, pennycress oil, castor oil, coriander oil, almond oil, wheat germ oil, bone oil, lard, tallow, poultry fat, algal oil, yellow grease, fish oil, and in particular rapeseed oil methyl ester, canola oil methyl ester, palm oil methyl ester, and soybean oil methyl ester may be particularly useful.

Rapeseed oil, which comprises a mixture of fatty acids partially esterified with glycerol, may be particularly useful since it may be obtained in large amounts by extractive pressing of rapeseeds. Sunflower seed oil, soybean oil, canola oil, palm oil, and/or mixtures thereof, may also be particularly useful.

Mixtures of alkyl esters of fatty acids having advantageous properties may include those which comprise mainly (that is, at least about 50% by weight) methyl esters of fatty acids having from about 16 to about 22 carbon atoms, and 1, 2, 3 or 4 carbon-carbon double bonds. These may include the methyl esters of oleic acid, linoleic acid, erucic acid, or a mixture of two or more thereof.

Alkyl fatty acid esters that may be useful may be obtained by hydrolyzing and esterifying natural oils or by transesterifying oils directly with relatively low aliphatic alcohols. To prepare useful alkyl esters of fatty acids, it may be advantageous to start with fats and/or oils having a high iodine number (i.e., an iodine number in the range from about 50 to about 150), for example sunflower seed oil, rapeseed oil, coriander oil, castor oil, soybean oil, cottonseed oil, peanut oil, bovine tallow, or a mixture of two or more thereof. Alkyl esters of fatty acids derived from rapeseed oil where more than about 80% by weight of the fatty acid component comprises one or more unsaturated fatty acids having about 18 carbon atoms may be particularly useful. In addition, alkyl esters of fatty acids derived from soybean oil, canola oil, and palm oil may also be particularly useful.

Biofuels may be regarded as being less damaging to the environment on combustion, and are advantageous because they are obtained from renewable sources. Less carbon dioxide may be formed on combustion with biofuels than with an equivalent amount of petroleum middle distillate, for example, petroleum diesel, and very little sulfur dioxide may be formed using biofuels.

The normally liquid fuel may comprise a mixture of one or more biofuels with one or more hydrocarbon oils (e.g., a petroleum middle distillate or a petroleum diesel). The ratio between the biofuel and the hydrocarbon oil may be from about 1:99 to about 99:1, or from about 1:99 to about 10:90 (based on volume). These mixtures may contain up to about 99% by volume of the biofuel, or up to about 90%, or up to about 75%, or up to about 50%, or up to about 25%, or up to 20% by volume, or up to about 15%, or up to about 10%, or up to about 5% by volume, of the biofuel. Mixtures of rapeseed oil esters, for example rapeseed oil methyl ester, with petroleum diesel at a ratio of about 5:95 (i.e., 5% ester and 95% petroleum diesel) to about 15:85, or about 10:90 (based on volume) may be used.

The Cold Flow Additive (B)

The cold flow additive (B) may comprise a metathesized natural oil, a metathesized natural oil derivative, or a mixture thereof. The metathesized natural oil may be the product of a self-metathesis process, a cross-metathesis process, or a combination thereof. The self-metathesis process may comprise reacting a natural oil or natural oil derivative in the presence of a metathesis catalyst to form the metathesized natural oil.

The cross-metathesis process may comprise reacting (a) a natural oil or natural oil derivative with (b) another olefinic compound in the presence of a metathesis catalyst to form the metathesized natural oil. The another olefinic compound may be a natural oil, a natural oil derivative or a short chain olefin. The short chain olefin may comprise an alpha olefin, an internal olefin, or a mixture thereof. The internal olefin may be symmetric or asymmetric. The olefin may comprise one or more of 2-butene, 3-hexene, 4-octene, 2-pentene, 2-hexene, 2-heptene, 3-heptene, 2-octene, 3-octene, 2-nonene, 3-nonene, 4-nonene, ethylene, 1-propene, 1-butene, 1-pentene, 1-hexene, 1-heptene, 1-octene, 1-nonene, decene, undecene, dodecene, tridecene, tetradecene, pentadecene, hexadecene, or a mixture of two or more thereof.

Multiple, sequential metathesis reaction steps may be employed. For example, the metathesized natural oil may be made by reacting a natural oil or natural oil derivative in the presence of a metathesis catalyst to form a first metathesized natural oil. The first metathesized natural oil may then be reacted in a self-metathesis reaction to form another metathesized natural oil. Alternatively, the first metathesized natural oil may be reacted in a cross-metathesis reaction with a natural oil and/or natural oil derivative to form another metathesized natural oil. These procedures may be used to form metathesis dimers, trimers as well as higher order metathesis oligomers and polymers. These procedures can be repeated as many times as desired (for example, from 2 to about 50 times, or from 2 to about 30 times, or from 2 to about 10 times, or from 2 to about 5 times, or from 2 to about 4 times, or 2 or 3 times) to provide the desired metathesis oligomer or polymer which may comprise, for example, from 2 to about 100 bonded groups, or from 2 to about 50, or from 2 to about 30, or from 2 to about 10, or from 2 to about 8, or from 2 to about 6 bonded groups, or from 2 to about 4 bonded groups, or from 2 to about 3 bonded groups.

The metathesized natural oil produced by the metathesis reaction process may comprise a mixture of olefins and/or esters comprising one or more metathesis monomers, oligomers and/or polymers derived from the unsaturates in the natural oil. The number of bonded groups in the metathesized natural oil monomers, oligomers or polymers may range from 1 to about 100, or from 2 to about 50, or from 2 to about 30, or from 2 to about 10. These may include metathesis monomers, metathesis dimers, metathesis trimers, metathesis tetramers, metathesis pentamers, and higher order metathesis oligomers or polymers (e.g., metathesis hexamers, heptamers, octamers, nonamers, decamers, and the like).

The metathesized natural oil derivative may comprise the reaction product of the metathesized natural oil with a nucleophilic nitrogen reagent, a nucleophilic oxygen reagent, an enophilic acid reagent, an oxidizing agent, or an aromatic compound. The metathesized natural oil or metathesized natural oil derivative may be in the form of a liquid or a solid which may be soluble in the normally liquid fuel. The solid form of these additives may comprise one or more waxes.

The Metathesis Reactants

The natural oil used as a starting material or reactant in the metathesis reaction process may comprise one or more oils or fats derived from plants and/or animals. The natural oils may include vegetable oils, algae oils, fungus oils, animal oils or fats, tall oils, derivatives of these oils, combinations of two or more of these oils, and the like. The natural oils may include canola oil, rapeseed oil, coconut oil, corn oil, cottonseed oil, olive oil, palm oil, peanut oil, safflower oil, sesame oil, soybean oil, sunflower seed oil, linseed oil, palm kernel oil, tung oil, jatropha oil, mustard oil, camellina oil, pennycress oil, castor oil, coriander oil, almond oil, wheat germ oil, bone oil, lard, tallow, poultry fat, yellow grease, fish oil, mixtures of two or more thereof, and the like. The natural oil may be refined, bleached and/or deodorized.

The natural oil derived unsaturated carboxylic acid, salt and/or ester used as a starting material or reactant in the metathesis reaction process may comprise one or more unsaturated fatty acids which may comprise an alkene chain of from about 4 to about 30 carbon atoms, or from about 10 to about 24 carbon atoms, or from about 16 to about 24 carbon atoms, or from about 16 to about 22 carbon atoms, or about 18 carbon atoms, with a terminal carboxylic acid group, and at least one carbon-carbon double bond in the alkene chain. The unsaturated fatty acid may be a polyunsaturated fatty acid with, for example, 2, 3 or 4 carbon-carbon double bonds in the alkene chain.

The natural oil derived unsaturated carboxylic acid, salt and/or ester used as a starting material or reactant for the metathesis reaction process may include one or more carboxylate salts. These may comprise one or more metal salts of an unsaturated fatty acid. The carboxylic salt may comprise an alkene chain of about 4 to about 30 carbon atoms, or from about 10 to about 24 carbon atoms, or from about 16 to about 24 carbon atoms, or from about 16 to about 22 carbon atoms, or about 18 carbon atoms, and at least one carbon-carbon double bond in the alkene chain. The carboxylate salt may be the salt of a polyunsaturated fatty acid with, for example, 2, 3 or 4 carbon-carbon double bonds in the alkene chain. The metal may be an alkali metal, an alkaline earth metal, a group IIIA metal, a group IVA metal, a group VA metal, a transition metal, a metal from the lanthanide series, a metal from the actinide series, or a mixture of two or more thereof.

The natural oil derived unsaturated carboxylic acid, salt and/or ester used as a starting material or reactant for the metathesis reaction process may comprise one or more unsaturated fatty esters which may comprise an alkene chain of about 4 to about 30 carbon atoms, or from about 10 to about 24 carbon atoms, or from about 16 to about 24 carbon atoms, or from about 16 to about 22 carbon atoms, or about 18 carbon atoms, with a terminal ester group, and at least one carbon-carbon double bond in the alkene chain. The unsaturated fatty ester may comprise a polyunsaturated fatty ester with, for example, 2, 3 or 4 carbon-carbon double bonds in the alkene chain. The unsaturated fatty ester may comprise an unsaturated monoester, an unsaturated polyol ester, or a mixture thereof. The unsaturated monoester may be derived from an alcohol containing from 1 to about 10 carbon atoms, or from 1 to about 4 carbon atoms. The unsaturated polyol ester may be derived from a polyol containing from 2 to about 10 carbon atoms, and from 2 to about 6 hydroxyl groups. The unsaturated fatty ester may comprise one or more an unsaturated glycerides. The unsaturated glyceride may comprise an unsaturated monoglyceride, an unsaturated diglyceride, an unsaturated triglyceride, or a mixture of two or more thereof.

The unsaturated fatty acid, salt or ester reactant may be derived from a plant-based or vegetable oil or an animal fat or oil. Representative examples of plant-based or vegetable oils may include canola oil, rapeseed oil, coconut oil, corn oil, cottonseed oil, olive oil, palm oil, peanut oil, safflower oil, sesame oil, soybean oil, sunflower seed oil, linseed oil, palm kernel oil, tung oil, castor oil, tall oil, coriander oil, almond oil, wheat germ oil, and the like. Representative examples of animal fats include lard, tallow, poultry fat, yellow grease, bone oil, and fish oil. Other useful oils may include tall oil, algae oil, and the like.

The plant-based or vegetable oil may comprise soybean oil. Soybean oil may comprise unsaturated glycerides, for example, in many embodiments about 95% weight or greater (e.g., 99% weight or greater) triglycerides. Major fatty acids making up soybean oil include saturated fatty acids, palmitic acid (hexadecanoic acid) and stearic acid (octadecanoic acid), and unsaturated fatty acids, oleic acid (9-octadecenoic acid), linoleic acid (9,12-octadecadienoic acid), and linolenic acid (9,12,15-octadecatrienoic acid). Soybean oil is a highly unsaturated vegetable oil with many of the triglyceride molecules having at least two unsaturated fatty acids.

The natural oil or natural oil derived unsaturated carboxylic acid, salt and/or ester starting material or reactant for the metathesis reaction process may comprise a polyunsaturated fatty acid, a carboxylate salt of a polyunsaturated fatty acid, or a polyunsaturated fatty ester (including polyunsaturated monoesters and polyol esters with at least one polyunsaturated fatty acid), or a mixture thereof. These may be partially hydrogenated prior to conducting the metathesis reaction.

The term "polyunsaturated fatty acid" refers to compounds that have a polyunsaturated alkene chain with a terminal carboxylic acid group. The alkene chain may be linear or branched and may optionally include one or more functional groups in addition to the carboxylic acid group. For example, the alkene chains may include one or more hydroxyl groups. The polyunsaturated alkene chain may contain about 4 to about 30 carbon atoms, or from about 4 to about 24 carbon atoms, or from about 10 to about 24 carbon atoms, or from about 16 to about 24 carbon atoms, or from about 14 to about 24 carbon atoms, or from about 16 to about 22 carbon atoms. The alkene chain may contain about 18 carbon atoms (i.e., a $C_{18}$ fatty acid). The polyunsaturated fatty acids, salts or esters may have at least two carbon-carbon double bonds in the alkene chain. In exemplary embodiments, the polyunsaturated fatty acid may have 2, 3 or 4 carbon-carbon double bonds in the alkene chain.

The term "polyunsaturated fatty ester" refers to compounds that have a polyunsaturated alkene chain with a terminal ester group. The alkene chain may be linear or branched and may optionally include one or more functional groups in addition to the ester group. For example, the polyunsaturated fatty ester may include one or more hydroxyl groups in addition to the ester group. Polyunsaturated fatty esters may include "polyunsaturated monoesters" and "polyunsaturated polyol esters". Polyunsaturated monoesters may comprise polyunsaturated fatty acids that are esterified to monofunctional alcohols. These alcohols may contain from 1 to about 10 carbon atoms, or from 1 to about 4 carbon atoms, and may include methanol, ethanol, propanol, butanol, mixtures of two or more thereof, and the like.

Polyunsaturated polyol esters may have at least one polyunsaturated fatty acid that is esterified to the hydroxyl group of polyol. The polyol may contain from 2 to about 10 carbon atoms, and from 2 to about 6 hydroxyl groups. Examples may include ethylene glycol, glycerol, trimethylolpropane, 1,2-propanediol, 1,3-propanediol, 1,2-butanediol, 1,3-butanediol, 2,3-butanediol, 2-ethyl-1,3-propanediol, 2-ethyl-2-butyl-1,3-propanediol, neopentyl glycol, 2,2,4-trimethyl-1,3-pentanediol, pentaerythritol, sorbitol, mixtures of two or more thereof, and the like.

The alkene chain of polyunsaturated monoesters or polyol esters may contain from about 4 to about 30 carbon atoms, or from about 4 to 24 carbon atoms, or from about 10 to about 24 carbon atoms, or from about 16 to about 24 carbon atoms, or from about 16 to about 22 carbon atoms. In exemplary embodiments, the alkene chain may contain about 18 carbon atoms (i.e., a $C_{18}$ fatty ester). The alkene chain in polyunsaturated monoesters has at least two carbon-carbon double bonds and may have more than two double bonds. The unsaturated fatty ester may have 2, 3 or 4 carbon-carbon double bonds in the alkene chain. In polyol esters, at least one fatty acid in the polyol ester is a polyunsaturated fatty acid. The remaining fatty acids making up the polyol ester may be saturated, monounsaturated, or polyunsaturated.

The carboxylate salts of the polyunsaturated fatty acids may comprise one or more metal salts. The metal salts may be salts of alkali metals (e.g., a group IA metal such as Li, Na, K, Rb, and Cs); alkaline earth metals (e.g., group IIA metals such as Be, Mg, Ca, Sr, and Ba); group IIIA metals (e.g., B, Al, Ga, In, and Tl); group IVA metals (e.g., Sn and Pb), group VA metals (e.g., Sb and Bi), transition metals (e.g., Sc, Ti, V, Cr, Mn, Fe, Co, Ni, Cu, Zn, Zr, Mo, Ru, Rh, Pd, Ag and Cd), lanthanides or actinides.

The polyunsaturated fatty acid, ester, or carboxylate salt may have a straight alkene chain and can be represented by the general formula:

$$CH_3—(CH_2)_{n1}—[—(CH_2)_{n3}—CH{=}CH—]_x—(CH_2)_{n2}—COOR$$

where:

R is hydrogen (fatty acid), an aliphatic or aromatic group (fatty ester), or a metal ion (carboxylate salt);

n1 is an integer equal to or greater than 0 (typically 0 to 15; more typically 0, 3, or 6);

n2 is an integer equal to or greater than 0 (typically 2 to 11; more typically 3, 4, 7, 9, or 11);

n3 is an integer equal to or greater than 0 (typically 0 to 6; more typically 1); and x is an integer equal to or greater than 2 (typically 2 to 6, more typically 2 to 3).

The polyunsaturated fatty acids and esters may include those provided in the following Table A.

TABLE A

Unsaturated Fatty Acids/Esters

| Type | General Formula | Examples of fatty acids | Examples of fatty esters |
|---|---|---|---|
| Polyunsaturated | Diunsaturated $CH_3—(CH_2)_{n1}—[—(CH_2)_{n3}—CH{=}CH—]_x—(CH_2)_{n2}—COOR$ Where x is 2, and n1, n2, n3, and R are as described above. | Linoleic acid (x = 2, n1 = 3; n2 = 7; n3 = 1; and R is H.) | Methyl Linoleate (x = 2, n1 = 3; n2 = 7; n3 = 1; and R is CH3.) |
| | Triunsaturated $CH_3—(CH_2)_{n1}—[—(CH_2)_{n3}—CH{=}CH—]_x—(CH_2)_{n2}—COOR$ Where x is 3, and n1, n2, n3, and R are as described above. | Linolenic acid (x = 3, n1 = 0; n2 = 7; n3 = 1; and R is H.) | Methyl Linolenate (x = 3, n1 = 0; n2 = 7; n3 = 1; and R is CH3.) |

Polyunsaturated monoesters may be alkyl esters (e.g., methyl esters) or aryl esters and may be derived from polyunsaturated fatty acids or polyunsaturated glycerides by transesterifying with a monohydric alcohol. The monohydric alcohol may be any monohydric alcohol that is capable of reacting with the unsaturated free fatty acid or unsaturated glyceride to form the corresponding unsaturated monoester. The monohydric alcohol may be a $C_1$ to $C_{20}$ monohydric alcohol, or a $C_1$ to $C_{12}$ monohydric alcohol, or a $C_1$ to $C_8$ monohydric alcohol, or a $C_1$ to $C_4$ monohydric alcohol. The carbon atoms of the monohydric alcohol may be arranged in a straight chain or in a branched chain structure, and may be substituted with one or more substituents. Representative examples of monohydric alcohols include methanol, ethanol, propanol (e.g., isopropanol), butanol, mixtures of two or more thereof, and the like.

Transesterification of a polyunsaturated triglyceride may be represented as follows.

1 Polyunsaturated Triglyceride+3 Alcohol→1 Glycerol+1-3 Polyunsaturated Monoester Depending upon the make-up of the polyunsaturated triglyceride, the above reaction may yield one, two, or three moles of polyunsaturated monoester. Transesterification may be conducted in the presence of a catalyst, for example, alkali catalysts, acid catalysts, or enzymes. Representative alkali transesterification catalysts may include NaOH, KOH, sodium and potassium alkoxides (e.g., sodium methoxide), sodium ethoxide, sodium propoxide, sodium butoxide. Representative acid catalysts may include sulfuric acid, phosphoric acid, hydrochloric acid, and sulfonic acids. Organic or inorganic heterogeneous catalysts may also be used for transesterification. Organic heterogeneous catalysts may include sulfonic and fluorosulfonic acid-containing resins. Inorganic heterogeneous catalysts may include alkaline earth metals or their salts such as CaO, MgO, calcium acetate, barium acetate, natural clays, zeolites, Sn, Ge or Pb, which may be supported on various support materials such as ZnO, MgO, $TiO_2$, activated carbon or graphite, inorganic oxides such as alumina, silica-alumina, boria, and the like. The catalysts may comprise one or more of P, Ti, Zr, Cr, Zn, Mg, Ca, Fe, or an oxide thereof. The triglyceride may be transesterified with methanol ($CH_3OH$) in order to form free fatty acid methyl esters.

The polyunsaturated fatty esters may comprise polyunsaturated polyol esters. The polyunsaturated polyol ester compounds may have at least one polyunsaturated fatty acid that is esterified to the hydroxyl group of a polyol. The other hydroxyl groups of the polyol may be unreacted, may be esterified with a saturated fatty acid, or may be esterified with a monounsaturated fatty acid. Examples of polyols include glycerol and 1,3 propanediol, as well as those mentioned above. The unsaturated polyol esters may have the general formula:

$$R(O—Y)_m(OH)_n(O—X)_b$$

where

R is an organic group having a valency of (n+m+b);

m is an integer from 0 to (n+m+b−1), typically 0 to 2;

b is an integer from 1 to (n+m+b), typically 1 to 3;

n is an integer from 0 to (n+m+b−1), typically 0 to 2;

(n+m+b) is an integer that is 2 or greater;

X is $—(O)C—(CH_2)_{n2}—[—CH{=}CH—(CH_2)_{n3}—]_x—(CH_2)_{n1}—CH_3$;

Y is —(O)C—R';

R' is a straight or branched chain alkyl or alkenyl group;

n1 is an integer equal to or greater than 0 (typically 0 to 15; more typically 0, 3, or 6);

n2 is an integer equal to or greater than 0 (typically 2 to 11; more typically 3, 4, 7, 9, or 11);

n3 is an integer equal to or greater than 0 (typically 0 to 6; more typically 1); and x is an integer equal to or greater than 2 (typically 2 to 6, more typically 2 to 3).

The polyunsaturated polyol esters may be polyunsaturated glycerides. The term "polyunsaturated glyceride" refers to a polyol ester having at least one (e.g., 1 to 3) polyunsaturated fatty acid that is esterified to a molecule of glycerol. The fatty acid groups may be linear or branched and may include pendant hydroxyl groups. The polyunsaturated glycerides may be represented by the general formula:

$$CH_2A\text{-}CHB—CH_2C$$

where -A; -B; and -C are selected from

—OH;

$—O(O)C—(CH_2)_{n2}—[—CH{=}CH—(CH_2)_{n3}—]_x—(CH_2)_{n1}—CH_3$; and

—O(O)C—R';

with the proviso that at least one of -A, -B, or -C is $—O(O)C—(CH_2)_{n2}—[—CH{=}CH—(CH_2)_{n3}—]—(CH_2)_{n1}—CH_3$.

In the above formula:

R' is a straight or branched chain alkyl or alkenyl group;

n1 is an integer equal to or greater than 0 (typically 0 to 15; more typically 0, 3, or 6);

n2 is an integer equal to or greater than 0 (typically 2 to 11; more typically 3, 4, 7, 9, or 11);

n3 is an integer equal to or greater than 0 (typically 0 to 6; more typically 1); and x is an integer equal to or greater than 2 (typically 2 to 6, more typically 2 to 3).

Polyunsaturated glycerides having two —OH groups (e.g., -A and -B are —OH) are commonly known as unsaturated monoglycerides. Unsaturated glycerides having one —OH group are commonly known as unsaturated diglycerides. Unsaturated glycerides having no —OH groups are commonly known as unsaturated triglycerides.

The polyunsaturated glyceride may include monounsaturated fatty acids, polyunsaturated fatty acids, and saturated fatty acids that are esterified to the glycerol molecule. The main chain of the individual fatty acids may have the same or different chain lengths. Accordingly, the unsaturated glyceride may contain up to three different fatty acids so long as at least one fatty acid is a polyunsaturated fatty acid.

The starting material or reactant composition for the metathesis reaction process may comprise a Δ9 polyunsaturated fatty acid, a Δ9 polyunsaturated fatty ester (e.g., monoesters or polyol esters), a carboxylate salt of a Δ9 polyunsaturated fatty acid, or mixtures of two or more of the foregoing. Δ9 polyunsaturated starting compositions have at least two carbon-carbon double bonds with one of the carbon-carbon double bonds being located between the $9^{th}$ and $10^{th}$ carbon atoms (i.e., between $C_9$ and $C_{10}$) in the alkene chain of the polyunsaturated fatty acid, ester, or carboxylate salt. In determining this position, the alkene chain is numbered starting with the carbon atom in the carbonyl group of the unsaturated fatty acid, ester, or salt. Included within the definition of Δ9 polyunsaturated fatty acids, esters, and carboxylate salts are Δ9, 12 polyunsaturated fatty acids, esters and carboxylate salts, and Δ9, 12, 15 polyunsaturated fatty acids, esters and carboxylate salts.

The Δ9 unsaturated starting material may have a straight alkene chain and may be represented by the general structure:

$$CH_3—(CH_2)_{n1}—[—(CH_2)_{n3}—CH{=}CH—]_x—(CH_2)_7—COOR$$

where

R is hydrogen (fatty acid), an aliphatic group (fatty monoester) or a metal ion (carboxylate salt);

n1 is an integer equal to or greater than 0 (typically 0 to 6; more typically 0, 3, 6);

n3 is an integer equal to or greater than 0 (typically 1); and x is an integer equal to or greater than 2 (typically 2 to 6, more typically 2 to 3).

The Δ9 polyunsaturated starting material may have a total of about 18 carbons in the alkene chain. Examples include $$CH_3—(CH_2)_4—CH{=}CH—CH_2—CH{=}CH—(CH_2)_7—COOR;\text{ and}$$

$$CH_3—CH_2—CH{=}CH—CH_2—CH{=}CH—CH_2—CH{=}CH—(CH_2)_7—COOR.$$

where R is hydrogen (fatty acid), an aliphatic group (fatty monoester) or a metal ion (fatty acid salt);

Δ9 unsaturated fatty esters may be monoesters or polyol esters. The Δ9 unsaturated polyol ester may have the general structure $$CH_2A\text{-}CHB—CH_2C$$

where -A; -B; and -C are independently selected from

—OH;

—O(O)C—R'; and $—O(O)C—(CH_2)_7—[—CH{=}CH—CH_2—]_x—(CH_2)_{n1}CH_3$ with the proviso that at least one of -A, -B, or -C is $—O(O)C—(CH_2)_7—[—CH{=}CH—CH_2—]_x—(CH_2)_{n1}CH_3$ In the above formula:

R' is a straight or branched chain alkyl or alkenyl group;

n1 is independently an integer equal to or greater than 0 (typically 0 to 6); and x is an integer greater than or equal to 2 (typically 2 to 6, more typically 2 to 3).

The starting materials for the metathesis reaction process may comprise one or more $C_{18}$ fatty acids, for example, linoleic acid (i.e., 9,12-octadecadienoic acid) and linolenic acid (i.e., 9,12,15-octadecatrienoic acid). The starting composition may comprise one or more $C_{18}$ fatty esters, for example, methyl linoleate and methyl linolenate. The starting composition may comprise an unsaturated glyceride comprising Δ9 fatty acids, for example, C18:Δ9 fatty acids.

Δ9 starting materials or reactants may be derived from vegetable oils such as soybean oil, rapeseed oil, corn oil, sesame oil, cottonseed oil, sunflower seed oil, canola oil, safflower oil, palm oil, palm kernel oil, linseed oil, castor oil, olive oil, peanut oil, coriander oil, almond oil, wheat germ oil, and the like. Since these vegetable oils yield predominately the glyceride form of the Δ9 unsaturated fatty esters, the oils must be processed (e.g., by transesterification) to yield an unsaturated free fatty ester, an unsaturated fatty acid, or salt. Δ9 unsaturated fatty acids, esters, and salts may also be also be derived from tall oil, fish oil, lard, algal oil, poultry fat, yellow grease, and tallow. A summary of some useful starting compositions is provided in Table B.

TABLE B

| Starting Composition | Description | Classification | Bond Locations |
|---|---|---|---|
| Linoleic acid | C18 diunsaturated fatty acid (C18:2) | Δ9 | Δ9, 12 |
| Linolenic acid | C18 triunsaturated fatty acid (C18:3) | Δ9 | Δ9, 12, 15 |

TABLE B-continued

| Starting Composition | Description | Classification | Bond Locations |
|---|---|---|---|
| Alkyl linoleate | C18 diunsaturated fatty ester (C18:2) | Δ9 | Δ9, 12 |
| Alkyl linolenate | C18 triunsaturated fatty ester (C18:3) | Δ9 | Δ9, 12, 15 |
| Vegetable Oil (e.g., soybean oil) | Unsaturated glycerides of C18:1, C18:2, and C18:3 fatty acids | Δ9 | Δ9<br>Δ9, 12<br>Δ9, 12, 15 |

The natural oil derived unsaturated carboxylic acid; salt and/or ester used as the starting material or reactant composition for the metathesis reaction process may comprise an unsaturated fatty acid, carboxylate salt of an unsaturated fatty acid and/or unsaturated fatty ester with an alkene chain of at least about 10 carbon atoms, or from 10 to about 30 carbon atoms, or from about 16 to about 24 carbon atoms, or about 18 carbon atoms, and a carbon-carbon double bond between the $C_9$ and $C_{10}$ carbon atoms in the alkene chain.

The natural oil derivative derived unsaturated carboxylic acid, salt and/or ester as the starting material or reactant for the metathesis reaction process may comprise an unsaturated fatty acid, carboxylate salt of an unsaturated fatty acid and/or the unsaturated fatty ester with an alkene chain of at least about 7 carbon atoms, or from 7 to about 30 carbon atoms, or from about 16 to about 24 carbon atoms, or about 18 carbon atoms, and a carbon-carbon double bond between the $C_6$ and $C_7$ carbon atoms in the alkene chain.

The natural oil derived unsaturated carboxylic acid, salt and/or ester used as the starting material or reactant material or reactant for the metathesis reaction process may comprise an unsaturated fatty acid, carboxylate salt of an unsaturated fatty acid and/or unsaturated fatty ester with an alkene chain in the carboxylic acid portion of the molecule of at least about 4 carbon atoms, or from 10 to about 30 carbon atoms, or from about 16 to about 24 carbon atoms, or about 18 carbon atoms, and a carbon-carbon double bond between the $C_{11}$ and $C_{12}$ carbon atoms in the alkene chain.

The natural oil derived unsaturated carboxylic acid, salt and/or ester used as the starting material or reactant for the metathesis reaction process may comprise an unsaturated fatty acid, carboxylate salt of an unsaturated fatty acid and/or unsaturated fatty ester with an alkene chain in the carboxylic acid portion of the molecule of at least about 4 carbon atoms, or from 10 to about 30 carbon atoms, or from about 16 to about 24 carbon atoms, or about 18 carbon atoms, and a carbon-carbon double bond between the $C_{13}$ and $C_{14}$ carbon atoms in the alkene chain.

The natural oil derived unsaturated carboxylic acid, salt and/or ester used as the starting material or reactant for the metathesis reaction process may comprise an unsaturated fatty acid, the carboxylate salt of an unsaturated fatty acid and/or unsaturated fatty ester with an alkene chain in the carboxylic acid portion of the molecule of at least about 4 carbon atoms, or from 10 to about 30 carbon atoms, or from about 16 to about 24 carbon atoms, or about 18 carbon atoms, and carbon-carbon double bonds between the $C_9$ and $C_{10}$ carbon atoms and between the $C_{12}$ and $C_{13}$ carbon atoms in the alkene chain.

The natural oil derived unsaturated carboxylic acid, salt and/or ester used as the starting material or reactant for the metathesis reaction process may comprise an unsaturated fatty acid, the carboxylate salt of an unsaturated fatty acid and/or the unsaturated fatty ester may comprise an alkene chain in the carboxylic acid portion of the molecule of at least about 4 carbon atoms, or from 10 to about 30 carbon atoms, or from about 16 to about 24 carbon atoms, with carbon-carbon double bonds between the $C_9$ and $C_{10}$ carbon atoms, or about 18 carbon atoms, between the $C_{12}$ and $C_{13}$ carbon atoms, and between $C_{15}$ and $C_{16}$ carbon atoms in the alkene chain.

The natural oil derived unsaturated carboxylic acid, salt and/or ester used as the starting material or reactant for the metathesis reaction process may comprise an unsaturated fatty acid, carboxylate salt of an unsaturated fatty acid and/or unsaturated fatty ester with an alkene chain in the carboxylic acid portion of the molecule of at least about 4 carbon atoms, or from 10 to about 30 carbon atoms, or from about 16 to about 24 carbon atoms, or about 18 carbon atoms, and carbon-carbon double bonds between the $C_6$ and $C_7$ carbon atoms, between the $C_9$ and $C_{10}$ carbon atoms, between the $C_{12}$ and $C_{13}$ carbon atoms, and between the $C_{15}$ and $C_{16}$ carbon atoms in the alkene chain.

The starting material or reactant for the metathesis reaction process may comprise soybean oil. Generally, crude soybean oil may include about 95-97 wt % triacylglycerides, while refined soybean oil may contain about 99 wt % or greater triacylglycerides. Free fatty acids may comprise less than about 1 wt % of crude soybean oil, and less than about 0.05 wt % of refined soybean oil. Generally speaking; the five major fatty acids present in soybean oil may be linolenic (C18:3), linoleic (C18:2), oleic (C18:1), stearic (C18:0) and palmitic (C16:0). The relative amounts of the component fatty acids can vary widely, especially for unsaturated fatty acid. Illustrative ranges for the major fatty acids are as follows: linolenic (2-13 wt %), linoleic (35-60 wt %), oleic (20-50 wt %), stearic (2-5.5 wt %) and palmitic (7-12 wt %). Because of the high unsaturated acid content of soybean oil, nearly all of the glyceride molecules contain at least two unsaturated fatty acids.

Partial Hydrogenation of the Metathesis Reactants

The metathesis reaction involves the interchange of alkylidene units among olefinic hydrocarbons via the formation and cleavage of carbon-carbon double bonds. The multiple unsaturated bonds within a polyunsaturated reactant provide multiple reaction sites for metathesis. Multiple reaction sites exponentially increase the chemical identity of metathesis reaction products, which in turn increases the complexity of the metathesis product composition. Multiple reaction sites within the starting material or reactant may also increase the catalyst demand for the reaction. These factors may increase the overall complexity and inefficiency of the metathesis reaction.

A more efficient metathesis process that can reduce catalyst demand and reduce complexity of the reaction product composition may be provided by partially hydrogenating the polyunsaturated reactants in the starting material prior to conducting the metathesis process. This process step can be used to reduce the polyunsaturated groups within the starting material. The partially hydrogenated reactant may then be subjected to metathesis to provide a product comprising a mixture of metathesis products. In some embodiments, the metathesis products are fatty esters (monoesters or polyol esters) having terminal carbon-carbon double bonds. The fatty esters may be hydrolyzed to yield linear fatty acids having terminal carbon-carbon double bonds. In some embodiments, the linear fatty acids with terminal carbon-carbon double bonds are monounsaturated. In some embodiments, the terminal linear fatty acids have a chain length in the range of 3 to n carbon atoms (where n is the chain length of the partially hydrogenated composition which has a double bond at the 2 to (n−1) position after partial hydrogenation). In other embodiments, the terminal fatty acids have a chain length in the range of 5 to (n−1) carbon atoms (where n is the chain length of the partially hydrogenated composition which has a double bond at the 4 to (n−2) position after partial hydrogenation). In exemplary embodiments, the terminal fatty acids have a chain length in the range of about 5 to about 17 carbon atoms. In other aspects, the metathesis products are monounsaturated diesters having a chain length in the range of about 4 to (2n−2) carbon atoms (where n is the chain length of the partially hydrogenated composition, which has a double bond at the 2 to (n−1) position after partial hydrogenation). In other embodiments, the monounsaturated diesters have a chain length in the range of about 8 to (2n−4) carbon atoms (where n is the chain length of the partially hydrogenated composition which has a double bond at the 4 to (n−2) position after partial hydrogenation). In exemplary embodiments, the monounsaturated diesters may have a chain length in the range of about 8 to about 32 carbon atoms.

The polyunsaturated starting materials may be partially hydrogenated under conditions to optimize the starting composition for metathesis. Partial hydrogenation may be used to reduce the number of double bonds that are available to participate in the metathesis reaction.

Partial hydrogenation can also alter the fatty acid composition of the polyunsaturated fatty acid starting materials or reactants. Positional and/or geometrical isomerization can occur during hydrogenation, thus changing the location and/or orientation of the double bonds. These reactions may occur concurrently. In the geometrical isomers, the cis bonds originally present in naturally occurring soybean oil may be converted in part to the trans form.

Partial hydrogenation can be conducted according to any known method for hydrogenating double bond-containing compounds such as vegetable oils. Catalysts for hydrogenation are known and can be homogeneous or heterogeneous (e.g., present in a different phase, typically the solid phase, than the substrate). A useful hydrogenation catalyst is nickel. Other useful hydrogenation catalysts include copper, palladium, platinum, molybdenum, iron, ruthenium, osmium, rhodium, iridium, zinc or cobalt. Combinations of catalysts can also be used. Bimetallic catalysts can be used, for example, palladium-copper, palladium-lead, nickel-chromite.

The metal catalysts can be utilized with promoters that may or may not be other metals. Illustrative metal catalysts with promoter include, for example, nickel with sulfur or copper as promoter; copper with chromium or zinc as promoter; zinc with chromium as promoter; or palladium on carbon with silver or bismuth as promoter.

The polyunsaturated starting composition may be partially hydrogenated in the presence of a nickel catalyst that has been chemically reduced with hydrogen to an active state. Commercial examples of supported nickel hydrogenation catalysts may include those available under the trade designations "NYSOFACT," "NYSOSEL," and "NI 5248 D" (from Engelhard Corporation, Iselin, N.J.). Additional supported nickel hydrogenation catalysts may include those commercially available under the trade designations "PRICAT 9910," "PRICAT 9920," "PRICAT 9908" and "PRICAT 9936" (from Johnson Matthey Catalysts, Ward Hill, Mass.).

The metal catalysts can be in the form of fine dispersions in a hydrogenation reaction (slurry phase environment). For example, in some embodiments, the particles of supported nickel catalyst may be dispersed in a protective medium comprising hardened triacylglyceride, edible oil, or tallow. In an exemplary embodiment, the supported nickel catalyst may be dispersed in the protective medium at a level of about 22 wt % nickel.

The catalysts may be impregnated on solid supports. Some useful supports include carbon, silica, alumina, magnesia, titania, and zirconia, for example. Illustrative support embodiments include, for example, palladium, platinum, rhodium or ruthenium on carbon or alumina support; nickel on magnesia, alumina or zirconia support; palladium on barium sulfate ($BaSO_4$) support; or copper on silica support.

The catalysts may be supported nickel or sponge nickel type catalysts. The hydrogenation catalyst may comprise nickel that has been chemically reduced with hydrogen to an active state (i.e., reduced nickel) provided on a support. The support may comprise porous silica (e.g., kieselguhr, infusorial, diatomaceous, or siliceous earth) or alumina. The catalysts may be characterized by a high nickel surface area per gram of nickel.

The supported nickel catalysts may be of the type reported in U.S. Pat. No. 3,351,566, which is incorporated herein by reference. These catalysts comprise solid nickel-silica having a stabilized high nickel surface area of 45 to 60 sq. meters per gram and a total surface area of 225 to 300 sq. meters per gram. The catalysts are prepared by precipitating the nickel and silicate ions from solution such as nickel hydrosilicate onto porous silica particles in such proportions that the activated catalyst contains 25 wt % to 50 wt % nickel and a total silica content of 30 wt % to 90 wt %. The particles are activated by calcining in air at 600° F. to 900° F. (315.5° C. to 482.2° C.), then reducing with hydrogen.

Useful catalysts having a high nickel content may include those described in EP 0 168 091, which is incorporated herein by reference, wherein the catalyst is made by precipitation of a nickel compound. A soluble aluminum compound is added to the slurry of the precipitated nickel compound while the precipitate is maturing. After reduction of the resultant catalyst precursor, the reduced catalyst typically has a nickel surface area on the order of 90 to 150 sq. meters per gram of total nickel. The catalysts have a nickel/aluminum atomic ratio in the range of 2 to 10 and have a total nickel content of more than about 66% by weight.

Useful high activity nickel/alumina/silica catalysts may include those described in EP 0 167 201, which is incorporated herein by reference. The reduced catalysts have a high nickel surface area per gram of total nickel in the catalyst.

Useful nickel/silica hydrogenation catalysts may include those described in U.S. Pat. No. 6,846,772, which is incorporated herein by reference. The catalysts are produced by heating a slurry of particulate silica (e.g., kieselguhr) in an aqueous nickel amine carbonate solution for a total period of at least 200 minutes at a pH above 7.5, followed by filtration, washing, drying, and optionally calcination. The nickel/silica hydrogenation catalysts are reported to have improved filtration properties. U.S. Pat. No. 4,490,480, which is incorporated herein by reference, reports high surface area nickel/alumina hydrogenation catalysts having a total nickel content of 5% to 40% by weight.

The amount of hydrogenation catalysts may be selected in view of a number of factors including, for example, the type of hydrogenation catalyst(s) used, the degree of unsaturation in the material to be hydrogenated, the desired rate of hydrogenation, the desired degree of hydrogenation (for example, as measured by the IV, see below), the purity of the reagent and the $H_2$ gas pressure. The hydrogenation catalyst may be used in an amount of about 10 wt % or less, for example about 5 wt % or less, about 1 wt % or less, or about 0.5 wt % or less.

Partial hydrogenation may be carried out in a batch, continuous or semi-continuous process. In a representative batch process, a vacuum is pulled on the headspace of a stirred reaction vessel and the reaction vessel is charged with the material to be hydrogenated (for example, RBD soybean oil). The material is then heated to a desired temperature, typically in the range of about 50° C. to about 350° C., for example, about 100° C. to about 300° C., or about 150° C. to about 250° C. The desired temperature can vary, for example, with hydrogen gas pressure. Typically, a higher gas pressure will require a lower temperature. In a separate container, the hydrogenation catalyst is weighed into a mixing vessel and is slurried in a small amount of the material to be hydrogenated (for example, RBD soybean oil). When the material to be hydrogenated reaches the desired temperature (typically a temperature below a target hydrogenation temperature), the slurry of hydrogenation catalyst is added to the reaction vessel. Hydrogen is then pumped into the reaction vessel to achieve a desired pressure of $H_2$ gas. Typically, the $H_2$ gas pressure ranges from about 15 psig to about 3000 psig, for example, about 15 psig to about 90 psig. As the gas pressure increases, more specialized high-pressure processing equipment can be required. Under these conditions the hydrogenation reaction begins and the temperature is allowed to increase to the desired hydrogenation temperature (for example, about 120° C. to about 200° C.), where it is maintained by cooling the reaction mass, for example, with cooling coils. When the desired degree of hydrogenation is reached, the reaction mass is cooled to the desired filtration temperature.

The polyunsaturated starting materials or reactants for the metathesis reaction process may be subjected to electrocatalytic hydrogenation to achieve a partially hydrogenated product. Various electrocatalytic hydrogenation processes can be utilized. For example, low temperature electrocatalytic hydrogenation that uses an electrically conducting catalyst such as Raney Nickel or Platinum black as a cathode are described in Yusem and Pintauro, *J. Appl. Electrochem.* 1997, 27, 1157-71, which is incorporated herein by reference. Another system that utilizes a solid polymer electrolyte reactor composed of a ruthenium oxide ($RuO_2$) powder anode and a platinum-black (Pt-black) or palladium-black (Pd-black) powder cathode that are hot-pressed as thin films onto a Nafion cation exchange membrane is described in An et al. *J. Am. Oil Chem. Soc.* 1998, 75, 917-25, which is incorporated herein by reference. A further system that involves electrochemical hydrogenation using a hydrogen transfer agent of formic acid and a nickel catalyst is described in Mondal and Lalvani, *J. Am. Oil Chem. Soc.* 2003, 80, 1135-41, which is incorporated herein by reference.

Hydrogenation may be performed under supercritical fluid state, as described in U.S. Pat. Nos. 5,962,711 and 6,265,596, which are incorporated herein by reference.

Hydrogenation may be conducted in a manner to promote selectivity toward monounsaturated fatty acid groups, i.e., fatty acid groups containing a single carbon-carbon double bond. Selectivity is understood here as the tendency of the hydrogenation process to hydrogenate polyunsaturated fatty acid groups over monounsaturated fatty acid groups. This form of selectivity is often called preferential selectivity, or selective hydrogenation.

The level of selectivity of hydrogenation may be influenced by the nature of the catalyst, the reaction conditions, and the presence of impurities. Generally speaking, catalysts having a high selectivity for one fat or oil reactant may also have a high selectivity in other fat or oil reactants. As used herein, "selective hydrogenation" refers to hydrogenation conditions (e.g., selection of catalyst, reaction conditions such as temperature, rate of heating and/or cooling, catalyst concentration, hydrogen availability, and the like) that are chosen to promote hydrogenation of polyunsaturated compounds to monounsaturated compounds. Using soybean oil as an example, the selectivity of the hydrogenation process is determined by examining the content of the various $C_{18}$ fatty acids and their ratios. Hydrogenation on a macro scale can be regarded as a stepwise process:

$$C18{:}3 \xrightarrow{k_3} C18{:}2 \xrightarrow{k_2} C18{:}1 \xrightarrow{k_1} C18{:}0$$

The following selectivity ratios (SR) can be defined: $SRI=k_2/k_3$; $SRII=k_3/k_2$; $SRIII=k_2/k_1$. Characteristics of the starting oil and the hydrogenated product may be utilized to determine the selectivity ratio (SR) for each acid. This may be done with the assistance of gas-liquid chromatography. For example, polyol esters may be saponified to yield free fatty acids (FFA) by reacting with NaOH/MeOH. The FFAs may then be methylated into fatty acid methyl esters (FAMEs) using $BF_3$/MeOH as the acid catalyst and MeOH as the derivatization reagent. The resulting FAMEs may then be separated using a gas-liquid chromatograph and are detected with a flame ionization detector (GC/FID). An internal standard may be used to determine the weight percent of the fatty esters. The rate constants may be calculated by either the use of a computer or graph.

In addition to the selectivity ratios, the following individual reaction rate constants may be described within the hydrogenation reaction: $k_3$ (C18:3 to C18:2), $k_2$ (C18:2 to C18:1), and $k_1$ (C18:1 to C18:0). In some aspects, hydrogenation under conditions sufficient to provide a selectivity or preference for $k_2$ and/or $k_3$ (i.e., $k_2$ and/or $k_3$ are greater than $k_1$) may be used. In these aspects, hydrogenation may be conducted to reduce levels of polyunsaturated compounds within the starting material or reactants for the metathesis reaction process, while minimizing the generation of saturated compounds.

In one illustrative embodiment, selective hydrogenation can promote hydrogenation of polyunsaturated fatty acid groups toward monounsaturated fatty acid groups (having one carbon-carbon double bond), for example, tri- or diunsaturated fatty acid groups to monounsaturated groups. In some embodiments, the invention involves selective hydrogenation of a polyunsaturated polyol ester (such as soybean oil) to a hydrogenation product having a minimum of 65% monounsaturated fatty acid groups, or a minimum of 75% monounsaturated fatty acid groups, or a minimum of 85% monounsaturated fatty acid groups. The target minimum percentage of monounsaturated fatty acid groups will depend upon the starting composition (i.e., the polyunsaturated polyol ester), since each polyol ester will have different starting levels of saturates, monounsaturates and polyunsaturates. It is also understood that high oleic oils can have 80% or more oleic acid. In such cases, very little hydrogenation will be required to reduce polyunsaturates.

In one illustrative embodiment, selective hydrogenation can promote hydrogenation of polyunsaturated fatty acid groups in soybean oil toward C18:1, for example, C18:2 to C18:1, and/or C18:3 to C18:2. Selective hydrogenation of a polyunsaturated composition (e.g., a polyol ester such as soybean oil) to a hydrogenation product may have reduced polyunsaturated fatty acid group content, while minimizing complete hydrogenation to saturated fatty acid groups (C18:0).

Selective hydrogenation may be accomplished by controlling reaction conditions (such as temperature, rate of heating, and/or cooling, hydrogen availability, and catalyst concentration), and/or by selection of catalyst. For some hydrogenation catalysts, increased temperature or catalyst concentration will result in an increased selectivity for hydrogenating C18:2 over C18:1. In some aspects, when a nickel-supported catalyst is utilized, pressure and/or temperature can be modified to provide selectivity. Illustrative lower pressures can include pressures of 50 psi or less. Lower pressures can be combined, in some embodiments, with increased temperature to promote selectivity. Illustrative conditions in accordance with these embodiments include temperatures in the range of 180° C. to 220° C., pressure of about 5 psi, with nickel catalyst present in an amount of about 0.5 wt %. See, for example, Allen et al. "*Isomerization During Hydrogenation. III. Linoleic Acid,*" *JAOC August* 1956, which is incorporated herein by reference.

In some aspects, selectivity can be enhanced by diminishing the availability of hydrogen. For example, reduced reaction pressure and/or agitation rate can diminish hydrogen supply for the reaction.

Selective hydrogenation can be accomplished by selection of the catalyst. One illustrative catalyst that can enhance selectivity is palladium. Palladium reaction conditions for sunflower seed oil can include low temperatures (e.g., 40° C.) in ethanol solvent, with catalyst present in an amount of about 1 wt %. Palladium can be provided on a variety of different supports known for hydrogenation processes. See, for example, Bendaoud Nohaira et al., *Palladium supported catalysts for the selective hydrogenation of sunflower oil," J. of Molecular Catalysts A: Chemical* 229 (2005) 117-126, Nov. 20, 2004, which is incorporated herein by reference.

Optionally, additives such as lead or copper can be included to increase selectivity. When catalysts containing palladium, nickel or cobalt are used, additives such as amines can be used.

Useful selective hydrogenation conditions are described, for example, in U.S. Pat. Nos. 5,962,711 and 6,265,596. Hydrogenation is performed by mixing the substrate (polyunsaturated polyol ester), hydrogen gas and solvent, and bringing the whole mixture into a super-critical or near-critical state. This substantially homogeneous super-critical or near-critical solution is led over the catalyst, whereby the reaction products formed (i.e., the hydrogenated substrates) will also be a part of the substantially homogeneous super-critical or near-critical solution.

Reaction conditions for supercritical hydrogenation may occur over a wide experimental range, and this range can be described as follows: temperature (in the range of about 0° C. to about 250° C., or about 20° C. to about 200° C.); pressure (in the range of about 10 bar to about 350 bar, or about 20 bar to about 200 bar); reaction time (up to about 10 minutes, or in the range of about 1 second to about 1 minute); and solvent concentration (in the range of about 30 wt % to about 99.9 wt %, or about 40 wt % to about 99 wt %). Useful solvents include, for example, ethane, propane, butane, $CO_2$, dimethyl ether, "freons," $N_2O$, $N_2$, $NH_3$, or mixtures of these. The catalyst can be selected according to the reaction to be carried out; any useful catalyst for hydrogenation can be selected. Concentration of hydrogen gas ($H_2$) can be up to 3 wt %, or in the range of about 0.001 wt % to about 1 wt %. Concentration of substrate (polyunsaturated polyol ester) in the reaction mixture can be in the range of about 0.1 wt % to about 70 wt %, or about 1 wt % to about 60 wt %. A continuous reactor can be used to conduct the hydrogenation reaction, such as described in U.S. Pat. Nos. 5,962,711 and 6,265,596.

The content of the starting material may influence the selectivity. Various substances that are naturally occurring in fats and oils may influence the selectivity of hydrogenation. For example, sulfur is known to be an irreversible surface poison for nickel catalysts. Other compounds that may inhibit catalyst activity include phosphatides, nitrogen and halogen derivatives. As a result, a refining step to remove substances that may have a net negative impact on the hydrogenation process may be used. This, in turn, may increase selectivity.

Products of the partial hydrogenation reaction can include one or more identifiable properties and/or compounds. Products formed from polyunsaturated compositions can include characteristic monounsaturated fatty acid groups in an acid profile and can contain minor amounts of polyunsaturated fatty acid groups. In some aspects, the acid profile comprises polyunsaturated fatty acid groups in an amount of about 1 wt % or less. In some aspects, the starting material is soybean oil, and the acid profile of the hydrogenation product comprises a majority of monounsaturated fatty acid groups having a carbon-carbon double bond in the $C_4$ to $C_{16}$ position on the fatty acid or ester. More generally speaking, the carbon-carbon double bond is located on the fatty acid or ester in the $C_2$ to C(n−1) position, where n is the chain length of the fatty acid or ester. More typically, the carbon-carbon double bond is located on the fatty acid or ester in the $C_4$ to C(n−2), where n is the chain length of the fatty acid or ester. Typically, n ranges from about 4 to about 30, or from about 4 to about 22.

When the starting material is derived from soybean oil, the acid profile of the partial hydrogenation product composition may comprise saturated fatty acid groups in an amount that is slightly higher than the starting concentration of saturated fatty acid groups in the starting material (i.e., unhydrogenated polyunsaturated polyol ester). The acid profile of the partial hydrogenation product composition may comprise saturated fatty acid groups in an amount of about 0.5 wt % to about 10 wt % higher than the concentration of saturated fatty acid groups in the starting material (polyunsaturated polyol ester starting material). The acid profile of the partial hydrogenation product composition may comprise saturated fatty acid groups in an amount of about 0.5 wt % to about 6 wt % higher than the concentration of saturated fatty acid groups in the starting material. It is understood that partial hydrogenation may result in generation of some additional saturated fatty acid groups. The generation of such additional saturated fatty acid groups may be controlled through selectivity. Generally speaking, saturated fatty acid groups do not participate in a subsequent metathesis reaction and thus can represent yield loss.

As one example of a partial hydrogenation product composition, when the starting material comprises soybean oil, a partial hydrogenation product composition may include saturated fatty acid groups in an amount of about 30 wt % or less, or 25 wt % or less, or 20 wt % or less. The acid profile may comprise saturated fatty acid groups in an amount in the range of about 15 wt % to about 20 wt %. For soybean oil, illustrative saturated fatty acid groups may include stearic and palmitic acids. It is understood the relative amount and identity of the saturated fatty acids within the partial hydrogenated product composition can vary, depending upon such factors as the starting material (polyunsaturated polyol ester), reaction conditions (including catalyst, temperature, pressure, and other factors impacting selectivity of hydrogenation), and positional isomerization. A representative example of a hydrogenation product from selective hydrogenation of soybean oil (SBO) is shown in Table C below.

TABLE C

| Percentages of Octadecenoates from Partially Hydrogenated Soybean Oil | |
|---|---|
| Relative Percent | Proposed C18:1 Compounds |
| 0.09 | C18:1,4t |
| 0.23 | C18:1,5t |
| 6.01 | C18:1,6-8t |
| 5.88 | C18:1,9t |
| 9.75 | C18:1,10t |
| 8.64 | C18:1,11t |
| 4.89 | C18:1,12t |
| 6.62 | C18:1,13t + 14t (C18:1,6-8c) |
| 14.00 | C18:1,9c (Oleic) (C18:1,14-16t) |
| 3.64 | C18:1,10c (C18:1,15t) |
| 3.00 | C18:1,11c |
| 4.47 | C18:1,12c |
| 1.02 | C18:1,13c |
| 1.16 | C18:1,14c (C18:1,16t) |

Within TABLE C, isomers are indicated as trans ("t") or cis ("c"), with the position of the double bond immediately preceding the isomer designation. Thus, "4t" is a trans isomer with the double bond at the C4 position within the carbon chain. Species in parenthesis denote minor products that may be present with similar elution times.

The acid profile of the partial hydrogenation product composition from soybean oil may comprise at least about 65 wt % monounsaturated fatty acid groups. The acid profile of the partial hydrogenation product composition may comprise at least about 70 wt %, or at least about 75 wt %, or at least about 80 wt %, or at least about 85 wt % monounsaturated fatty acid groups. The monounsaturated fatty acid groups may include the carbon-carbon double bond at any position from $C_2$ to $C_{16}$. Using soybean oil as an example, the monounsaturated fatty acid groups of the fatty acid profile may include the following:

octadec-2-enoic acid (—$OOCCH{=}CH(CH_2)_{14}CH_3$),
octadec-3-enoic acid (—$OOC(CH_2)CH{=}CH(CH_2)_{13}CH_3$),
octadec-4-enoic acid (—$OOC(CH_2)_2CH{=}CH(CH_2)_{12}CH_3$),
octadec-5-enoic acid (—$OOC(CH_2)_3CH{=}CH(CH_2)_{11}CH_3$),
octadec-6-enoic acid (—$OOC(CH_2)_4CH{=}CH(CH_2)_{10}CH_3$),
octadec-7-enoic acid (—$OOC(CH_2)_5CH{=}CH(CH_2)_9CH_3$),
octadec-8-enoic acid (—$OOC(CH_2)_6CH{=}CH(CH_2)_8CH_3$),
octadec-9-enoic acid (—$OOC(CH_2)_7CH{=}CH(CH_2)_7CH_3$),
octadec-10-enoic acid (—$OOC(CH_2)_8CH{=}CH(CH_2)_6CH_3$),
octadec-11-enoic acid (—$OOC(CH_2)_9CH{=}CH(CH_2)_5CH_3$),
octadec-12-enoic acid (—$OOC(CH_2)_{10}CH{=}CH(CH_2)_4CH_3$),
octadec-13-enoic acid (—$OOC(CH_2)_{11}CH{=}CH(CH_2)_3CH_3$),
octadec-14-enoic acid (—$OOC(CH_2)_{12}CH{=}CH(CH_2)_2CH_3$),
octadec-15-enoic acid (—$OOC(CH_2)_{13}CH{=}CH(CH_2)_1CH_3$),
octadec-16-enoic acid (—$OOC(CH_2)_{14}CH{=}CHCH_3$), and For each monounsaturated fatty acid, the fatty acid can be the cis or trans isomer.

An objective of selective hydrogenation is reduction in the amount of polyunsaturated fatty acid groups of the polyunsaturated composition (e.g., polyunsaturated polyol ester). The hydrogenation product composition may have a polyunsaturated fatty acid group content of about 10 wt % or less, based upon total fatty acid content in the composition. Particularly with respect to the hydrogenation product that is to be subjected to self-metathesis, hydrogenation can be performed to drive down the concentration of polyunsaturated fatty acid groups even lower than about 5 wt %, for example to concentrations of about 1 wt % or less, or about 0.75 wt % or less, or about 0.5 wt % or less.

The hydrogenation product composition thus may comprise a reduced polyunsaturate content relative to the polyunsaturated starting material. The hydrogenation product composition may comprise polyunsaturated fatty acid groups in an amount of about 1 wt % or less; saturated fatty acid groups in an amount in the range of about 30 wt % or less, or about 25 wt % or less, or about 20 wt % or less; and monounsaturated fatty acid groups comprising the balance of the mixture, for example, about 65 wt % or more, or about 70 wt % or more, or about 75 wt % or more, or about 80 wt % or more, or about 85 wt % or more. This product composition is understood to be illustrative for soybean oil, and it is understood that the relative amounts of each level of saturated, monounsaturated and polyunsaturated components could vary depending upon such factors as the starting material (e.g., polyunsaturated polyol ester), the hydrogenation catalyst selected, the hydrogenation reaction conditions, and the like factors described herein.

Generally, it is desirable to maximize the concentration of monounsaturated fatty acid groups in the hydrogenation product composition. In many embodiments, the monounsaturated fatty acid groups may comprise monounsaturated fatty acid groups having the carbon-carbon double bond in the $C_4$ to $C_{16}$ position within the carbon chain.

The hydrogenation product composition thus may comprise a partially hydrogenated polyol ester. As mentioned previously, in addition to effecting a reduction of unsaturation of the polyol ester, partial hydrogenation can also cause geometric and positional isomers to be formed. A goal of selective hydrogenation is reduction in the amount of polyunsaturation in the polyol esters.

The hydrogenation product composition can also be characterized as having an iodine number within a desired range. The iodine number is a measure of the degree of unsaturation of a compound. When used in reference to an unsaturated material, such as an unsaturated polyol ester, the iodine number is a measure of the unsaturation, or the number of double bonds, of that compound or mixture.

Generally speaking, the iodine number may range from about 8 to about 180 in naturally-occurring seed oils, and from about 90 to about 210 in naturally-occurring marine oils. Illustrative iodine numbers for some natural oils are the following:

| Oil | Iodine Number |
|---|---|
| soy | 125-138 |
| canola | 110-115 |
| palm | 45-56 |
| rapeseed | 97-110 |
| Sunflower seed | 122-139 |
| fish | 115-210 |

At complete hydrogenation of oils or fats, all double bonds would be hydrogenated and the iodine number would therefore be zero or near zero. For partially hydrogenated triglycerides the iodine number may be about 90 or lower, or about 85 or lower, or about 80 or lower, or about 75 or lower. The iodine number target will depend upon such factors as the initial iodine number, the content of the monounsaturates in the starting material, the selectivity of the hydrogenation catalyst, the economic optimum level of unsaturation, and the like. An optimum partial hydrogenation would leave only the saturates that were initially present in the polyunsaturated polyol ester starting material and react all of the polyunsaturates. For example, a triolein oil would have an iodine number of about 86. Soybean oil starts with an iodine number of around 130 with a saturates content of about 15%. An optimum partial hydrogenation product may have an iodine number of about 73 and would maintain the 15% level of saturates. Canola oil has an initial iodine number of about 113 and 7% saturates; an optimum partial hydrogenation product may have an iodine number of about 80, while maintaining the 7% saturate level. The balance between additional saturate production and allowable polyunsaturate content may depend upon such factors as product quality parameters, yield costs, catalyst costs, and the like. If catalyst costs dominate, then some saturate production may be tolerable. If yield is critical, then some remaining polyunsaturates may be tolerable. If the formation of cyclic byproducts is unacceptable, then it may be acceptable to drive polyunsaturate levels to near zero.

The iodine number may represent a hydrogenation product composition wherein a certain percentage of double bonds have reacted, on a molar basis, based upon the starting iodine number of the polyunsaturated composition. For example, soybean oil with an iodine number of about 130 may be used as the starting material for the metathesis reaction process.

After partial hydrogenation, the hydrogenation catalyst may be removed from the partial hydrogenated product using known techniques, for example, by filtration. The hydrogenation catalyst may be removed using a plate and frame filter such as those commercially available from Sparkle Filters, Inc., Conroe, Tex. The filtration may be performed with the assistance of pressure or a vacuum. In order to improve filtering performance, a filter aid can optionally be used. A filter aid can be added to the hydrogenated product directly or it can be applied to the filter. Representative examples of filtering aids include diatomaceous earth, silica, alumina and carbon. Typically, the filtering aid is used in an amount of about 10 wt % or less, for example, about 5 wt % or less, or about 1 wt % or less. Other filtering techniques and filtering aids can also be employed to remove the used hydrogenation catalyst. In other embodiments, the hydrogenation catalyst is removed by using centrifugation followed by decantation of the product.

Partial hydrogenation of a polyunsaturated composition can impart one or more desirable properties to the partially hydrogenated composition and, consequently, to metathesis processes performed on the partially hydrogenated composition. For example, partial hydrogenation can be used to decrease the amount of polyunsaturated fatty acid groups in the composition, thereby reducing unneeded sites of reaction for a metathesis catalyst. This, in turn, can reduce catalyst demand. Another benefit can be seen in the final metathesis product composition. Because less polyunsaturated fatty acid groups are present in the reaction mixture prior to metathesis, a more predictable metathesis product composition can be provided. For example, the carbon chain length and double bond position of metathesis products can be predicted, based upon the fatty acid composition and metathesis catalyst utilized. This, in turn, can reduce the purification requirements for the metathesis product composition.

The Metathesis Catalyst

The metathesis reaction is conducted in the presence of a catalytically effective amount of a metathesis catalyst. The term "metathesis catalyst" includes any catalyst or catalyst system which catalyzes the metathesis reaction.

Any metathesis catalyst may be used, alone or in combination with one or more additional catalysts. Exemplary metathesis catalysts may include metal carbene catalysts based upon transition metals, for example, ruthenium, molybdenum, osmium, chromium, rhenium, and tungsten. The metathesis catalyst may be a Group 8 transition metal complex having the structure of the following formula (I)

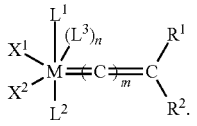

in which the various substituents are as follows:

M is a Group 8 transition metal;

$L^1$, $L^2$ and $L^3$ are neutral electron donor ligands;

n is 0 or 1, such that $L^3$ may or may not be present;

m is 0, 1, or 2;

$X^1$ and $X^2$ are anionic ligands; and $R^1$ and $R^2$ are independently selected from hydrogen, hydrocarbyl, substituted hydrocarbyl, heteroatom-containing hydrocarbyl, substituted heteroatom-containing hydrocarbyl, and functional groups, wherein any two or more of $X^1$, $X^2$, $L^1$, $L^2$, $L^3$, $R^1$, and $R^2$ can be taken together to form a cyclic group, and further wherein any one or more of $X^1$, $X^2$, $L^1$, $L^2$, $L^3$, $R^1$, and $R^2$ may be attached to a support.

The catalysts may contain Ru or Os as the Group 8 transition metal, with Ru being especially advantageous.

Numerous embodiments of the catalysts useful in the reactions of the disclosure are described in more detail infra. For the sake of convenience, the catalysts are described in groups, but it should be emphasized that these groups are not meant to be limiting in any way. That is, any of the catalysts useful in the disclosure may fit the description of more than one of the groups described herein.

A first group of catalysts, which may be referred to as $1^{st}$ Generation Grubbs-type catalysts, have the structure of formula (I). For the first group of catalysts, M and m are as described above, and n, $X^1$, $X^2$, $L^1$, $L^2$, $L^3$, $R^1$, and $R^2$ are described as follows.

For the first group of catalysts, n may be 0, and $L^1$ and $L^2$ may independently be phosphine, sulfonated phosphine, phosphite, phosphinite, phosphonite, arsine, stibine, ether, amine, amide, imine, sulfoxide, carboxyl, nitrosyl, pyridine, substituted pyridine, imidazole, substituted imidazole, pyrazine, and/or thioether. Exemplary ligands include trisubstituted phosphines.

$X^1$ and $X^2$ may be anionic ligands, and may be the same or different, or may be linked together to form a cyclic group which may be a five- to eight-membered ring. $X^1$ and $X^2$ may each be independently hydrogen, halide, or one of the following groups: $C_1$-$C_{20}$ alkyl, $C_5$-$C_{24}$ aryl, $C_1$-$C_{20}$ alkoxy, $C_5$-$C_{24}$ aryloxy, $C_2$-$C_{20}$ alkoxycarbonyl, $C_6$-$C_{24}$ aryloxycarbonyl, $C_2$-$C_{24}$ acyl, $C_2$-$C_{24}$ acyloxy, $C_1$-$C_{20}$ alkylsulfonato, $C_5$-$C_{24}$ arylsulfonato, $C_1$-$C_{20}$ alkylsulfanyl, $C_5$-$C_{24}$ arylsulfanyl, $C_1$-$C_{20}$ alkylsulfinyl, or $C_5$-$C_{24}$ arylsulfinyl. $X^1$ and $X^2$ may be substituted with one or more moieties selected from $C_1$-$C_{12}$ alkyl, $C_1$-$C_{12}$ alkoxy, $C_5$-$C_{24}$ aryl, and halide, which may, in turn, with the exception of halide, be further substituted with one or more groups selected from halide, $C_1$-$C_6$ alkyl, $C_1$-$C_6$ alkoxy, and phenyl. $X^1$ and $X^2$ may be halide, benzoate, $C_2$-$C_6$ acyl, $C_2$-$C_6$ alkoxycarbonyl, $C_1$-$C_6$ alkyl, phenoxy, $C_1$-$C_6$ alkoxy, $C_1$-$C_6$ alkylsulfanyl, aryl, or $C_1$-$C_6$ alkylsulfonyl. $X^1$ and $X^2$ may each be halide, $CF_3CO_2$, $CH_3CO_2$, $CFH_2CO_2$, $(CH_3)_3CO$, $(CF_3)_2(CH_3)CO$, $(CF_3)(CH_3)_2CO$, PhO, MeO, EtO, tosylate, mesylate, or trifluoromethane-sulfonate. $X^1$ and $X^2$ may each be chloride.

$R^1$ and $R^2$ may independently be selected from hydrogen, hydrocarbyl (e.g., $C_1$-$C_{20}$ alkyl, $C_2$-$C_{20}$ alkenyl, $C_2$-$C_{20}$ alkynyl, $C_5$-$C_{24}$ aryl, $C_6$-$C_{24}$ alkaryl, $C_6$-$C_{24}$ aralkyl, etc.), substituted hydrocarbyl (e.g., substituted $C_1$-$C_{20}$ alkyl, $C_2$-$C_{20}$ alkenyl, $C_2$-$C_{20}$ alkynyl, $C_5$-$C_{24}$ aryl, $C_6$-$C_{24}$ alkaryl, $C_6$-$C_{24}$ aralkyl, etc.), heteroatom-containing hydrocarbyl (e.g., heteroatom-containing $C_1$-$C_{20}$ alkyl, $C_2$-$C_{20}$ alkenyl, $C_2$-$C_{20}$ alkynyl, $C_6$-$C_{24}$ aryl, $C_6$-$C_{24}$ alkaryl, $C_6$-$C_{24}$ aralkyl, etc.), and substituted heteroatom-containing hydrocarbyl (e.g., substituted heteroatom-containing $C_1$-$C_{20}$ alkyl, $C_2$-$C_{20}$ alkenyl, $C_2$-$C_{20}$ alkynyl, $C_5$-$C_{24}$ aryl, $C_6$-$C_{24}$ alkaryl, $C_6$-$C_{24}$ aralkyl, etc.), and functional groups. $R^1$ and $R^2$ may also be linked to form a cyclic group, which may be aliphatic or aromatic, and may contain substituents and/or heteroatoms. Generally, such a cyclic group may contain 4 to about 12, or 5, 6, 7, or 8 ring atoms.

$R^1$ may be hydrogen and $R^2$ may be selected from $C_1$-$C_{20}$ alkyl, $C_2$-$C_{20}$ alkenyl, $C_5$-$C_{24}$ aryl, $C_1$-$C_6$ alkyl, $C_2$-$C_6$ alkenyl, or $C_5$-$C_{14}$ aryl. $R^2$ may be phenyl, vinyl, methyl, isopropyl, or t-butyl, optionally substituted with one or more moieties selected from $C_1$-$C_6$ alkyl, $C_1$-$C_6$ alkoxy, phenyl, or a functional group. $R^2$ may be phenyl or vinyl substituted with one or more moieties selected from methyl, ethyl, chloro, bromo, iodo, fluoro, nitro, dimethylamino, methyl, methoxy, and phenyl. $R^2$ may be phenyl or —C═C($CH_3$)$_2$.

Any two or more (typically two, three, or four) of $X^1$, $X^2$, $L^1$, $L^2$, $L^3$, $R^1$, and $R^2$ can be taken together to form a cyclic group, as disclosed, for example, in $L^1$, $L^2$, $L^3$, $R^1$, U.S. Pat. No. 5,312,940 to Grubbs et al. When any of $X^1$, $X^2$, $L^1$, $L^2$, $L^3$, $R^1$, and $R^2$ are linked to form cyclic groups, those cyclic groups may contain 4 to about 12, or 4, 5, 6, 7 or 8 atoms, or may comprise two or three of such rings, which may be either fused or linked. The cyclic groups may be aliphatic or aromatic, and may be heteroatom-containing and/or substituted. The cyclic group may form a bidentate ligand or a tridentate ligand. Examples of bidentate ligands may include bisphosphines, dialkoxides, alkyldiketonates, and aryldiketonates.

A second group of catalysts, which may be referred to as $2^{nd}$ Generation Grubbs-type catalysts, have the structure of formula (I), wherein $L^1$ is a carbene ligand having the structure of formula (II)

(II)

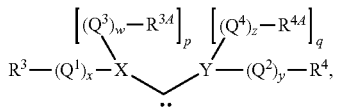

such that the complex may have the structure of formula (III)

(III)

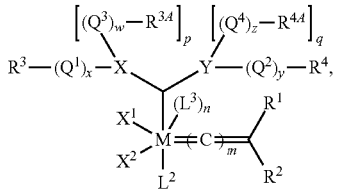

wherein M, m, n, $X^1$, $X^2$, $L^2$, $L^3$, $R^1$, and $R^2$ are as defined for the first group of catalysts, and the remaining substituents are as follows.

X and Y may be heteroatoms typically selected from N, O, S, and P. Since O and S are divalent, p is zero when X is O or S, and q is zero when Y is O or S. When X is N or P, then p is 1, and when Y is N or P, then q is 1. Both X and Y may be N.

$Q^1$, $Q^2$, $Q^3$, and $Q^4$ may be linkers, e.g., hydrocarbylene (including substituted hydrocarbylene, heteroatom-containing hydrocarbylene, and substituted heteroatom-containing hydrocarbylene, such as substituted and/or heteroatom-containing alkylene) or —(CO)—, and w, x, y, and z are independently zero or 1, meaning that each linker is optional. w, x, y, and z may all be zero. Two or more substituents on adjacent atoms within $Q^1$, $Q^2$, $Q^3$, and $Q^4$ may be linked to form an additional cyclic group.

$R^3$, $R^{3A}$, $R^4$, and $R^{4A}$ may be selected from hydrogen, hydrocarbyl, substituted hydrocarbyl, heteroatom-containing hydrocarbyl, and substituted heteroatom-containing hydrocarbyl.

In addition, any two or more of $X^1$, $X^2$, $L^1$, $L^2$, $L^3$, $R^1$, $R^2$, $R^3$, $R^{3A}$, $R^4$, and $R^{4A}$ can be taken together to form a cyclic group, and any one or more of $X^1$, $X^2$, $L^1$, $L^2$, $L^3$, $R^1$, $R^2$, $R^3$, $R^{3A}$, and $R^{4A}$ may be attached to a support.

$R^{3A}$ and $R^{4A}$ may be linked to form a cyclic group so that the carbene ligand is an heterocyclic carbine, for example, an N-heterocyclic carbene, such as the N-heterocylic carbene having the structure of formula (IV):

(IV)

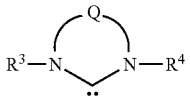

where $R^3$ and $R^4$ are defined above at least one of $R^3$ and $R^4$, and advantageously both $R^3$ and $R^4$, may be alicyclic or aromatic of one to about five rings, and optionally containing one or more heteroatoms and/or substituents. Q may be a linker, typically a hydrocarbylene linker, including substituted hydrocarbylene, heteroatom-containing hydrocarbylene, and substituted heteroatom-containing hydrocarbylene linkers, wherein two or more substituents on adjacent atoms within Q may also be linked to form an additional cyclic structure, which may be similarly substituted to provide a fused polycyclic structure of two to about five cyclic groups. Q may comprise a two-atom linkage or a three-atom linkage.

Examples of N-heterocyclic carbene ligands suitable as $L^1$ may include the following:

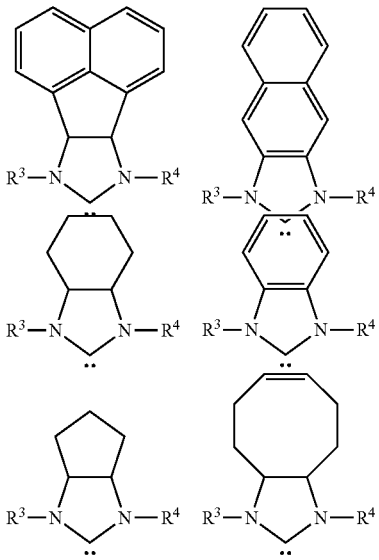

-continued

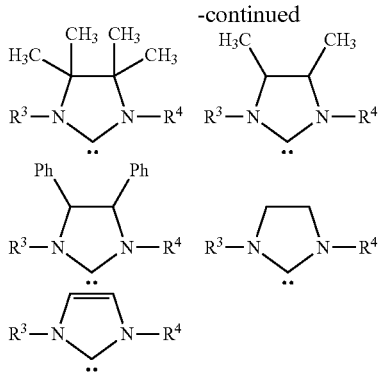

When M is ruthenium, the complex may have the structure of formula (V).

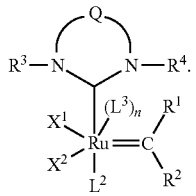

(V)

Q may be a two-atom linkage having the structure —$CR^{11}R^{12}$—$CR^{13}R^{14}$— or —$CR^{11}$=$CR^{13}$—, wherein $R^{11}$, $R^{12}$, $R^{13}$, and $R^{14}$ are independently selected from hydrogen, hydrocarbyl, substituted hydrocarbyl, heteroatom-containing hydrocarbyl, substituted heteroatom-containing hydrocarbyl, and functional groups. Examples of functional groups may include carboxyl, $C_1$-$C_{20}$ alkoxy, $C_5$-$C_{24}$ aryloxy, $C_2$-$C_{20}$ alkoxycarbonyl, $C_5$-$C_{24}$ alkoxycarbonyl, $C_2$-$C_{24}$ acyloxy, $C_1$-$C_{20}$ alkylthio, $C_5$-$C_{24}$ arylthio, $C_1$-$C_{20}$ alkylsulfonyl, and $C_1$-$C_{20}$ alkylsulfinyl, optionally substituted with one or more moieties selected from $C_1$-$C_{12}$ alkyl, $C_1$-$C_{12}$ alkoxy, $C_5$-$C_{14}$ aryl, hydroxyl, sulfhydryl, formyl, and halide. $R^{11}$, $R^{12}$, $R^{13}$, and $R^{14}$ may be independently selected from hydrogen, C1-C12 alkyl, substituted $C_1$-$C_{12}$ alkyl, $C_1$-$C_{12}$ heteroalkyl, substituted $C_1$-$C_{12}$ heteroalkyl, phenyl, and substituted phenyl. Any two of $R^{11}$, $R^{12}$, $R^{13}$, and $R^{14}$ may be linked together to form a substituted or unsubstituted, saturated or unsaturated ring structure, e.g., a $C_4$-$C_{12}$ alicyclic group or a $C_5$ or $C_6$ aryl group, which may itself be substituted, e.g., with linked or fused alicyclic or aromatic groups, or with other substituents.

When $R^3$ and $R^4$ are aromatic, they may be composed of one or two aromatic rings, which may or may not be substituted, e.g., $R^3$ and $R^4$ may be phenyl, substituted phenyl, biphenyl, substituted biphenyl, or the like. $R^3$ and $R^4$ may be the same and each may be unsubstituted phenyl or phenyl substituted with up to three substituents selected from $C_1$-$C_{20}$ alkyl, substituted $C_1$-$C_{20}$ alkyl, $C_1$-$C_{20}$ heteroalkyl, substituted $C_1$-$C_{20}$ heteroalkyl, $C_5$-$C_{24}$ aryl, substituted $C_5$-$C_{24}$ aryl, $C_5$-$C_{24}$ heteroaryl, $C_6$-$C_{24}$ aralkyl, $C_6$-$C_{24}$ alkaryl, or halide. Any substituents present may be hydrogen, $C_1$-$C_{12}$ alkyl, $C_1$-$C_{12}$ alkoxy, $C_5$-$C_{14}$ aryl, substituted $C_5$-$C_{14}$ aryl, or halide. As an example, $R^3$ and $R^4$ may be mesityl.

In a third group of catalysts having the structure of formula (I), M, m, n, $X^1$, $X^2$, $R^1$, and $R^2$ are as defined for the first group of catalysts, $L^1$ may be a strongly coordinating neutral electron donor ligand such as any of those described for the first and second groups of catalysts, and $L^2$ and $L^3$ may be weakly coordinating neutral electron donor ligands in the form of optionally substituted heterocyclic groups. n is zero or 1, such that $L^3$ may or may not be present. In the third group of catalysts, $L^2$ and $L^3$ may be optionally substituted five- or six-membered monocyclic groups containing 1 to about 4, or 1 to about 3, or 1 to 2 heteroatoms, or are optionally substituted bicyclic or polycyclic structures composed of 2 to about 5 such five- or six-membered monocyclic groups. If the heterocyclic group is substituted, it should not be substituted on a coordinating heteroatom, and any one cyclic moiety within a heterocyclic group may not be substituted with more than 3 substituents.

For the third group of catalysts, examples of $L^2$ and $L^3$ may include, heterocycles containing nitrogen, sulfur, oxygen, or a mixture thereof.

Examples of nitrogen-containing heterocycles appropriate for $L^2$ and $L^3$ may include pyridine, bipyridine, pyridazine, pyrimidine, bipyridamine, pyrazine, 1,3,5-triazine, 1,2,4-triazine, 1,2,3-triazine, pyrrole, 2H-pyrrole, 3H-pyrrole, pyrazole, 2H-imidazole, 1,2,3-triazole, 1,2,4-triazole, indole, 3H-indole, 1H-isoindole, cyclopenta(b)pyridine, indazole, quinoline, bisquinoline, isoquinoline, bisisoquinoline, cinnoline, quinazoline, naphthyridine, piperidine, piperazine, pyrrolidine, pyrazolidine, quinuclidine, imidazolidine, picolylimine, purine, benzimidazole, bisimidazole, phenazine, acridine, and carbazole.

Examples of sulfur-containing heterocycles appropriate for $L^2$ and $L^3$ may include thiophene, 1,2-dithiole, 1,3-dithiole, thiepin, benzo(b)thiophene, benzo(c)thiophene, thionaphthene, dibenzothiophene, 2H-thiopyran, 4H-thiopyran, and thioanthrene.

Examples of oxygen-containing heterocycles appropriate for $L^2$ and $L^3$ may include 2H-pyran, 4H-pyran, 2-pyrone, 4-pyrone, 1,2-dioxin, 1,3-dioxin, oxepin, furan, 2H-1-benzopyran, coumarin, coumarone, chromene, chroman-4-one, isochromen-1-one, isochromen-3-one, xanthene, tetrahydrofuran, 1,4-dioxan, and dibenzofuran.

Examples of mixed heterocycles appropriate for $L^2$ and $L^3$ may include isoxazole, oxazole, thiazole, isothiazole, 1,2,3-oxadiazole, 1,2,4-oxadiazole, 1,3,4-oxadiazole, 1,2,3,4-oxatriazole, 1,2,3,5-oxatriazole, 3H-1,2,3-dioxazole, 3H-1,2-oxathiole, 1,3-oxathiole, 4H-1,2-oxazine, 2H-1,3-oxazine, 1,4-oxazine, 1,2,5-oxathiazine, o-isooxazine, phenoxazine, phenothiazine, pyrano[3,4-b]pyrrole, indoxazine, benzoxazole, anthranil, and morpholine.

The $L^2$ and $L^3$ ligands may be aromatic nitrogen-containing and oxygen-containing heterocycles. The $L^2$ and $L^3$ ligands may be monocyclic N-heteroaryl ligands that may be optionally substituted with 1 to 3, or 1 or 2, substituents. Specific examples of $L^2$ and $L^3$ ligands may include pyridine and substituted pyridines, such as 3-bromopyridine, 4-bromopyridine, 3,5-dibromopyridine, 2,4,6-tribromopyridine, 2,6-dibromopyridine, 3-chloropyridine, 4-chloropyridine, 3,5-dichloropyridine, 2,4,6-trichloropyridine, 2,6-dichloropyridine, 4-iodopyridine, 3,5-diiodopyridine, 3,5-dibromo-4-methylpyridine, 3,5-dichloro-4-methylpyridine, 3,5-dimethyl-4-bromopyridine, 3,5-dimethylpyridine, 4-methylpyridine, 3,5-diisopropylpyridine, 2,4,6-trimethylpyridine, 2,4,6-triisopropylpyridine, 4-(tert-butyl)pyridine, 4-phenylpyridine, 3,5-diphenylpyridine, 3,5-dichloro-4-phenylpyridine, and the like.

Any substituents present on $L^2$ and/or $L^3$ may be selected from halo, $C_1$-$C_{20}$ alkyl, substituted $C_1$-$C_{20}$ alkyl, $C_1$-$C_{20}$ heteroalkyl, substituted $C_1$-$C_{20}$ heteroalkyl, $C_5$-$C_{24}$ aryl, substituted $C_5$-$C_{24}$ aryl, $C_5$-$C_{24}$ heteroaryl, substituted $C_5$-$C_{24}$ heteroaryl, $C_6$-$C_{24}$ alkaryl, substituted $C_6$-$C_{24}$ alkaryl, $C_6$-$C_{24}$ heteroalkaryl, substituted $C_6$-$C_{24}$ heteroalkaryl, $C_6$-$C_{24}$ aralkyl, substituted $C_6$-$C_{24}$ aralkyl, $C_6$-$C_{24}$ heteroaralkyl, substituted $C_6$-$C_{24}$ heteroaralkyl, and functional groups, with suitable functional groups including, without limitation, $C_1$-$C_{20}$ alkoxy, $C_5$-$C_{24}$ aryloxy, $C_2$-$C_{20}$ alkylcarbonyl, $C_6$-$C_{24}$ arylcarbonyl, $C_2$-$C_{20}$ alkylcarbonyloxy, $C_6$-$C_{24}$ arylcarbonyloxy, $C_2$-$C_{20}$ alkoxycarbonyl, $C_6$-$C_{24}$ aryloxycarbonyl, halocarbonyl, $C_2$-$C_{20}$ alkylcarbonato, $C_6$-$C_{24}$ arylcarbonato, carboxy, carboxylato, carbamoyl, mono-($C_1$-$C_{20}$ alkyl)-substituted carbamoyl, di-($C_1$-$C_{20}$ alkyl)-substituted carbamoyl, di-N—($C_1$-$C_{20}$ alkyl), N—($C_5$-$C_{24}$ aryl)-substituted carbamoyl, mono-($C_5$-$C_{24}$ aryl)-substituted carbamoyl, di-($C_6$-$C_{24}$ aryl)-substituted carbamoyl, thiocarbamoyl, mono-($C_1$-$C_{20}$ alkyl)-substituted thiocarbamoyl, di-($C_1$-$C_{20}$ alkyl)-substituted thiocarbamoyl, di-N—($C_1$-$C_{20}$ alkyl)-N—($C_6$-$C_{24}$ aryl)-substituted thiocarbamoyl, mono-($C_6$-$C_{24}$ aryl)-substituted thiocarbamoyl, di-($C_6$-$C_{24}$ aryl)-substituted thiocarbamoyl, carbamido, formyl, thioformyl, amino, mono-($C_1$-$C_{20}$ alkyl)-substituted amino, di-($C_1$-$C_{20}$ alkyl)-substituted amino, mono-($C_5$-$C_{24}$ aryl)-substituted amino, di-($C_5$-$C_{24}$ aryl)-substituted amino, di-N—($C_1$-$C_{20}$ alkyl), N—($C_5$-$C_{24}$ aryl)-substituted amino, $C_2$-$C_{20}$ alkylamido, $C_6$-$C_{24}$ arylamido, imino, $C_1$-$C_{20}$ alkylimino, $C_5$-$C_{24}$ arylimino, nitro, and nitroso. In addition, two adjacent substituents may be taken together to form a ring, generally a five- or six-membered alicyclic or aryl ring, optionally containing 1 to about 3 heteroatoms and 1 to about 3 substituents.

The substituents on $L^2$ and $L^3$ may include halo, $C_1$-$C_{12}$ alkyl, substituted $C_1$-$C_{12}$ alkyl, $C_1$-$C_{12}$ heteroalkyl, substituted $C_1$-$C_{12}$ heteroalkyl, $C_5$-$C_{14}$ aryl, substituted $C_5$-$C_{14}$ aryl, $C_5$-$C_{14}$ heteroaryl, substituted $C_5$-$C_{14}$ heteroaryl, $C_6$-$C_{16}$ alkaryl, substituted $C_6$-$C_{16}$ alkaryl, $C_6$-$C_{16}$ heteroalkaryl, substituted $C_6$-$C_{16}$ heteroalkaryl, $C_6$-$C_{16}$ aralkyl, substituted $C_6$-$C_{16}$ aralkyl, $C_6$-$C_{16}$ heteroaralkyl, substituted $C_6$-$C_{16}$ heteroaralkyl, $C_1$-$C_{12}$ alkoxy, $C_5$-$C_{14}$ aryloxy, $C_2$-$C_{12}$ alkylcarbonyl, $C_6$-$C_{14}$ arylcarbonyl, $C_2$-$C_{12}$ alkylcarbonyloxy, $C_6$-$C_{14}$ arylcarbonyloxy, $C_2$-$C_{12}$ alkoxycarbonyl, $C_6$-$C_{14}$ aryloxycarbonyl, halocarbonyl, formyl, amino, mono-($C_1$-$C_{12}$ alkyl)-substituted amino, di-($C_1$-$C_{12}$ alkyl)-substituted amino, mono-($C_5$-$C_{14}$ aryl)-substituted amino, di-($C_5$-$C_{14}$ aryl)-substituted amino, and nitro.

The substituents may be halo, $C_1$-$C_6$ alkyl, $C_1$-$C_6$ haloalkyl, $C_1$-$C_6$ alkoxy, phenyl, substituted phenyl, formyl, N,N-di$C_1$-$C_6$ alkyl)amino, nitro, or nitrogen heterocycles as described above (including, for example, pyrrolidine, piperidine, piperazine, pyrazine, pyrimidine, pyridine, pyridazine, etc.).

$L^2$ and $L^3$ may also be taken together to form a bidentate or multidentate ligand containing two or more, generally two, coordinating heteroatoms such as N, O, S, or P. These may include diimine ligands of the Brookhart type. A representative bidentate ligand has the structure of formula (VI)

(VI)

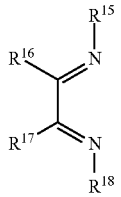

wherein $R^{15}$, $R^{16}$, $R^{17}$, and $R^{18}$ may be hydrocarbyl (e.g., $C_1$-$C_{20}$ alkyl, $C_2$-$C_{20}$ alkenyl, $C_2$-$C_{20}$ alkynyl, $C_5$-$C_{24}$ aryl, $C_6$-$C_{24}$ alkaryl, or $C_6$-$C_{24}$ aralkyl), substituted hydrocarbyl (e.g., substituted $C_1$-$C_{20}$ alkyl, $C_2$-$C_{20}$ alkenyl, $C_2$-$C_{20}$ alkynyl, $C_5$-$C_{24}$ aryl, $C_6$-$C_{24}$ alkaryl, or $C_6$-$C_{24}$ aralkyl), heteroatom-containing hydrocarbyl (e.g., $C_1$-$C_{20}$ heteroalkyl, $C_5$-$C_{24}$ heteroaryl, heteroatom-containing $C_6$-$C_{24}$ aralkyl, or heteroatom-containing $C_6$-$C_{24}$ alkaryl), or substituted heteroatom-containing hydrocarbyl (e.g., substituted $C_1$-$C_{20}$ heteroalkyl, $C_5$-$C_{24}$ heteroaryl, heteroatom-containing $C_6$-$C_{24}$ aralkyl, or heteroatom-containing $C_6$-$C_{24}$ alkaryl), or (1) $R^{15}$ and $R^{16}$, (2) $R^{17}$ and $R^{18}$, (3) $R^{16}$ and $R^{17}$, or (4) both $R^{15}$ and $R^{16}$, and $R^{17}$ and $R^{18}$, may be taken together to form a ring, i.e., an N-heterocycle. Preferred cyclic groups in such a case are five- and six-membered rings, typically aromatic rings.

In a fourth group of catalysts that have the structure of formula (I), two of the substituents may be taken together to form a bidentate ligand or a tridentate ligand. Examples of bidentate ligands may include bisphosphines, dialkoxides, alkyldiketonates, and aryldiketonates. These may include —$P(Ph)_2CH_2CH_2P(Ph)_2$—, —$As(Ph)_2CH_2CH_2As(Ph_2)$—, —$P(Ph)_2CH_2CH_2C(CF_3)_2O$—, binaphtholate dianions, pinacolate dianions, —$P(CH_3)_2(CH_2)_2P(CH_3)_2$—, and —$OC(CH_3)_2(CH_3)_2CO$—. Preferred bidentate ligands are —$P(Ph)_2CH_2CH_2P(Ph)_2$- and —$P(CH_3)_2(CH_2)_2P(CH_3)_2$—. Tridentate ligands include, but are not limited to, $(CH_3)_2NCH_2CH_2P(Ph)CH_2CH_2N(CH_3)_2$. Other tridentate ligands may be those in which any three of —$X^1$, $X^2$, $L^1$, $L^2$, $L^3$, $R^1$, and $R^2$ (e.g., $X^1$, $L^1$, and $L^2$) are taken together to be cyclopentadienyl, indenyl, or fluorenyl, each optionally substituted with $C_2$-$C_{20}$ alkenyl, $C_2$-$C_{20}$ alkynyl, $C_1$-$C_{20}$ alkyl, $C_5$-$C_{20}$ aryl, $C_1$-$C_{20}$ alkoxy, $C_2$-$C_{20}$ alkenyloxy, $C_2$-$C_{20}$ alkynyloxy, $C_5$-$C_{20}$ aryloxy, $C_2$-$C_{20}$ alkoxycarbonyl, $C_1$-$C_{20}$ alkylthio, $C_1$-$C_{20}$ alkylsulfonyl, or $C_1$-$C_{20}$ alkylsulfinyl, each of which may be further substituted with $C_1$-$C_6$ alkyl, halide, $C_1$-$C_6$ alkoxy or with a phenyl group optionally substituted with halide, $C_1$-$C_6$ alkyl, or $C_1$-$C_6$ alkoxy. In compounds of this type, X, $L^1$, and $L^2$ may be taken together to be cyclopentadienyl or indenyl, each optionally substituted with vinyl, $C_1$-$C_{10}$ alkyl, $C_5$-$C_{20}$ aryl, $C_1$-$C_{10}$ carboxylate, $C_2$-$C_{10}$ alkoxycarbonyl, $C_1$-$C_{10}$ alkoxy, or $C_5$-$C_{20}$ aryloxy, each optionally substituted with $C_1$-$C_6$ alkyl, halide, $C_1$-$C_6$ alkoxy or with a phenyl group optionally substituted with halide, $C_1$-$C_6$ alkyl or $C_1$-$C_6$ alkoxy. X, $L^1$ and $L^2$ may be taken together to be cyclopentadienyl, optionally substituted with vinyl, hydrogen, methyl, or phenyl. Tetradentate ligands may include $O_2C(CH_2)_2P(Ph)(CH_2)_2P(Ph)(CH_2)_2CO_2$, phthalocyanines, and porphyrins.

Complexes wherein $L^2$ and $R^2$ are linked are examples of the fourth group of catalysts. These may be called "Grubbs-Hoveyda" catalysts. Examples of Grubbs-Hoveyda-type catalysts may include the following:

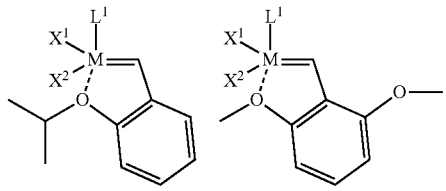

-continued

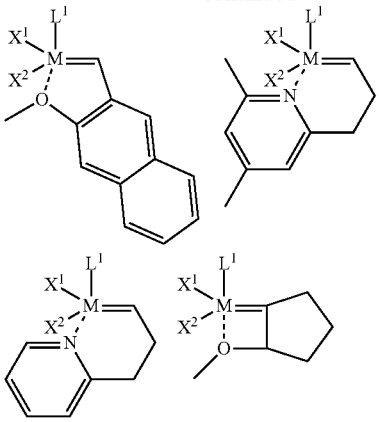

wherein $L^1$, $X^1$, $X^2$, and M are as described for any of the other groups of catalysts.

In addition to the catalysts that have the structure of formula (I), as described above, other transition metal carbene complexes may include;

neutral ruthenium or osmium metal carbene complexes containing metal centers that are formally in the +2 oxidation state, have an electron count of 16, are penta-coordinated, and are of the general formula (VII);

neutral ruthenium or osmium metal carbene complexes containing metal centers that are formally in the +2 oxidation state, have an electron count of 18, are hexa-coordinated, and are of the general formula (VIII);

cationic ruthenium or osmium metal carbene complexes containing metal centers that are formally in the +2 oxidation state, have an electron count of 14, are tetra-coordinated, and are of the general formula (IX); and cationic ruthenium or osmium metal carbene complexes containing metal centers that are formally in the +2 oxidation state, have an electron count of 14, are tetra-coordinated, and are of the general formula (X)

(VII)

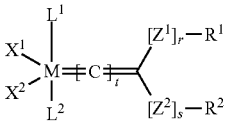

(VIII)

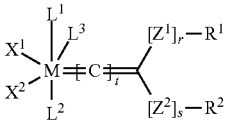

(IX)

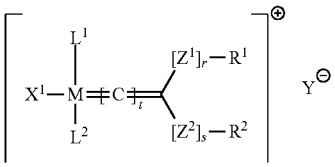

(X)

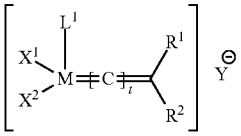

wherein: $X^1$, $X^2$, $L^1$, $L^2$, n, $L^3$, $R^1$, and $R^2$ may be as defined for any of the previously defined four groups of catalysts; r and s are independently zero or 1; t may be an integer in the range of zero to 5;

Y may be any non-coordinating anion (e.g., a halide ion, $BF_4^-$, etc.); $Z^1$ and $Z^2$ may be independently selected from —O—, —S—, —$NR^2$—, —$PR^2$—, —P(═O)$R^2$—, —P($OR^2$)—, —P(═O)($OR^2$)—, —C(═O)—, —C(═O)O—, —OC(═O)—, —OC(═O)O—, —S(═O)—, and —$S(═O)_2$—; $Z^3$ may be any cationic moiety such as —$P(R^2)_3^+$ or —$N(R^2)_3^+$; and any two or more of $X^1$, $X^2$, $L^1$, $L^2$, $L^3$, n, $Z^1$, $Z^2$, $Z^3$, $R^1$, and $R^2$ may be taken together to form a cyclic group, e.g., a multidentate ligand, and wherein any one or more of $X^1$, $X^2$, $L^1$, $L^2$, n, $L^3$, $Z^1$, $Z^2$, $Z^3$, $R^1$, and $R^2$ may be attached to a support.

Other suitable complexes include Group 8 transition metal carbenes bearing a cationic substituent, such as are disclosed in U.S. Pat. No. 7,365,140 (Piers et al.) having the general structure (XI):

(XI)

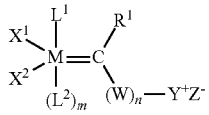

wherein:

M is a Group 8 transition metal;

$L^1$ and $L^2$ are neutral electron donor ligands;

$X^1$ and $X^2$ are anionic ligands;

$R^1$ is hydrogen, $C_1$-$C_{12}$ hydrocarbyl, or substituted $C_1$-$C_{12}$ hydrocarbyl;

W is an optionally substituted and/or heteroatom-containing $C_1$-$C_{20}$ hydrocarbylene linkage;

Y is a positively charged Group 15 or Group 16 element substituted with hydrogen, $C_1$-$C_{12}$ hydrocarbyl, substituted $C_1$-$C_{12}$ hydrocarbyl; heteroatom-containing $C_1$-$C_{12}$ hydrocarbyl, or substituted heteroatom-containing hydrocarbyl;

$Z^-$ is a negatively charged counterion;

m is zero or 1; and n is zero or 1;

wherein any two or more of $L^1$, $L^2$, $X^1$, $X^2$, $R^1$, W, and Y can be taken together to form a cyclic group.

Each of M, $L^1$, $L^2$, $X^1$, and $X^2$ in structure (XI) may be as previously defined herein.

W may be an optionally substituted and/or heteroatom-containing $C_1$-$C_{20}$ hydrocarbylene linkage, typically an optionally substituted $C_1$-$C_{12}$ alkylene linkage, e.g., —$(CH_2)_i$— where i is an integer in the range of 1 to 12 inclusive and any of the hydrogen atoms may be replaced with a non-hydrogen substituent as described earlier herein with regard to the definition of the term "substituted." The subscript n may be zero or 1, meaning that W may or may not be present. In an embodiment, n is zero.

Y may be a positively charged Group 15 or Group 16 element substituted with hydrogen, $C_1$-$C_{12}$ hydrocarbyl, substituted $C_1$-$C_{12}$ hydrocarbyl, heteroatom-containing $C_1$-$C_{12}$ hydrocarbyl, or substituted heteroatom-containing hydrocarbyl. Y may be a $C_1$-$C_{12}$ hydrocarbyl-substituted, positively charged Group 15 or Group 16 element. Representative Y groups may include $P(R^2)_3$, $P(R^2)_3$, $As(R^2)_3$, $S(R^2)_2$, $O(R^2)_2$, where the $R^2$ may be independently selected from $C_1$-$C_{12}$ hydrocarbyl. Within these, the Y groups may be phosphines of the structure $P(R^2)_3$ wherein the $R^2$ may be independently selected from $C_1$-$C_{12}$ alkyl and aryl, and thus include, for example, methyl, ethyl, n-propyl, isopropyl, n-butyl, isobutyl, t-butyl, cyclopentyl, cyclohexyl, and phenyl. Y may also be a heterocyclic group containing the positively charged Group 15 or Group 16 element. For instance, when the Group 15 or Group 16 element is nitrogen, Y may be an optionally substituted pyridinyl, pyrazinyl, or imidazolyl group.

$Z^-$ may be a negatively charged counterion associated with the cationic complex, and may be virtually any anion, so long as the anion is inert with respect to the components of the complex and the reactants and reagents used in the metathesis reaction. The $Z^-$ moieties may be weakly coordinating anions, such as, for instance, $[B(C_6F_5)_4]^-$, $[BF_4]^-$, $[B(C_6H_6)_4]^-$, $[CF_3S(O)_3]^-$, $[PF_6]^-$, $[SbF_6]^-$, $[AlCl_4]^-$, $[FSO_3]^-$, $[CB_{11}H_6Cl_6]^-$, $[C_{11}H_6Br_6]^-$, and $[SO_2F{:}SbF_5]^-$. Anions suitable as $Z^-$ may be of the formula $B(R^{15})_4^-$ where $R^{15}$ is fluoro, aryl, or perfluorinated aryl, typically fluoro or perfluorinated aryl. Anions suitable as $Z^-$ may be $BF_4^-$ or $B(C_6F_5)^-$.

Any two or more of $X^1$, $X^2$, $L^1$, $L^2$, $R^1$, W, and Y may be taken together to form a cyclic group, as disclosed, for example, in U.S. Pat. No. 5,312,940 to Grubbs et al. When any of $X^1$, $X^2$, $L^1$, $L^2$, $R^1$, W, and Y are linked to form cyclic groups, those cyclic groups may be five- or six-membered rings, or may comprise two or three five- or six-membered rings, which may be either fused or linked. The cyclic groups may be aliphatic or aromatic, and may be heteroatom-containing and/or substituted.

One group of exemplary catalysts encompassed by the structure of formula (XI) are those wherein m and n are zero, such that the complex has the structure of formula (XII)

(XII)

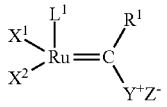

The $X^1$, $X^2$, and $L^1$ ligands are as described earlier with respect to complexes of formula (XI), as are $Y^+$ and $Z^-$. M may be Ru or Os and $R^1$ may be hydrogen or $C_1$-$C_{12}$ alkyl. M may be Ru, and $R^1$ may be hydrogen.

In formula (XII)-type catalysts, $L^1$ may be a heteroatom-containing carbene ligand having the structure of formula (XIII)

(XIII)

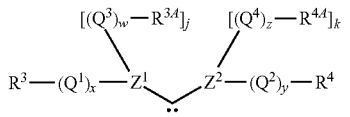

such that complex (XII) has the structure of formula (XIV)

(XIV)

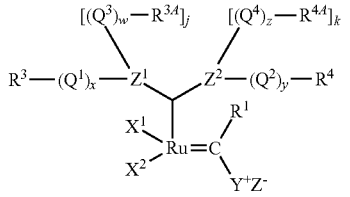

wherein $X^1$, $X^2$, $R^1$, $R^2$, Y, and Z are as defined previously, and the remaining substituents are as follows:

$Z^1$ and $Z^2$ may be heteroatoms typically selected from N, O, S, and P. Since O and S are divalent, j may be zero when $Z^1$ is O or S, and k may be zero when $Z^2$ is O or S. However, when $Z^1$ is N or P, then j may be 1, and when $Z^2$ is N or P, then k may be 1. Both $Z^1$ and $Z^2$ may be N.

$Q^1$, $Q^2$, $Q^3$, and $Q^4$ are linkers, e.g., $C_1$-$C_{12}$ hydrocarbylene, substituted $C_1$-$C_{12}$ hydrocarbylene, heteroatom-containing $C_1$-$C_{12}$ hydrocarbylene, substituted heteroatom-containing $C_1$-$C_{12}$ hydrocarbylene, or —(CO)—, and w, x, y, and z may be independently zero or 1, meaning that each linker may be optional. w, x, y, and z may all be zero.

$R^3$, $R^{3A}$, $R^4$, and $R^{4A}$ may be selected from hydrogen, $C_1$-$C_{20}$ hydrocarbyl, substituted $C_1$-$C_{20}$ hydrocarbyl, heteroatom-containing $C_1$-$C_{20}$ hydrocarbyl, and substituted heteroatom-containing $C_1$-$C_{20}$ hydrocarbyl.

w, x, y, and z may be zero, $Z^1$ and $Z^1$ may be N, and $R^{3A}$ and $R^{4A}$ may be linked to form -Q-, such that the complex has the structure of formula (XV)

(XV)

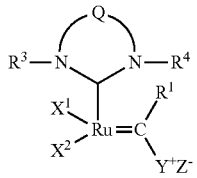

wherein $R^3$ and $R^4$ are defined above. At least one of $R^3$ and $R^4$, and optionally both $R^3$ and $R^4$, may be alicyclic or aromatic of one to about five rings, and optionally containing one or more heteroatoms and/or substituents. Q may be a linker, typically a hydrocarbylene linker, including $C_1$-$C_{12}$ hydrocarbylene, substituted $C_1$-$C_{12}$ hydrocarbylene, heteroatom-containing $C_1$-$C_{12}$ hydrocarbylene, or substituted heteroatom-containing $C_1$-$C_{12}$ hydrocarbylene linker, wherein two or more substituents on adjacent atoms within Q may be linked to form an additional cyclic structure, which may be similarly substituted to provide a fused polycyclic structure of two to about five cyclic groups. Q may be a two-atom linkage or a three-atom linkage, e.g., —$CH_2$—$CH_2$—, —CH(Ph)—CH(Ph)— where Ph is phenyl; ═CR—N═, giving rise to an unsubstituted (when R═H) or substituted (R=other than H) triazolyl group; or —$CH_2$—$SiR_2$—$CH_2$— (where R is H, alkyl, alkoxy, etc.).

Q may be a two-atom linkage having the structure —$CR^8R^9$—$CR^{10}R^{11}$— or —$CR^8$═$CR^{10}$—, wherein $R^8$, $R^9$, $R^{10}$, and $R^{11}$ may be independently selected from hydrogen, $C_1$-$C_{12}$ hydrocarbyl, substituted $C_1$-$C_{12}$ hydrocarbyl, heteroatom-containing $C_1$-$C_{12}$ hydrocarbyl, substituted heteroatom-containing $C_1$-$C_{12}$ hydrocarbyl, and functional groups. Examples of the functional groups may include carboxyl, $C_1$-$C_{20}$ alkoxy, $C_5$-$C_{20}$ aryloxy, $C_2$-$C_{20}$ alkoxycarbonyl, $C_2$-$C_{20}$ alkoxycarbonyl, $C_2$-$C_{20}$ acyloxy, $C_1$-$C_{20}$ alkylthio, $C_5$-$C_{20}$ arylthio, $C_1$-$C_{20}$ alkylsulfonyl, and $C_1$-$C_{20}$ alkylsulfinyl, optionally substituted with one or more moieties selected from $C_1$-$C_{10}$ alkyl, $C_1$-$C_{10}$ alkoxy, $C_5$-$C_{20}$ aryl, hydroxyl, sulfhydryl, formyl, and halide. Alternatively, any two of $R^6$, $R^9$, $R^{10}$, and $R^{11}$ may be linked together to form a substituted or unsubstituted, saturated or unsaturated ring structure, e.g., a $C_4$-$C_{12}$ alicyclic group or a $C_5$ or $C_6$ aryl group, which may itself be substituted, e.g., with linked or fused alicyclic or aromatic groups, or with other substituents.

Further details concerning such formula (XI) complexes, as well as associated preparation methods, may be obtained from U.S. Pat. No. 7,365,140.

Suitable solid supports for any of the catalysts described herein may be made of synthetic, semi-synthetic, or naturally occurring materials, which may be organic or inorganic, e.g., polymeric, ceramic, or metallic. Attachment to the support may be covalent, and the covalent linkage may be direct or indirect, if indirect, typically through a functional group on a support surface.

Examples of the catalysts that may be used may include the following, some of which for convenience are identified throughout this disclosure by reference to their molecular weight:

12

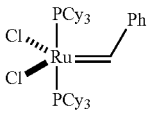

14

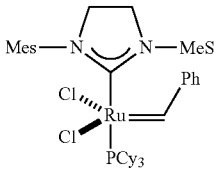

16

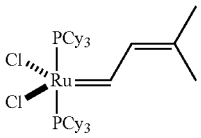

18

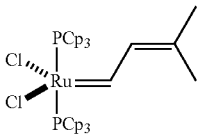

20

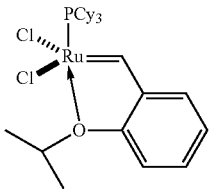

22

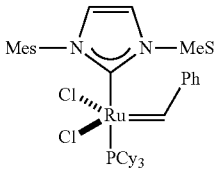

24

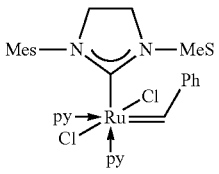

-continued

26

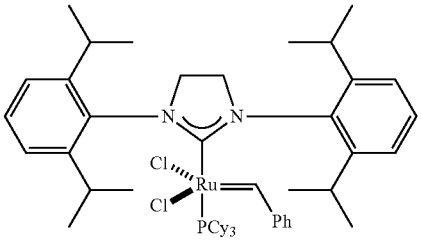

28

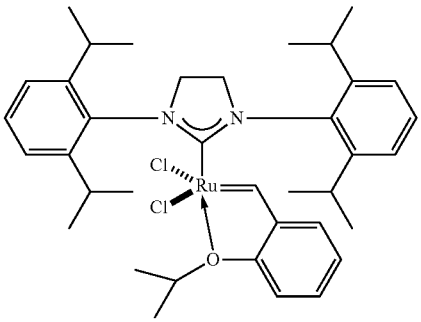

50

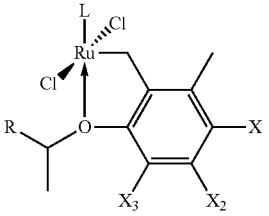

where

L = $PCy_3$, siMes, Mes, Phobane

X = H, $NO_2$, $SO_2N(CH_3)_2$ $X_2$ = H, $N^+(C_2H_3)_2CH_3$ $X_3$ = H, Phenyl

R = H, alkyl, aryl, $Co_2Me$

52

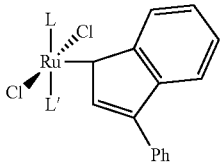

where

L = $PCy_3$, siMes, Mes, Phobane

L' = $PCy_3$, Phobane

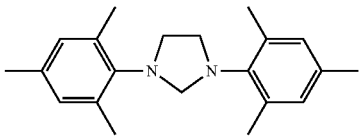

siMes

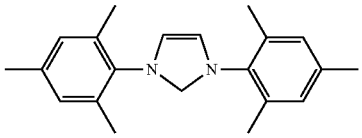

Mes

-continued
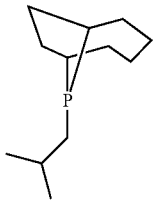
Phobane
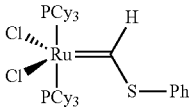
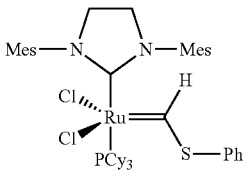
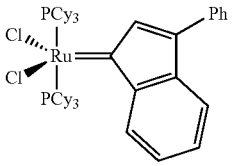
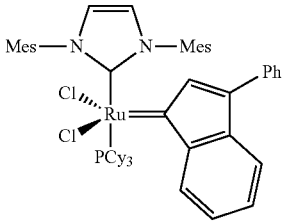
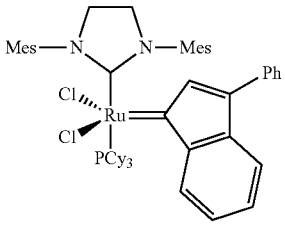
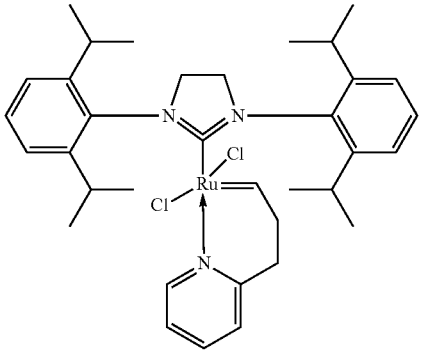
-continued
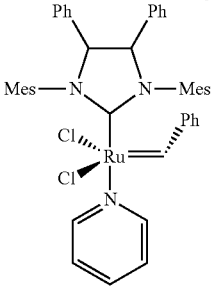
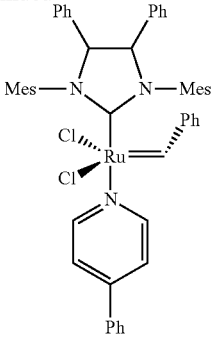
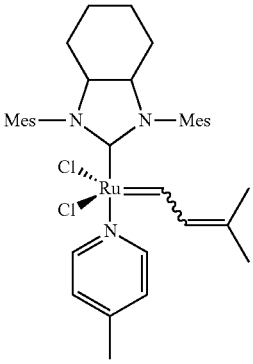
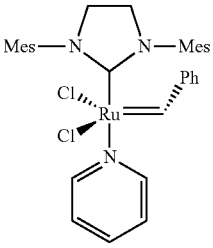
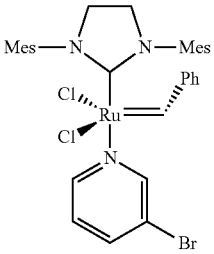
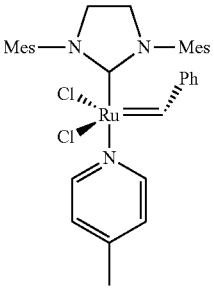
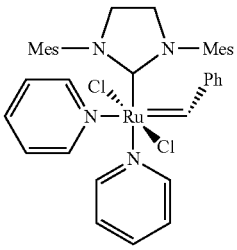
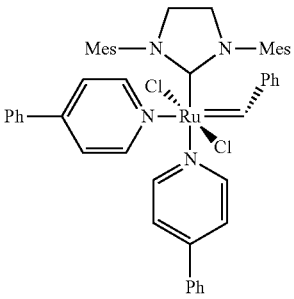

-continued
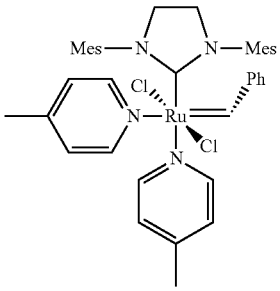
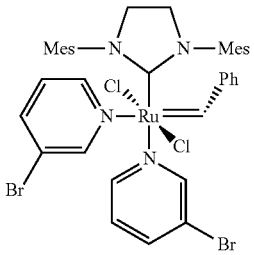
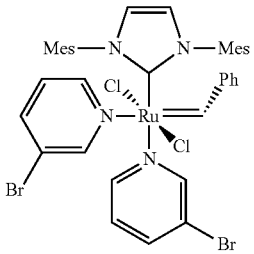
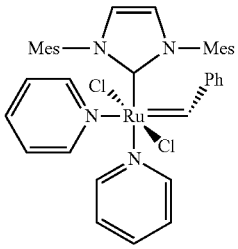
C827
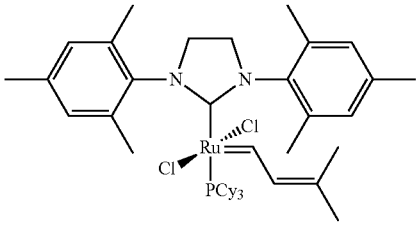
C859
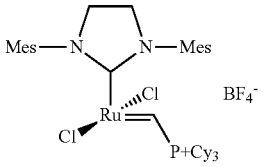
C841-n
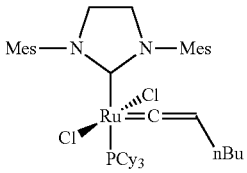
C916
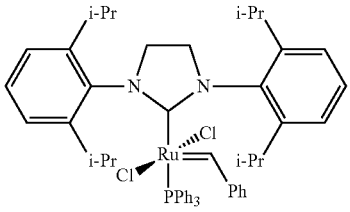
-continued
C965-p
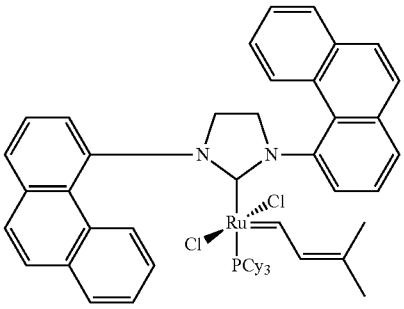
C727
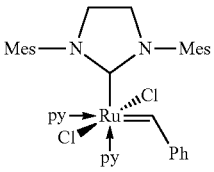
C577
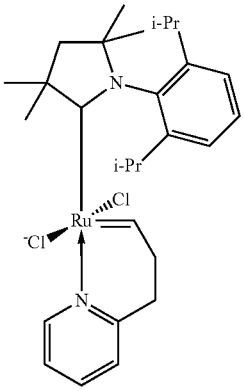
C646
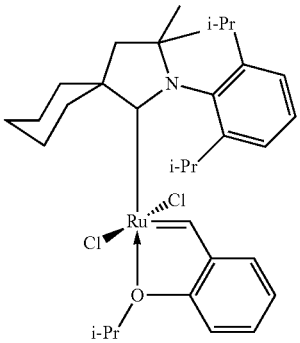
C701
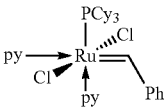
C767-m
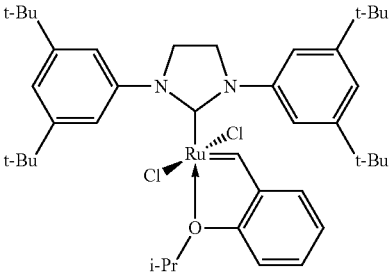

-continued
C811
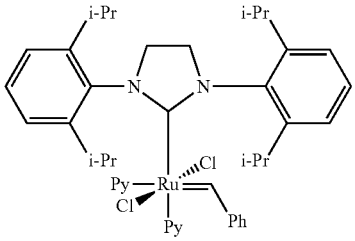
C801
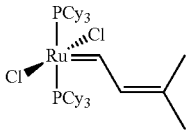
C838
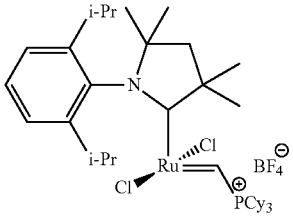
C712
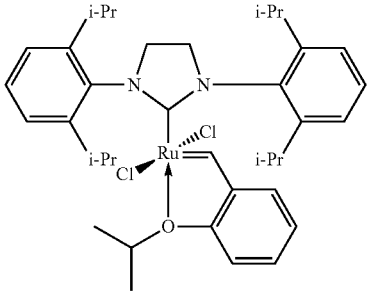
C933
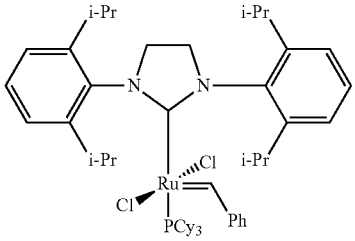
C824
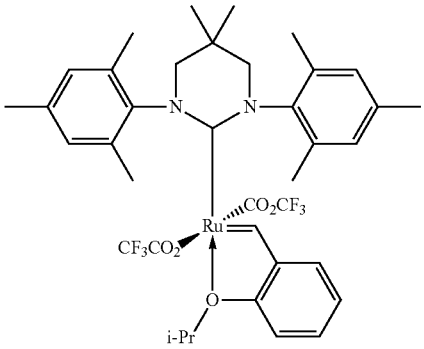
-continued
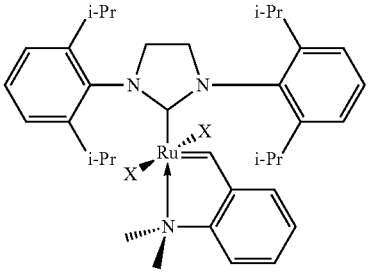
C697 (X = Cl)
C785 (X = Br)
C879 (X = I)
C601
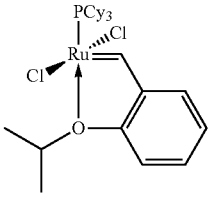
C848
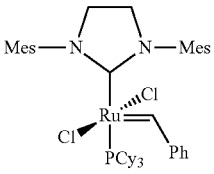
C831
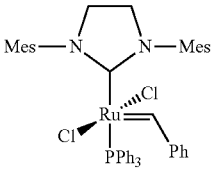
C627
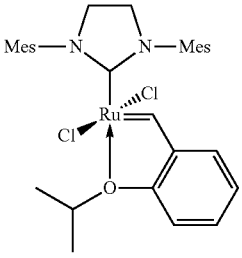
C672
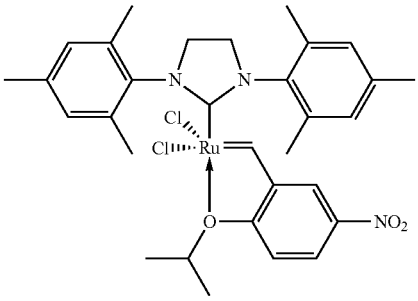

-continued
C657
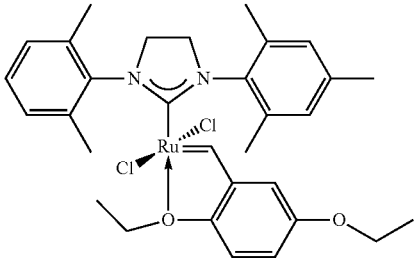
C734
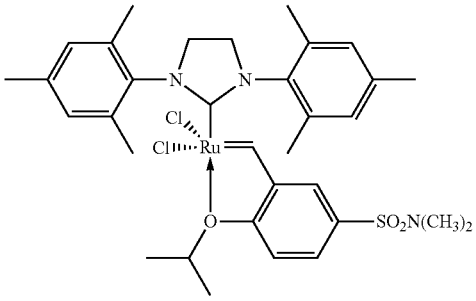
C767
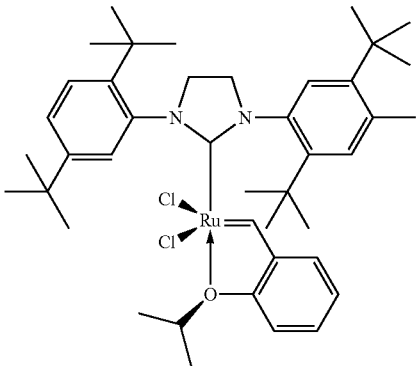
C809
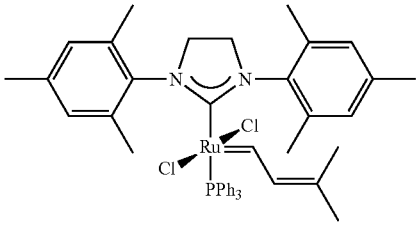
C849
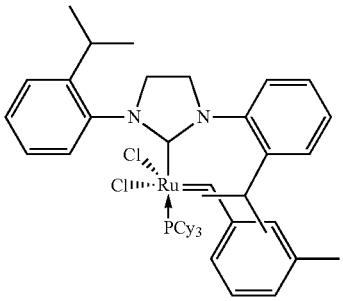
-continued
C923
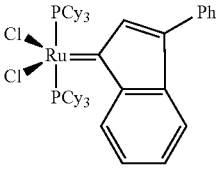
C-524
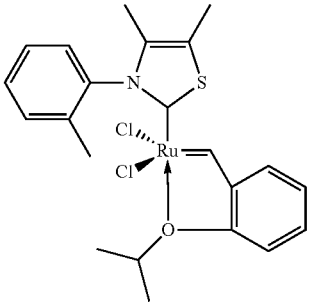
C-552
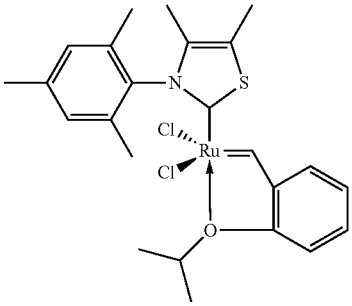
C-566
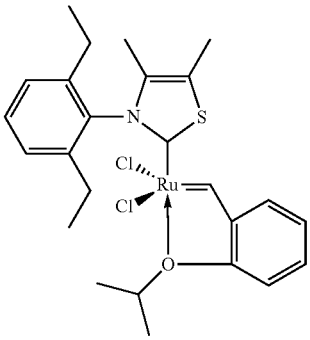
DPAI-278
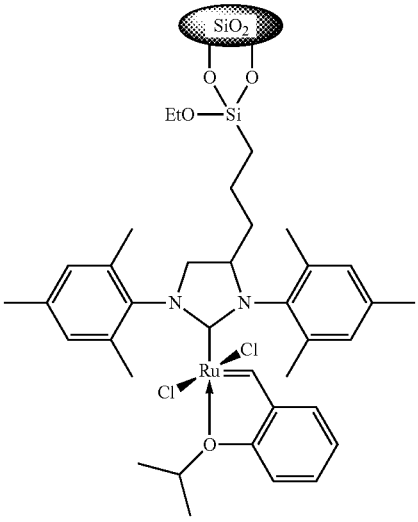

-continued
C-598
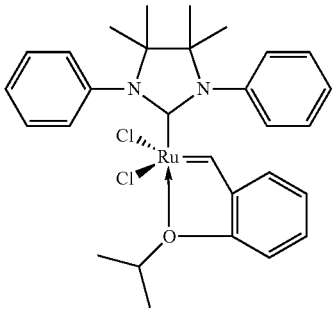
C-626
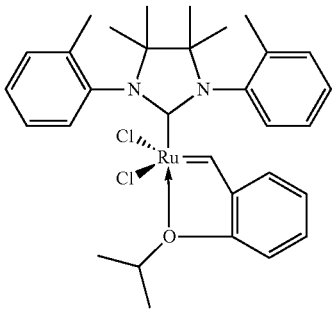
C949
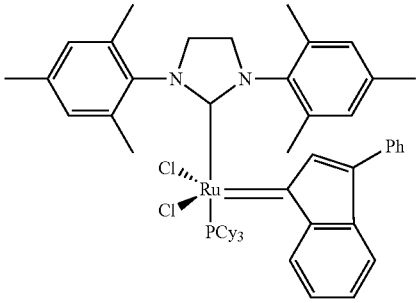
C823
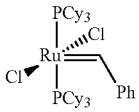
C606
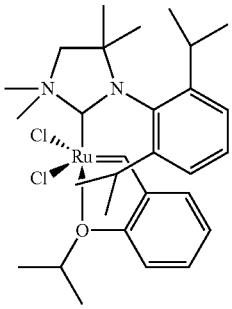
C629
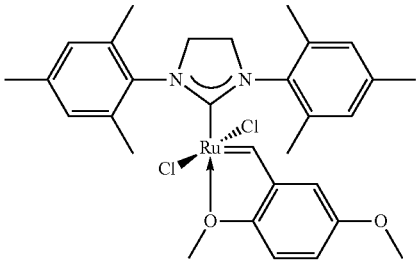
-continued
C833
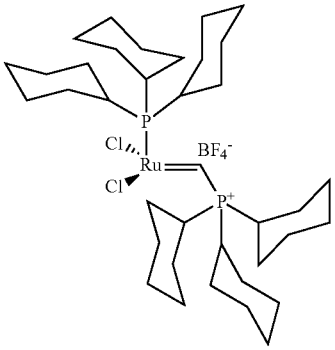
C613
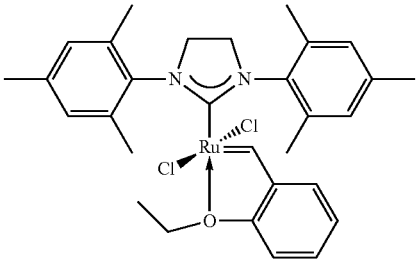
C827
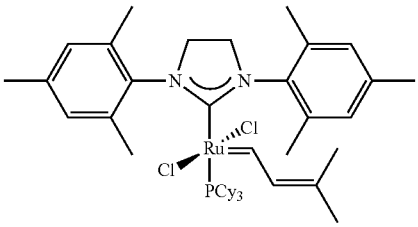
C627
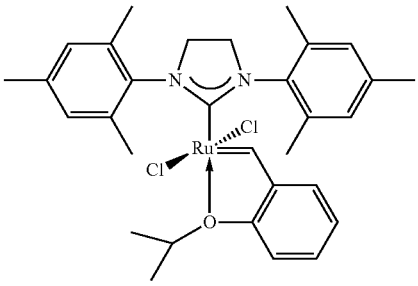
C793
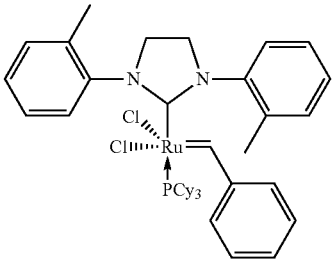

-continued

C598Cs

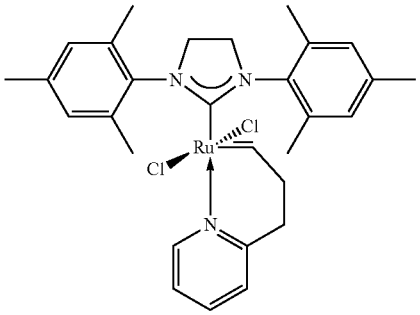

C782

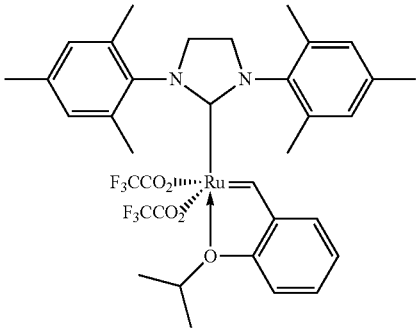

C702

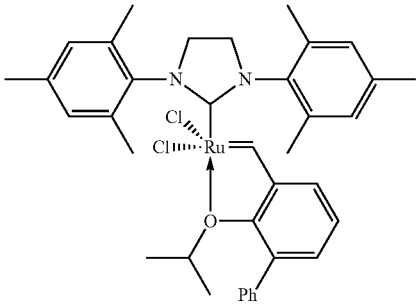

C884

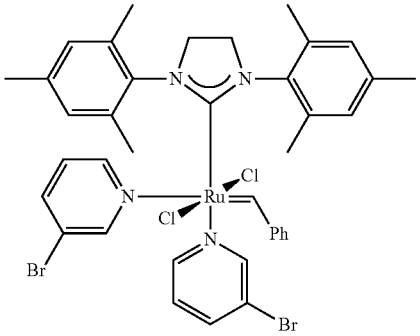

C933

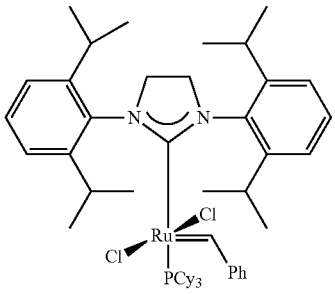

-continued

C866

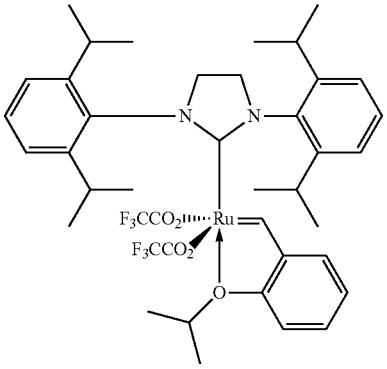

C571

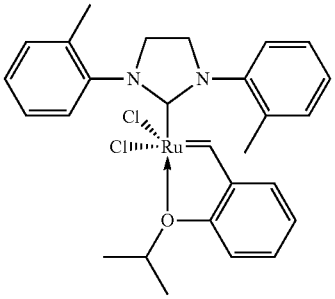

C578

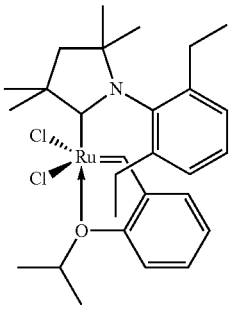

In the foregoing molecular structures and formulae, Ph represents phenyl, Cy represents cyclohexane, Me represents methyl, nBu represents n-butyl, i-Pr represents isopropyl, py represents pyridine (coordinated through the N atom), and Mes represents mesityl (i.e., 2,4,6-trimethylphenyl).

Further examples of catalysts that may be used may include the following: ruthenium (II) dichloro (3-methyl-1,2-butenylidene) bis(tricyclopentylphosphine) (C716); ruthenium (II) dichloro (3-methyl-1,2-butenylidene) bis(tricyclohexylphosphine) (C801); ruthenium (II) dichloro (phenylmethylene) bis(tricyclohexylphosphine) (C823); ruthenium (II) [1,3-bis-(2,4,6-trimethylphenyl)-2-imidazolidinylidene) dichloro (phenylmethylene) (triphenylphosphine) (C830), and ruthenium (II) dichloro (vinyl phenylmethylene) bis(tricyclohexylphosphine) (C835); ruthenium (II) dichloro (tricyclohexylphosphine)(o-isopropoxyphenylmethylene)(C601), and ruthenium(II)(1,3-bis-(2,4,6,-trimethylphenyl)-2-imidazolidinylidene)dichloro(phenylmethylene)(bis3-bromopyridine (C884)).

Exemplary ruthenium-based metathesis catalysts may include those represented by structures 12 (commonly known as Grubbs's catalyst), 14 and 16. Structures 18, 20, 22, 24, 26, 28, 60, 62, 64, 66, and 68 represent additional ruthenium-based metathesis catalysts. Catalysts C627, C682, C697, C712, and C827 represent still additional ruthenium-based catalysts. General structures 50 and 52 represent additional ruthenium-based metathesis catalysts of the type reported in Chemical & Engineering News; Feb. 12, 2007, at pages 37-47. In the structures, Ph is phenyl, Mes is mesityl, py is pyridine, Cp is cyclopentyl, and Cy is cyclohexyl.

Techniques for using the metathesis catalysts are known in the art (see, for example, U.S. Pat. Nos. 7,102,047; 6,794,534; 6,696,597; 6,414,097; 6,306,988; 5,922,863; 5,750,815; and metathesis catalysts with ligands in U.S. Publication No. 2007/0004917 A1), all incorporated herein by reference. A number of the metathesis catalysts as shown are manufactured by Materia, Inc. (Pasadena, Calif.).

Additional exemplary metathesis catalysts may include metal carbene complexes selected from molybdenum, osmium, chromium, rhenium, and tungsten. The term "complex" refers to a metal atom, such as a transition metal atom, with at least one ligand or complexing agent coordinated or bound thereto. Such a ligand may be a Lewis base in metal carbene complexes useful for alkyne or alkene-metathesis. Typical examples of such ligands include phosphines, halides and stabilized carbenes. Some metathesis catalysts may employ plural metals or metal co-catalysts (e.g., a catalyst comprising a tungsten halide, a tetraalkyl tin compound, and an organoaluminum compound).

An immobilized catalyst can be used for the metathesis process. An immobilized catalyst may be a system comprising a catalyst and a support, the catalyst associated with the support. Exemplary associations between the catalyst and the support may occur by way of chemical bonds or weak interactions (e.g. hydrogen bonds, donor acceptor interactions) between the catalyst, or any portions thereof, and the support or any portions thereof. Support may be any material suitable to support the catalyst. Typically, immobilized catalysts may be solid phase catalysts that act on liquid or gas phase reactants and products. Exemplary supports may include polymers, silica or alumina. Such an immobilized catalyst may be used in a flow process. An immobilized catalyst may simplify purification of products and recovery of the catalyst so that recycling the catalyst may be more convenient.

The Metathesis Reaction Process and Products

The metathesis starting materials or reactants, whether partially hydrogenated or unhydrogenated, may be subjected to a metathesis reaction to produce the desired metathesized product. Metathesis is a catalytic reaction that involves the interchange of alkylidene units among compounds containing one or more double bonds (i.e., olefinic compounds) via the formation and cleavage of the carbon-carbon double bonds. Metathesis can occur between two of the same molecules (often referred to as self-metathesis) and/or it can occur between two different molecules (often referred to as cross-metathesis).

Self-metathesis may be represented generally as shown in Equation I.

$$R^1—HC{=}CH—R^2+R^1—CH{=}CH—R^2 \rightarrow R^1—CH{=}CH—R^1+R^2—CH{=}CH—R^2 \quad (I)$$

where $R^1$ and $R^2$ are organic groups.

Cross-metathesis may be represented generally as shown in Equation II.

$$\begin{aligned} &R^1—HC{=}CH—R^2+R^3—HC{=}CH—R^4 \rightarrow R^1—HC{=}CH—R^3+R^1—HC{=}CH—R^4+R^2— \\ &HC{=}CH—R^3+R^2—HC{=}CH—R^4+R^1— \\ &HC{=}CH—R^1+R^2—HC{=}CH—R^2+R^3— \\ &HC{=}CH—R^3+R^4—HC{=}CH—R^4 \end{aligned} \quad (II)$$

where $R^1$, $R^2$, $R^3$, and $R^4$ are organic groups.

When an unsaturated polyol ester comprises molecules having more than one carbon-carbon double bond, self-metathesis may result in oligomerization or polymerization of the unsaturates in the starting material. For example, reaction sequence (III) depicts metathesis oligomerization of a representative species (e.g., an unsaturated polyol ester) having more than one carbon-carbon double bond. In reaction sequence (III), the self-metathesis reaction results in the formation of metathesis dimers, metathesis trimers, and metathesis tetramers. Although not shown, higher order oligomers such as metathesis pentamers, hexamers, heptamers, octamers, nonamers, decamers, and mixtures of two or more thereof, may also be formed. The number of metathesis repeating units or groups in the metathesized oil may range from 1 to about 100, or from 2 to about 50, or from 2 to about 30, or from 2 to about 10, or from 2 to about 4. The molecular weight of the metathesis dimer may be greater than the molecular weight of the unsaturated polyol ester from which the dimer is formed. Each of the bonded polyol ester molecules may be referred to as a "repeating unit or group." Typically, a metathesis trimer may be formed by the cross-metathesis of a metathesis dimer with an unsaturated polyol ester. Typically, a metathesis tetramer may be formed by the cross-metathesis of a metathesis trimer with an unsaturated polyol ester or formed by the cross-metathesis of two metathesis dimers.

$$R^1—HC{=}CH—R^2—HC{=}CH—R^3+R^1—HC{=}CH—R^2—HC{=}CH—R^3 \rightarrow R^1—HC{=}CH—R^2—HC{=}CH—R^2—HC{=}CH—R^3+\text{(other products)}$$

(metathesis dimer)

$$R^1—R^2—HC{=}CH—R^2—HC{=}CH—R^3+R^1—HC{=}CH—R^2—HC{=}CH—R^3 \rightarrow R^1—HC{=}CH—R^2—HC{=}CH—R^2—HC{=}CH—R^2—HC{=}CH—R^3+\text{(other products)}$$

(metathesis trimer)

$$\begin{aligned} &R^1—HC{=}CH—R^2—HC{=}CH—R^2—HC{=}CH—R^2—HC{=}CH—R^3+R^1—HC{=}CH—R^2— \\ &HC{=}CH—R^3 \rightarrow R^1—HC{=}CH—R^2— \\ &HC{=}CH—R^2—HC{=}CH—R^2—HC{=}CH—R^2—HC{=}CH—R^3+\text{(other products)} \end{aligned} \quad (III)$$

(metathesis tetramer)

where $R^1$, $R^2$, and $R^3$ are organic groups.

An unhydrogenated or hydrogenated polyol ester may be subjected to metathesis (self or cross). An exemplary self-metathesis reaction scheme is shown in FIG. 1. The reaction scheme shown in FIG. 1 highlights the reaction of the major fatty acid group component of the hydrogenation product composition (i.e., triacylglycerides having a monounsaturated fatty acid group). As shown in FIG. 1, a triglyceride having a monounsaturated fatty acid group is self-metathesized in the presence of a metathesis catalyst to form a metathesis product composition. Within FIG. 1, the R group designates a diglyceride. In FIG. 1, the reaction composition (18) comprises triglyceride having a monounsaturated fatty acid group. The resulting metathesis product composition includes, as major components, monounsaturated diacid esters in triglyceride form (20), internal olefins (22) and monounsaturated fatty acid esters in triglyceride form (24). Any one or more of the starting material (18) and each of the products shown, 20, 22 and 24, can be present as the cis or trans isomer. Unreacted starting material will also be present (not shown). As illustrated, the metathesis products, 20, 22 and 24 will have overlapping chain lengths.

A concern when performing metathesis of natural oils in their triglyceride or other form may be the generation light co-products. Naturally occurring methylene interrupted cis, cis configuration may form cyclic compounds that may be present as volatile organic compounds (VOCs). Depending upon the identity and amount of the VOC, it may represent a yield loss and/or a hazardous emission. It may thus be desirable to reduce the formation of VOCs during the metathesis reaction. As the concentration of polyunsaturates is reduced, this in turn reduces the likelihood of generating such metathesis products as cyclohexadienes (e.g., 1,3-cyclohexadiene, 1,4-cyclohexadiene, and the like), which themselves can be VOCs and/or be converted to other VOCs, such as benzene. Thus, in some aspects, the metathesis process may reduce the generation of VOCs and/or control the identity of any yield loss that can result from the metathesis reaction.

In some aspects, then, the invention can provide methods wherein the occurrence of methylene interrupted cis-cis diene structures are reduced in the metathesis reaction mixture. These structures can be converted to other structures by geometric isomerization, positional isomerization, and/or hydrogenation. In turn, these methods can reduce volatile co-product formation, e.g., in the form of cyclohexadiene.

Figure 2:
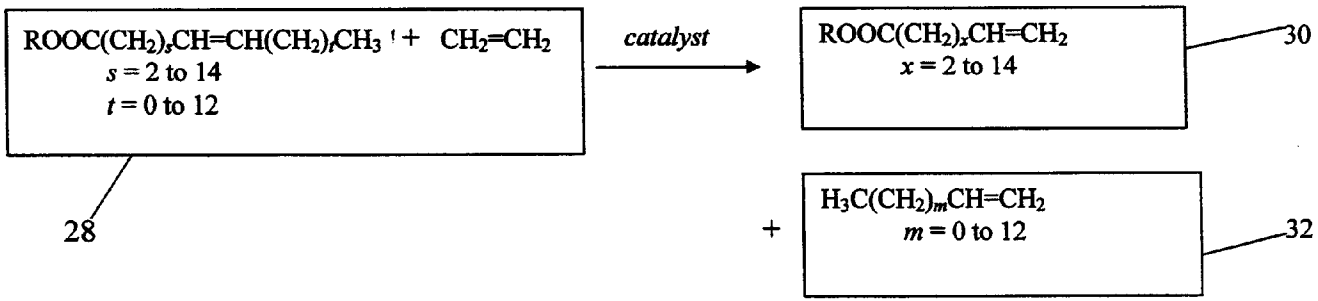
FIG. 2 illustrates an exemplary cross-metathesis reaction scheme.

An exemplary cross-metathesis reaction scheme is illustrated in FIG. 2. As shown in FIG. 2, a triglyceride having a monounsaturated fatty acid group is cross-metathesized with a short chain olefin (ethylene shown in figure), in the presence of a metathesis catalyst to form a metathesis product composition. As discussed elsewhere herein, acceptable short chain olefins include, for example, ethylene, propylene, 1-butene, 2-butene, isobutene, 1-pentene, 2-pentene, isopentene, 2-hexene, 3-hexene, and the like.

As shown in FIG. 2, the reaction composition (28) includes triglyceride having a monounsaturated fatty acid group and ethylene. The resulting metathesis product composition includes, as major components, monounsaturated fatty acid esters in triglyceride form having terminal double bonds (30), as well as olefins with terminal double bonds (32). Unreacted starting material can also be present, as well as products from some amount of self-metathesis (not shown in figure). The starting material and each of the products shown, 30 and 32, can be present as the cis or trans isomer (except when ethylene is used in which case the product is a terminal olefin). As illustrated, the metathesis products, 30 and 32 will have overlapping chain lengths. In particular, the chain lengths of the terminal monounsaturated fatty acid esters can be in the range from about 5 to about 17 carbons. In some aspects, the majority (e.g., 50% or more) of the terminal monounsaturated fatty acids can have chain lengths in the range of from about 9 to about 13 carbon atoms.

The metathesis process can be conducted under any conditions adequate to produce the desired metathesis products. For example, stoichiometry, atmosphere, solvent, temperature and pressure can be selected to produce a desired product and to minimize undesirable byproducts. The metathesis process may be conducted under an inert atmosphere. Similarly, if the olefin reagent is supplied as a gas, an inert gaseous diluent can be used. The inert atmosphere or inert gaseous diluent typically is an inert gas, meaning that the gas does not interact with the metathesis catalyst to substantially impede catalysis. For example, particular inert gases are selected from the group consisting of helium, neon, argon, nitrogen and combinations thereof.

Similarly, if a solvent is used, the solvent chosen may be selected to be substantially inert with respect to the metathesis catalyst. For example, substantially inert solvents include, without limitation, aromatic hydrocarbons, such as benzene, toluene, xylenes, etc.; halogenated aromatic hydrocarbons, such as chlorobenzene and dichlorobenzene; aliphatic solvents, including pentane, hexane, heptane, cyclohexane, etc.; and chlorinated alkanes, such as dichloromethane, chloroform, dichloroethane, etc.

In certain embodiments, a ligand may be added to the metathesis reaction mixture. In many embodiments using a ligand, the ligand is selected to be a molecule that stabilizes the catalyst, and may thus provide an increased turnover number for the catalyst. In some cases the ligand can alter reaction selectivity and product distribution. Examples of ligands that can be used include Lewis base ligands, such as, without limitation, trialkylphosphines, for example tricyclohexylphosphine and tributyl phosphine; triarylphosphines, such as triphenylphosphine; diarylalkylphosphines, such as, diphenylcyclohexylphosphine; pyridines, such as 2,6-dimethylpyridine, 2,4,6-trimethylpyridine; as well as other Lewis basic ligands, such as phosphine oxides and phosphinites. Additives may also be present during metathesis that increase catalyst lifetime.

Any useful amount of the selected metathesis catalyst can be used in the process. For example, the molar ratio of the unsaturated polyol ester to catalyst may range from about 5:1 to about 10,000,000:1, or from about 50:1 to 500,000:1.

The metathesis reaction temperature may be a rate-controlling variable where the temperature is selected to provide a desired product at an acceptable rate. The metathesis temperature may be greater than −40° C., may be greater than about −20° C., and is typically greater than about 0° C. or greater than about 20° C. Typically, the metathesis reaction temperature is less than about 150° C., typically less than about 120° C. An exemplary temperature range for the metathesis reaction may range from about 20° C. to about 120° C.

The metathesis reaction can be run under any desired pressure. Typically, it will be desirable to maintain a total pressure that is high enough to keep the cross-metathesis reagent in solution. Therefore, as the molecular weight of the cross-metathesis reagent increases, the lower pressure range typically decreases since the boiling point of the cross-metathesis reagent increases. The total pressure may be selected to be greater than about 10 kPa, in some embodiments greater than about 30 kPa, or greater than about 100 kPa. Typically, the reaction pressure is no more than about 7000 kPa, in some embodiments no more than about 3000 kPa. An exemplary pressure range for the metathesis reaction is from about 100 kPa to about 3000 kPa. In some embodiments, it may be desirable to conduct self-metathesis under vacuum conditions, for example, at low as about 0.1 kPa.

In some embodiments, the metathesis reaction is catalyzed by a system containing both a transition and a non-transition metal component. The most active and largest number of catalyst systems may be derived from Group VI A transition metals, for example, tungsten and molybdenum.

Metathesized Natural Oil Derivatives

The metathesized natural oil derivative may comprise the reaction product of a metathesized natural oil with a nucleophile (e.g., a nucleophilic nitrogen reagent or a nucleophilic oxygen reagent), an enophilic acid reagent, an oxidizing agent, or an aromatic compound. In each case the resulting product may provide enhanced cold flow properties to the metathesized natural oil which can improve the normally liquid fuels to which they are added. In some embodiments, the metathesized natural oil derivative may be hydrogenated before or after its production.

Reaction with a Nucleophilic Nitrogen Reagent

The metathesized natural oil derivative may comprise the reaction product of the metathesized natural oil with one or more a nucleophilic nitrogen reagents. This derivative may be referred to as an amidated metathesized natural oil, an amidated wax, or a metathesized natural oil/amine derivative. The nucleophilic nitrogen reagent may comprise ammonia or a compound containing one or more primary and/or secondary amino groups. These may be referred to as amines. The amine may be a monoamine. The amine may be a mono-substituted amine having one non-hydrogen substituted group (such as an alkyl, aryl group, alkyl-amino group, or aryl-amino group), a di-substituted amine having two non-hydrogen substituted groups, an amino-alcohol, or a combination of two or more thereof.

The amine may be a mono-substituted or di-substituted amine. These may include methylamine, dimethylamine, ethylamine, diethylamine, propylamine, dipropylamine, butylamine, dibutylamine, pentylamine, dipentylamine, hexylamine, dihexylamine, heptylamine, diheptylamine, octylamine, dioctylamine, or a mixture thereof. In other non-limiting embodiments, the amine is an amino-alcohol such as: methanolamine, dimethanolamine, ethanolamine, diethanolamine, propanolamine, dipropanolamine, butanolamine, dibutanolamine, pentanolamine, dipentanolamine, hexanolamine, dihexanolamine, heptanolamine, diheptanolamine, octanolamine, dioctanolamine, aniline, or a mixture of two or more thereof.

The amine may be a diamine. Examples may include ethylenediamine (1,2-ethanediamine), 1,3-propanediamine, 1,4-butanediamine (putrescine), 1,5-pentanediamine, 1,6-hexanediamine, 1,7-heptanediamine, 1,8-octanediamine, 1,3-bis(aminomethyl)cyclohexane, meta-xylenediamine, 1,8-naphthalenediamine, p-phenylenediamine, N-(2-aminoethyl)-1,3-propanediamine, or a mixture of two or more thereof.

The amine may be a triamine, a tetramine, or a mixture thereof. Examples of these may include diethylenetriamine, dipropylenetriamine, dibutylenetriamine, dipentylenetriamine, dihexylenetriamine, diheptylenetriamine, dioctylenetriamine, spermidine, melamine, triethylenetetramine, tripropylenetetramine, tributylenetetramine, tripentylenetetramine, trihexylenetetramine, triheptylenetetramine, trioctylenetetramine, hexamine, or a mixture of two or more thereof. The amine may be an imidazole or oxazolidine.

The amine may comprise ethanolamine, diethanolamine, diethylamine, ethylenediamine, hexamethyleneamine, or a mixture of two or more thereof. The amine may be ethylenediamine. The amine may be diethanolamine.

The amine may comprise an amino-alcohol. Examples may include methanolamine, dimethanolamine, ethanolamine, diethanolamine, propanolamine, dipropanolamine, butanolamine, dibutanolamine, pentanolamine, dipentanolamine, hexanolamine, dihexanolamine, heptanolamine, diheptanolamine, octanolamine, dioctanolamine, aniline, or a mixture of two or more thereof.

The weight ratio of the metathesized natural oil to amine may be from about 30 to about 0.1, or from about 15 to about 1.

The reaction between the metathesized natural oil and the amine may be carried out in the presence of a catalyst. The catalyst, which may be a basic catalyst, may be used to improve the reaction rate of the metathesized natural oil with the one or more amines. The catalyst may comprise one or more of sodium carbonate, lithium carbonate, sodium methanolate, potassium hydroxide, sodium hydride, potassium butoxide, potassium carbonate, or a mixture thereof. The catalyst may be added to the reaction mixture in dry form or in the form of a solution.

The reaction of the metathesized natural oil with the amine may be enhanced by heating the reaction mixture (with or without a catalyst) to at least about 80° C., or at least 100° C., or at least about 120° C., or at least about 140° C., or at least about 160° C., or between about 80° C. and about 250° C., or between 100° C. and about 200° C., or between about 120° C. and about 180° C., or between about 120° C. and about 160° C.

The amount of catalyst added to the reaction may be in the range from about 0.01 percent by weight to about 10 percent by weight of the metathesized natural oil in the reaction mixture, or from about 0.01 percent by weight to about 5 percent by weight, or from about 0.01 percent by weight to about 1 percent by weight, or from about 0.2 percent by weight and about 0.7 percent by weight of the metathesized natural oil.

The reaction may be conducted in an inert atmosphere, for example, a nitrogen atmosphere. The time of reaction may range from about 1 to about 24 hours, or from about 1 to about 12 hours, or from about 1 to about 6 hours, or from about 1 to about 4 hours.

Following the reaction, the product mixture may be vacuum pumped for at least about 30 minutes, or at least about 1 hour, to separate water, unreacted amine, and/or glycerol from the metathesized natural oil/amine product. Paraffin may be separated from the metathesized natural oil/amine product.

In an embodiment, the metathesized natural oil may be reacted with an amine in the presence of catalyst and/or heat, and ester functionality may be replaced by an amine to form an amidated metathesized natural oil comprising molecules having the following structures:

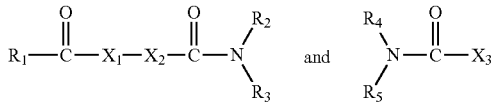

wherein $R_1$ may be one or more of:

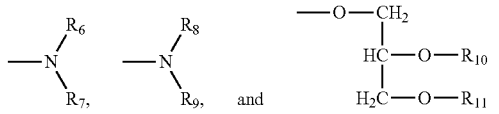

wherein $R_2$, $R_3$, $R_4$, $R_5$, $R_6$, $R_7$, $R_8$, and $R_9$ may be, independently, hydrogen, alcohol, alkyls, aryl, alkyl-amine, or and aryl-amine, and $R_{10}$ and $R_{11}$ may be, independently, hydrogen,

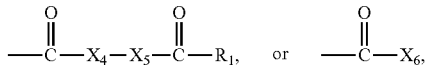

and wherein $X_1$, $X_2$, $X_3$, $X_4$, $X_5$, and $X_6$ are independently $C_8$-$C_{28}$ saturated or unsaturated alkyl chains from either a fatty acid of a natural oil, or a derivative thereof formed by a metathesis reaction.

In an embodiment, $R_2$, $R_3$, $R_4$, $R_5$, $R_6$, $R_7$, $R_8$, and $R_9$ may form at least one amine. Examples may include methylamine, dimethylamine, ethylamine, diethylamine, propylamine, dipropylamine, butylamine, dibutylamine, pentylamine, dipentylamine, hexylamine, dihexylamine, heptylamine, diheptylamine, octylamine, dioctylamine, methanolamine, dimethanolamine, ethanolamine, diethanolamine, propanolamine, dipropanolamine, butanolamine, dibutanolamine, pentanolamine, dipentanolamine, hexanolamine, dihexanolamine, heptanolamine, diheptanolamine, octanolamine, dioctanolamine, aniline, ethylenediamine (1,2-ethanediamine), 1,3-propanediamine, 1,4-butanediamine (putrescine), 1,5-pentanediamine, 1,6-hexanediamine, 1,7-heptanediamine, 1,8-octanediamine, 1,3-bis(aminomethyl)cyclohexane, meta-xylenediamine, 1,8-naphthalenediamine, p-phenylenediamine, N-(2-aminoethyl)-1,3-propanediamine, diethylenetriamine, dipropylenetriamine, dibutylenetriamine, dipentylenetriamine, dihexylenetriamine, diheptylenetriamine, dioctylenetriamine, spermidine, melamine, triethylenetetramine, tripropylenetetramine, tributylenetetramine, tripentylenetetramine, trihexylenetetramine, triheptylenetetramine, trioctylenetetramine, hexamine, imidazole, oxazolidine, or mixtures of two or more thereof.

In an embodiment, the metathesized natural oil/amine product may comprise a "diacid functionality" [e.g., —(C═O)—$X_1$—$X_2$—(C═O)—]. In an embodiment, the metathesized natural oil/amine product may contain the diacid functionality and a glycerol backbone of the metathesized natural oil.

In an embodiment, in addition to the metathesized natural oil/amine product, the reaction between the metathesized natural oil and amine may comprise a hydroxy-metathesis oligomer co-product having the following structure:

$$H—R_{12}$$

wherein $R_{12}$ is:

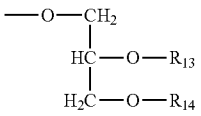

wherein $R_{13}$ and $R_{14}$ are independently hydrogen,

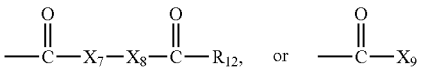

wherein $X_7$, $X_8$, and $X_9$ are independently $C_8$-$C_{28}$ saturated or unsaturated alkyl chains from either a fatty acid of a natural oil, or a derivative thereof formed by a metathesis reaction.

In an embodiment, the reaction of ethylenediamine and a natural oil metathesis dimer may form a variety of products based on the location of the amidation reaction(s). In the case of the metathesis dimer below, the amidation reaction(s) may occur at one or more of the six labeled ester locations (shown below).

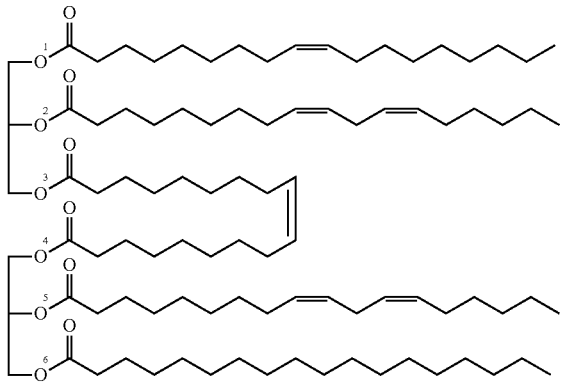

Should the amidation reaction between the metathesis dimer and ethylenediamine occur at ester location 1, the amide product formed from the reaction may include:

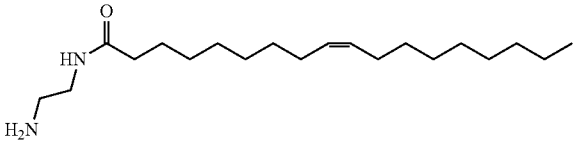

and a hydroxy-metathesis oligomer co-product:

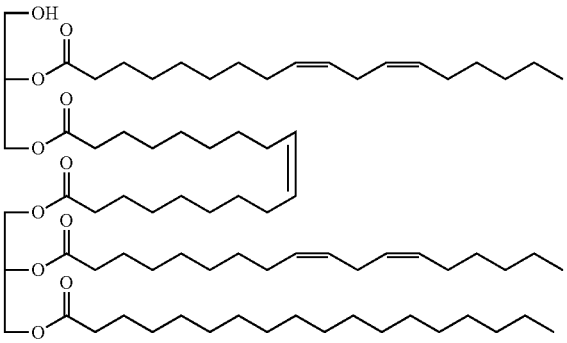

Amidation reactions at ester locations 2, 5, and 6 may produce similar amide products and hydroxy-metathesis oligomer co-products.

Should the amidation reaction between the metathesis dimer and ethylenediamine occur at ester location 3, the amide product formed from the reaction may include:

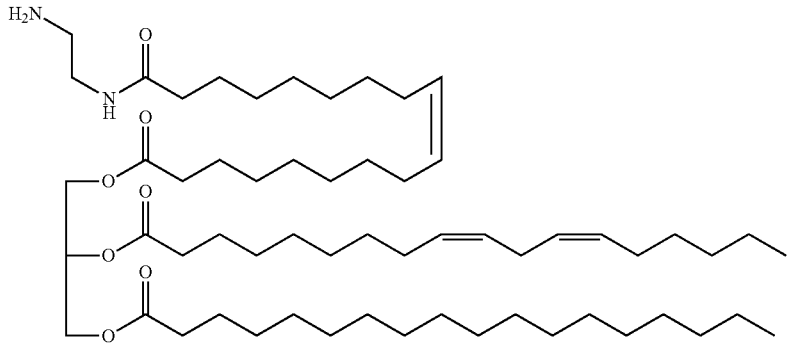

and a hydroxy-metathesis oligomer co-product:

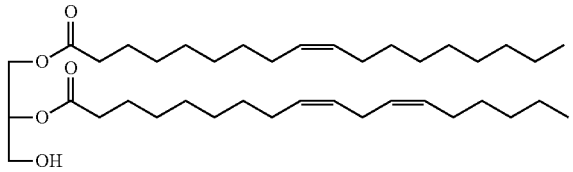

An amidation reaction at ester location 4 may produce a similar product and a hydroxy-metathesis oligomer co-product.

The amidation reaction may occur at multiple ester locations of the metathesized natural oil. For example, should the amidation reaction occur at ester locations 3 and 4 of the metathesis dimer (shown above) with ethylenediamine, the amide product formed from the reaction may include:

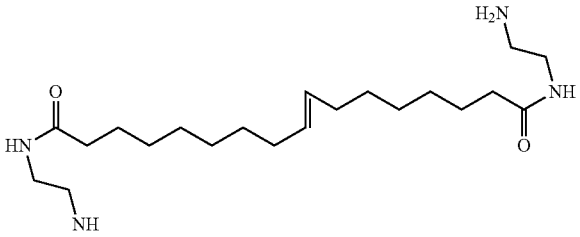

Should the amidation reaction occur at ester locations 3 and 6, the amide products formed from the reaction may include:

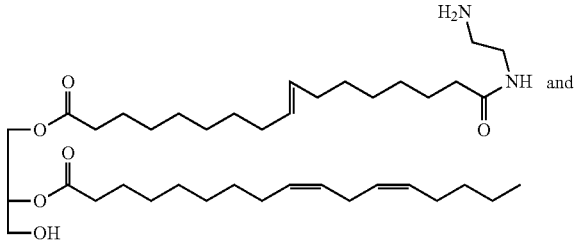

and

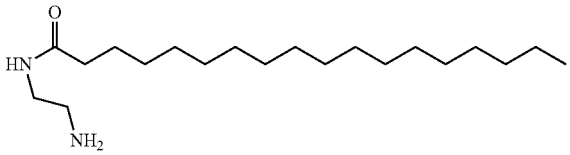

In some embodiments, the amine may replace more than one ester functionality of the metathesized natural oil. In such embodiments, di- or tri-substitution of the amino group may require more severe reaction conditions than the first substitution reaction. The reaction of an amine (in this non-limiting example, ethylenediamine) and a natural oil metathesis dimer (shown above) may form an amide with multiple ester-functionality substitutions, such as the following examples:

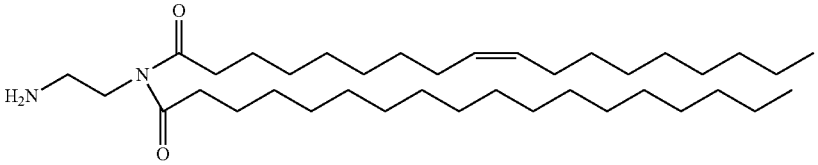

-continued

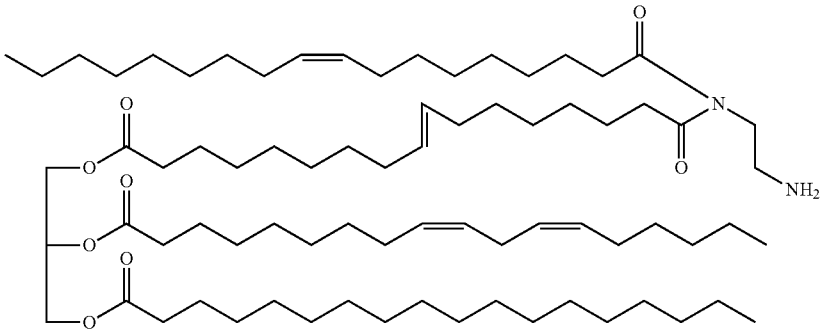

When the metathesized natural oil is reacted with an amine having more than one amino group (i.e., "multi-amine") in the presence of a catalyst, a cross-linked amidated metathesized natural oil may be produced where more than one amino group reacts with an ester functionality to form the cross-linked amidated metathesized natural oil. The reaction mechanism may be shown below in (I), using ethylenediamine as a non-limiting example:

$$2R^1(C{=}O)OR^2+NH_2CH_2CH_2NH_2 \rightarrow R^1(C{=}O)NHCH_2CH_2NH(C{=}O)R^1+2R^2OH \quad (I)$$

wherein $R^1$ may be a fatty acid ester or metathesized fatty acid ester of the natural oil and $R^2$ may include the glycerol backbone of the natural oil, $CH_2CH(OR)CH_2(OR')$, where R and R' may be fatty acid esters or metathesized fatty acid esters of the natural oil.

For example, the reaction of a multi-amine (in this case, ethylenediamine) and a natural oil metathesis dimer (shown below) may form a variety of cross-linked products based on the location of the amidation reaction(s). For example, the reaction may occur with ester group 1 and ester group 6 (of the same or different compound), the cross-linked product may include:

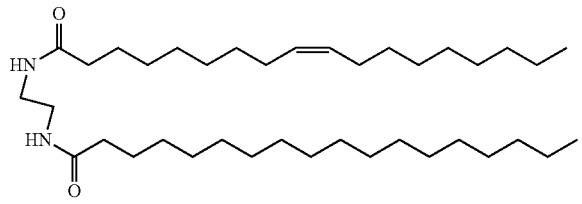

Should the multi-amine react with ester group 1 and ester group 3 (of the same or different compound), the cross-linked product may include:

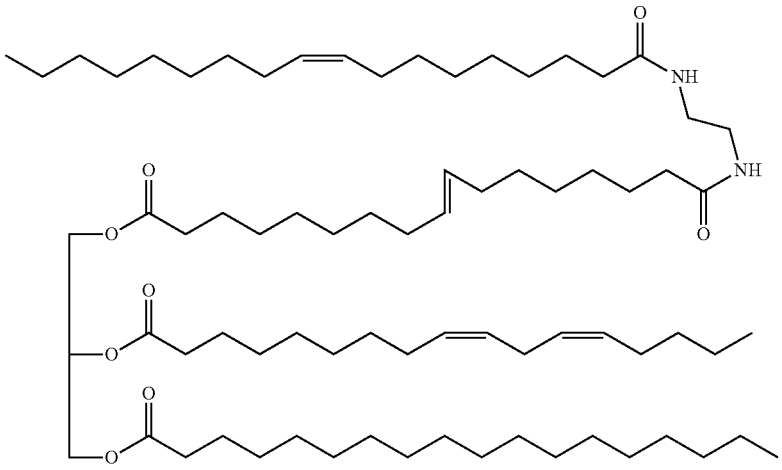

In one embodiment, hydrogenated metathesized soybean oil (HMSBO) may be reacted with diethanolamine in the presence of a catalyst to produce a metathesized natural oil/amine product comprising fatty acid amides, mixed amide-esters, fatty acid salts, triglycerides, diglycerides, monoglycerides, natural oil oligomers, paraffins, and/or free glycerol.

In one embodiment, hydrogenated metathesized soybean oil (HMSBO) may be reacted with ethylenediamine in the presence of a catalyst to produce an amidated metathesized natural oil composition comprising fatty acid amides, mixed amide-esters, fatty acid salts, triglycerides, diglycerides, monoglycerides, natural oil oligomers, paraffins, and/or free glycerol.

When the metathesized natural oil comprises paraffinic compounds, such as those found in various hydrogenated metathesized natural oils, the paraffinic compounds may not react with the amine and may thus exit the reaction unaltered. Depending on the potential use of the metathesized natural oil/amine product formed in the reaction, the paraffinic compounds may be partially or fully separated from the product mixture.

In addition, the catalyst may react with the triglycerides and oligomers thereof to hydrolyze the ester groups and form the corresponding fatty acid salts. The reaction mechanisms may be as shown below in (II):

$$R^1(C{=}O)OR^2+CH_3ONa+H_2O\rightarrow R^1(C{=}O)ONa+R^2OH+CH_3OH\uparrow 2R^1(C{=}O)OR^2+Na_2CO_3+H_2O\rightarrow 2R^1(C{=}O)ONa+2R^2OH+CO_2\uparrow R^1(C{=}O)OR^2+KOH\rightarrow +R^1(C{=}O)OK+R^2OH \quad (II)$$

wherein $R^1$ and $R^2$ are defined above in equation (I).

The product composition from the metathesized natural oil/amine reaction product may comprise fatty acid amides (including polyamides), mixed amide-esters, fatty acid salts, triglycerides, diglycerides, monoglycerides, natural oil oligomers, olefins, paraffins, and/or free glycerol.

The product composition from the metathesized natural oil/amine reaction may be subjected to partial or full hydrogenation (in the instance where the metathesized natural oil is partially to fully hydrogenated prior to the metathesized natural oil/amine reaction).

The metathesized natural oil/amine reaction product composition may comprise: from about 4 to about 99 percent by weight fatty acid amides (including monoamides and polyamides) and mixed amide-esters; from about 1 to about 2 percent by weight fatty acid salts; from 0 to about 95 percent by weight triglycerides, diglycerides, monoglyceride and natural oil oligomers; from 0 to about 15 percent by weight paraffins; and from 0 to about 9 percent by weight free glycerol.

The metathesized natural oil/amine reaction product composition may comprise from about 4 to about 40 mol % fatty acid amides (including monoamides and polyamides) and mixed amide-esters; from about 0.1 to about 2 mol % fatty acid salts; from 0 to about 88 mol % triglycerides, diglycerides, monoglycerides, natural oil oligomers; from about 7 to about 12 mol % paraffins; and from 0 to about 4 mol % free glycerol.

The amine-metathesized natural oil/amine reaction product composition may comprise from about 10 to about 20 mol % fatty acid amides (including monoamides and polyamides) and mixed amide-esters; from about 0.1 to about 2 mol % fatty acid salts; from about 60 to about 85 mol % triglycerides, diglycerides, monoglycerides, natural oil oligomers; from about 3 to about mol % paraffins; and from about 1 to about 6 mol % free glycerol. The product composition may be described with greater delineation of the chemical species resulting from a reaction with ethylenediamine as comprising from about 10 to about 15 mol % fatty acid diamides; from about 2 to about 4 mol % diamides of metathesis oligomers; from about 0.5 to about 2 mol % diamides of hydroxy-metathesis oligomers; and from about 40 to about 60 mol % metathesis oligomers; and from about 15 to about 25 mol % hydroxy-metathesis oligomers.

The metathesized natural oil/amine reaction product composition comprises about 16 mol % fatty acid amides (including monoamides and polyamides) and mixed amide-esters; from about 0.1 to about 2 mol % fatty acid salts; about 74 mol % triglycerides, diglycerides, monoglycerides, natural oil oligomers; about 8 mol % paraffins; and about 3 mol % free glycerol. The composition may be described with greater delineation of the chemical species resulting from a reaction with ethylenediamine as comprising about 12 mol % fatty acid diamides; about 3 mol % diamides of metathesis oligomers; about 1 mol % diamides of hydroxy metathesis oligomers; about 52 mol % metathesis oligomers; and about 22 mol % hydroxy metathesis oligomers.

Reaction with a Nucleophilic Oxygen Reagent

The metathesized natural oil derivative may comprise the reaction product of the metathesized natural oil with one or more a nucleophilic oxygen reagents. This derivative may be referred to as a metathesized natural oil/oxygen derivative. The nucleophilic oxygen reagent may comprise one or more of the peroxides (discussed below) as well as one or more alcohols. The alcohols may be monoalcohols or polyols. The monoalcohols may contain from 1 to about 10 carbon atoms, or from 1 to about 4 carbon atoms, and may include methanol, ethanol, propanol, butanol, mixtures of two or more thereof, and the like.

The polyols may contain from 2 to about 10 carbon atoms, and from 2 to about 6 hydroxyl groups. Examples may include ethylene glycol, glycerol, trimethylolpropane, 1,2-propanediol, 1,3-propanediol, 1,2-butanediol, 1,3-butanediol, 2,3-butanediol, 2-ethyl-1,3-propanediol, 2-ethyl-2-butyl-1,3-propanediol, neopentyl glycol, 2,2,4-trimethyl-1,3-pentanediol, pentaerythritol, sorbitol, mixtures of two or more thereof, and the like.

The weight ratio of the metathesized natural oil to the nucleophilic oxygen reagent may be from about 30 to about 1, or from about 15 to about 1.

The reaction between the metathesized natural oil and the oxygen reagent may be carried out in the presence of a catalyst. The catalyst may be a Lewis acid, a Bronsted acid and/or a sulfonic acid.

The reaction of the metathesized natural oil with the oxygen reagent may be enhanced by heating the reaction mixture (with or without a catalyst) to a temperature in the range from about 100° C. to about 250° C., or from about 150° C. to about 200° C.

The amount of catalyst added to the reaction may be from about 0.01 percent by weight to about 5 percent by weight of the metathesized natural oil in the reaction mixture, or from about 0.5 percent by weight to about 2 percent by weight of the metathesized natural oil.

The reaction may be conducted in an inert atmosphere, for example, a nitrogen atmosphere. The time of reaction may range from about 3 to about 24 hours, or from about 8 to about 12 hours.

Following the reaction, the product mixture may be subjected to a vacuum for at least about 30 minutes, or at least about 1 hour, to separate water, unreacted oxygen reagent, and/or glycerol from the metathesized natural oil/oxygen reagent product. Paraffin may be separated from the metathesized natural oil/oxygen reagent product.

Reaction with an Enophilic Acid Reagent

The metathesized natural oil derivative may comprise the reaction product of a metathesized natural oil with one or more enophilic acid reagents. This derivative may be referred to as a metathesized natural oil/enophilic acid derivative.

The enophilic acid reagent may comprise one or more alpha-beta olefinically unsaturated carboxylic acids and/or derivatives thereof. The derivative may comprise one or more anhydrides, esters, amides, aldehydes, and/or acyl halides. The carboxylic acid or derivative may comprise one or more monobasic and/or polybasic alpha-beta olefincally unsaturated carboxylic acids or derivatives thereof. The monobasic carboxylic acids may comprise one or more compounds represented by the formula

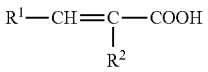

wherein $R^1$ and $R^2$ are independently hydrogen or hydrocarbyl groups. $R^1$ and $R^2$ independently may be hydrocarbyl groups containing 1 to about 20 carbon atoms, or from 1 to about 12 carbon atoms, or from 1 to about 4 carbon atoms.

The polybasic carboxylic acid reagents may comprise one or more alpha, beta olefinically unsaturated dicarboxylic acids or derivatives thereof. These may include those wherein a carbon-carbon double bond is in an alpha, beta-position to at least one of the carboxy functions (e.g., itaconic acid, or derivative thereof) or in an alpha, beta-position to both of the carboxy functions (e.g., maleic acid, anhydride or derivative thereof). The carboxy functions of these compounds may be separated by up to about 4 carbon atoms, or about 2 carbon atoms.

Examples of the enophilic acid reagents may include one or more of: acrylic acid; methacrylic acid; cinnamic acid; crotonic acid; 3-phenyl propenoic acid; alpha,beta-decanoic acid; maleic acid; fumaric acid; mesconic acid; itaconic acid; citraconic acid; maleic anhydride; or a mixture of two or more thereof.

The weight ratio of the metathesized natural oil to the enophilic acid reagent may be from about 15 to about 1, or from about 8 to about 2.

The reaction between the metathesized natural oil and the enophilic acid reagent may be carried out in the presence of a catalyst. The catalyst may comprise a dialkylperoxide, or a Lewis acid such as $AlCl_3$.

The reaction of the metathesized natural oil with the enophilic acid reagent may be enhanced by heating the reaction mixture (with or without a catalyst) to a temperature in the range from about 100° C. to about 300° C., or from about 150° C. to about 250° C.

The amount of catalyst added to the reaction may be from about 2 percent by weight to about 10 percent by weight of the metathesized natural oil in the reaction mixture, or from about 1 percent by weight to about 5 percent by weight of the metathesized natural oil.

The reaction may be conducted in, an inert atmosphere, for example, a nitrogen atmosphere. The time of reaction may range from about 1 to about 24 hours, or from about 6 to about 12 hours.

Following the reaction, the product mixture may be subjected to a vacuum for at least about 30 minutes, or at least about 1 hour, to separate water, unreacted enophilic acid reagent, and other volatile materials from the metathesized natural oil/oxygen reagent product. Paraffin may be separated from the metathesized natural oil/enophilic acid reagent product.

Reaction with an Oxidizing Agent

The metathesized natural oil derivative may comprise the reaction product of the metathesized natural oil with one or more oxidizing agents. This derivative may be referred to as an oxidized metathesized natural oil derivative. This derivative may be an epoxide.

The oxidizing agent, which may be referred to as an oxidant, oxidizer or an oxygen nucleophile, may be any compound that transfers oxygen atoms to the metathesized natural oil to form the desired metathesized natural oil derivative. The oxidizing agent may comprise any compound containing an oxygen-oxygen single bond, or a peroxide group or peroxide ion. Examples include hydrogen peroxide, organic peroxides such as peroxy acids (e.g., peroxy carboxylic acid) and organic hydroperoxides (e.g., cumene hydroperoxide), and inorganic peroxides such as peroxide salts (e.g., alkali metal or alkaline earth metal peroxides) and acid peroxides (e.g., peroxymonosulfuric acid, peroxydisulfuric acid, and the like).

The weight ratio of the metathesized natural oil to the oxidizing agent may be from about 6 to about 1, or from about 5 to about 2.

The reaction between the metathesized natural oil and the oxidizing agent may be carried out in the presence of a catalyst. The catalyst may comprise Amberlyst (polymer based catalyst available from Rohm & Haas), Amberlite (ion exchange resin available from Rohm & Haas) and/or sulfuric acid.

The reaction of the metathesized natural oil with the oxidizing agent may be enhanced by heating the reaction mixture (with or without a catalyst) to a temperature in the range from about 30° C. to about 180° C., or from about 50° C. to about 70° C.

The amount of catalyst added to the reaction may be from about 5 percent by weight to about 25 percent by weight of the metathesized natural oil in the reaction mixture, or from about 5 percent by weight to about 20 percent by weight of the metathesized natural oil.

The reaction may be conducted in an inert atmosphere, for example, a nitrogen atmosphere. The time of reaction may range from about 6 to about 24 hours, or from about 8 to about 12 hours.

Following the reaction, the product mixture may be subjected to a vacuum for at least about 30 minutes, or at least about 1 hour, to separate water, unreacted oxidizing agent, and/or glycerol from the metathesized natural oil/oxygen reagent product. Paraffin may be separated from the product mixture.

Reaction with an Aromatic Compound

The metathesized natural oil derivative may comprise a metathesized natural oil reacted with one or more aromatic compounds. This may be referred to as an alkylation reaction wherein the metathesized natural oil is attached to the aromatic compound via one or more of the carbon-carbon double bonds in the metathesized natural oil. The product may be referred to as an alkylated aromatic compound.

The aromatic compound may comprise any aromatic compound capable of reacting with a metathesized natural oil to form an alkylation product. The aromatic compound may comprise an aromatic, aliphatic-substituted aromatic, or aromatic-substituted aliphatic compound. The aromatic compound may comprise a substituted aromatic compound, that is, an aromatic compound containing one or more non-hydrocarbon groups such as hydroxyl, halo, nitro, amino, cyano, alkoxy, acyl, epoxy, acryloxy, mercapto, mixtures of two or more thereof, and the like. The aromatic compound may comprise a hetero substituted aromatic compound, that is, an aromatic compound containing one or more atoms other than carbon in a chain or ring otherwise comprising carbon atoms; examples of such hetero atoms including nitrogen, oxygen and sulfur.

The aromatic compound may comprise one or more of benzene, naphthalene, naphthacene, alkylated derivatives thereof, and the like. The aromatic compound may contain from 6 to about 40 carbon atoms, or from 6 to about 30 carbon atoms, or from 6 to about 20 carbon atoms, or from 6 to about 15 carbon atoms, or from 6 to about 12 carbon atoms. Examples may include benzene, toluene, ethylbenzene, styrene, alpha-methyl styrene, propylbenzene, xylene, mesitylene, methylethylbenzene, naphthalene, anthracene, phenanthrene, methynaphthalene, dimethylnaphthalene, tetralin, mixtures of two or more thereof, and the like. The aromatic compound may comprise phenol and/or its derivatives, dihydroxybenzene, naphthol and/or dihydroxynaphthalene. The aromatic compound may comprise an aromatic amine and/or a pyridine. The aromatic compound may comprise aniline, diphenylamine, toluidine, phenylenediamine, toluene diamine, diphenylamine, alkyldiphenylamine, and/or phenothiazine. The aromatic compound may comprise an alkylbenzene with a multi-substituted benzene ring, examples including o-, m- and p-xylene, toluene, tolyl aldehyde, aminotoluene, o-, m- and p-cresol, phenyl aldehyde, mixtures of two or more thereof, and the like.

The weight ratio of the metathesized natural oil to the aromatic compound may be from about 4 to about 1, or from about 2 to about 1.

The reaction between the metathesized natural oil and the aromatic compound may be carried out in the presence of a catalyst. The catalyst may comprise a Lewis acid, Bronsted acid, sulfurized clay and/or zeolite.

The reaction of the metathesized natural oil with the aromatic compound may be enhanced by heating the reaction mixture (with or without a catalyst) to a temperature in the range from about 50° C. to about 300° C., or from about 100° C. to about 200° C.

The amount of catalyst added to the reaction may be from about 1 percent by weight to about 50 percent by weight of the metathesized natural oil in the reaction mixture, or from about 2 percent by weight to about 20 percent by weight of the metathesized natural oil.

The reaction may be conducted in an inert atmosphere, for example, a nitrogen atmosphere. The time of reaction may range from about 2 to about 24 hours, or from about 6 to about 12 hours.

Following the reaction, the product mixture may be subjected to a vacuum for at least about 30 minutes, or at least about 1 hour, to separate reaction water, unreacted volatile materials and/or glycerol resulting from the alkylation reaction involving metathesized natural oil and the aromatic compound. Paraffin may be separated from the metathesized natural oil/aromatic compound product.

EXAMPLES

In the examples provided below, samples of MSBO (metathesized soybean oil), stripped and unstripped, and derivatives of HMSBO (hydrogenated metathesized soybean oil) are tested. The preparation of MSBO is shown in Example 1. The preparation of the HMSBO derivatives are shown in Examples 2-5. The preparation of an epoxidized MSBO is shown in Example 6.

The derivatives shown in Examples 2-5 are derived from HMSBO, which is a hydrogenated soybean-derived polyglyceride [CAS #912810-05-0] via a direct fat splitting process (hydrolysis). The HMSBO is obtained by the catalytic metathesis of glycine soja (soybean) oil with subsequent hydrogenation. HMSBO contains a mixture of paraffins, triglycerides and oligomers thereof. The free fatty acid profile of HMSBO, which may be referred to as a metathesized and hydrogenated wax (raw material), provides the final product, after splitting, with unique physical properties.

Direct hydrolysis of the HMSBO provides a mixture of free fatty acids and free glycerol. The fatty acid profile in the product mixture matches the acid profile of the HMSBO. Additionally, the product mixture typically contains metathesis byproducts, such as paraffin, e.g. octadecane.

As a result of the HMSBO material used, the fatsplit product (HMSBO fatty acid mixture) contains paraffin, as well as mono- and di-carboxylic acids. Paraffin acts as a plasticizer and significantly lowers the dropping point and hardness of the product, which is typically in the form of a wax. To improve the properties and increase the commercial value of the product, paraffin may be removed by vacuum distillation at elevated temperatures. Dropping point and hardness of the HMSBO fatty acid wax may increase with the degree of distillation. As such, more low boiling compounds may be removed with higher temperatures.

The reaction product produced by direct fat splitting under pressure of HMSBO comprises a free fatty acid and paraffin mixture. This reaction product can be refined by vacuum stripping to remove most of the paraffin and parts of the free fatty acids up to $C_{18}$ chain lengths.

HMSBO comprises a mixture of compounds of at least two general types:

a) paraffinic compounds; and b) triglycerides of long-chain mono-carboxylic acids, and oligomers of triglycerides which contain long-chain monocarboxylic and dicarboxylic acids.

The paraffinic compounds are inert and do not react under fatsplitting conditions and exit the reaction unaltered. Depending on the final product application, the paraffinic compounds may be partly or fully removed from the final product.

Triglycerides and oligomers thereof react with water or $OH^-/H^+$ to give mainly free fatty acids, which corresponds to the HMSBO fatty acid profile (mono- and di-acids). The fat splitting reaction may also generate free glycerol. Any remaining partially hydrolyzed HMSBO may comprise monoglycerides, diglycerides, triglycerides, and oligomers thereof.

The free glycerol generated by the fatsplitting reaction may be separated with an aqueous phase.

$$R(C{=}O)_3OR+3H_2O \rightarrow R(C{=}O)OH+R(OH)_3$$

A typical reaction mixture to produce acid wax from HMSBO may be a 4:1 to 1:1 mixture by weight of HMSBO and water which may be reacted at about 230° C. for about 2.5 hours at high pressure.

Typical product compositions, which are listed below, may be calculated by using GC-MS data corresponding to five similar products. The five similar products may be generated by direct fatsplitting using a small Parr reactor. The product compositions are as follows:

(A) Crude Acid Wax (Before Stripping):

19-26% Linear dibasic acids with terminal carboxylic groups, e.g. $HOOC—(CH_2)_{16}—COOH$, composed of $C_{18}$, $C_{21}$ and $C_{24}$ and higher molecular weight dibasic acids.

56-66% Linear monoacids with chain lengths exhibited within the fatty acid profile of soybean oil, e.g. mainly $C_{16}$ and $C_{18}$ for soybean oil, and shorter chain monobasic acids.

0-9% Triglycerides, diglycerides, monoglycerides and oligomers.

7-9% Paraffins.

0-1% Free glycerol.

(B) Refined Acid Wax (after Stripping):

28-39% Linear dibasic acids with terminal carboxylic groups, e.g. HOOC—$(CH_2)_{16}$—COOH, composed of $C_{18}$, $C_{21}$ and $C_{24}$ and higher molecular weight dibasic acids.

52-66% Linear monoacids with chain lengths exhibited within the fatty acid profile of soybean oil, e.g. mainly $C_{16}$ and $C_{18}$ for soybean oil, and shorter chain monobasic acids.

0-10% Triglycerides, diglycerides, monoglycerides and oligomers.

0-2% Paraffins.

(C) Stripped Fraction (Byproduct/Waste Stream):

1-9% Linear dibasic acids with terminal carboxylic groups, e.g. HOOC—$(CH_2)_{16}$—COOH, composed of $C_{18}$, $C_{21}$ and $C_{24}$ and higher molecular weight dibasic acids.

56-76% Linear monoacids with chain lengths exhibited within the fatty acid profile of soybean oil, e.g. mainly $C_{16}$ and $C_{18}$ for soybean oil, and shorter chain monobasic acids.

16-30% Paraffins.

0-1% Free glycerol.

Residual partially hydrolyzed HMSBO is not captured by the GC-MS method due to sample preparation (transesterification), but can be quantitatively analyzed by AV/SAP=degree of conversion, SAP−AV=ester value.

Example 1

MSBO

In a 50-gallon batch reactor, soybean oil (87 Kg) is degassed overnight (~16 hrs) with argon or nitrogen at an estimated rate of 10 mL/min. The oil is then heated to 70° C. and Ruthenium catalyst C827 (3.5 g) is added. A metathesis reaction is run for 2 hours, under an atmosphere of argon. Stirring sufficient to cause a small amount of splash from the baffle is used. GC analysis of the corresponding methyl esters indicates 68% conversion.

The catalyst is removed by contacting the metathesis product mixture with 5 wt % of Pure Flo 80 bleaching clay (i.e., 5 g bleaching clay/100 g metathesis product mixture) for 4 hr at 70° C., followed by filtering the metathesis product mixture through a plug of bleaching clay and sand.

The filtrate is an unstripped metathesis product (unstripped MSBO). Vacuum stripping of this product is conducted at 80° C. for 30 minutes, followed by vacuum stripping at 100° C. for 30 minutes, followed by vacuum stripping at 200° C. until visual observation indicates that no more volatiles or paraffins are distilled, with the resulting product being a stripped MSBO product (stripped MSBO).

Example 1A

Unstripped 2×MSBO

The unstripped 2×MSBO sample is produced by repeating the metathesis reaction described in Example 1 using unstripped MSBO in place of soybean oil.

Example 2

HMSBO Acid Wax

In a 22 L reactor equipped with a mechanical stirrer, water and 4.0 kg of HMSBO are heated to 80° C. to form a molten wax. The stirring speed is maintained at 90-95 rpm. A solution of 750 g sodium hydroxide in 4 L of water is added. After the addition, the temperature is raised to 95° C. Water is added to replace evaporation loss. After 24 hours a sample is taken from the reaction. The acid value (AV) of the sample is determined. An AV of 200-220 indicates sufficient conversion. If the AV is too low, the reaction mixture is heated longer until the AV shows the desired value. Phosphoric acid (2.2 kg, 85%) is slowly added to neutralize the solution. During neutralization the volume increases due to the formation of emulsions and generation of solid fatty acids. After one hour the free fatty acids are molten and separated from the surface as acid wax. Water and an organic layer are separated through a valve at the bottom of the reactor. The acid wax is transferred into a 5 L three neck flask to strip off paraffin and lower boiling compounds. Under high vacuum the temperature is stepwise increased to 220° C. The results are: crude wax 3.831 kg; refined wax 2.639 (kg); drop point (dp) 185.4° F. (85.2° C.); and AV of 213.2

Example 3

HMSBO/Amine Derivative No. 1

3500 grams of HMSBO are melted in a 2 L flask in a heated oil bath (80-100° C.) on a hotplate/stirrer under nitrogen atmosphere. Once the melting stage is complete, 175 g of ethylene diamine (0.5 wt %) are added and allowed to mix (300-500 rpm) until the two melts are mixed. Then 17.5 g of $Na_2CO_3$ catalyst are added. The temperature is increased to 160-170° C. The reaction is left to run for 16 hours. The sample is distilled. The product, which may be referred to as an amide wax, has a dp of 213.7° F. (100.9° C.), and a needle penetration (np) of 6 dmm.

Example 4

HMSBO/Amine Derivative No. 2

1200 grams of HMSBO are melted in a 2 L flask in a heated oil bath (80-100° C.) on a hotplate/stirrer under nitrogen atmosphere. Once the melting stage is complete, 240 g of ethanolamine are added and allowed to mix (300-500 rpm) until the two melts are mixed. Then 0.5 wt % of $Na_2CO_3$ catalyst is added. The temperature is increased to 160-170° C. The reaction is left to run for 16 hours. The sample is then vacuum pumped for a total of 1 hour and poured into a sample holder for cooling. The product, which may be referred to as an amide wax, has a drop point of 216.1° F. (102.3° C.), and a needle penetration of 15 dmm.

Example 5

HMSBO/Amine Derivative No. 3

70 grams of HMSBO are melted in a 2 L flask in a heated oil bath (80-100° C.) on a hotplate/stirrer under nitrogen atmosphere. Once the melting stage is complete, 7.2 g of ethylene diamine (10 wt %) are added and allowed to mix (300-500 rpm) until the two melts are mixed. Then 0.35 g of $Na_2CO_3$ catalyst is added. The temperature is increased to 160-170° C. The reaction is left to run for 16 hours. The sample is distilled. The product, which may be referred to as an amide wax, has a drop point of 352.4° F. (178° C.) and a needle penetration of 0.5 dmm Example 6

Epoxidized MSBO

The following are added to a 3 L jacketed reactor: 658.0 g (1 equivalent) of filtered and stripped metathesized soybean oil, 165.7 g (3 equivalents) glacial acetic acid, 260 ml of toluene, and 150 g of Amberlite IR 120 (sulfonated polystyrene type acidic cation exchange resin available from Rohm & Haas). A 19 mm glass shaft with polytetrafluoroethylene (PFTE) stir blade and 4 inch (10.16 cm) agitator are put in place to stir the contents of the reactor. The glass shaft, blade and agitator are turned by an electric stirring motor. Positive nitrogen pressure is maintained throughout the reaction. The reaction mixture in the reactor is heated in a hot water bath to 50° C. while stirring at 75 rpm. 455 g (5 equivalents) of 35 wt % $H_2O_2$ are weighed in a glass jar. Once the reaction mixture reaches 49.8° C., the weighed $H_2O_2$ is added over a period of 2 hours and 10 minutes using 0.25 inch (0.635 cm) ID tubing in a Fisher ultralow flow peristaltic pump set to the nominal value of 7.5 on the dial. After all $H_2O_2$ is added, the reaction temperature is increased to 60° C. and the reaction mixture is stirred for 20 hours. The reaction is allowed to cool to room temperature and 1 L of water is then added to the reactor. An organic layer is removed and placed in a 2 L separatory funnel. The organic layer is washed with water five times or until a pH of 7 is measured, using pH paper, in the water layer. The organic layer is collected from the separatory funnel and dried over 200 g of anhydrous sodium sulfate. The organic layer is filtered using a pressure filter under 25 (psi) pounds per square inch (172.4 kilopascals) of pressure to remove the sodium sulfate. The filtrate is rotoevaporated in a 2 L flask at 60° C. to remove toluene, yielding 545 g of product. The product is tested using AT-IR, showing a characteristic epoxide peak at 893 $cm^{-1}$. The epoxidized product content is verified using A.O.C.S. Official Method Cd 9-57 for the determination of oxirane oxygen. The titration yielded a value of 5.4% oxirane oxygen. For the purpose of comparison, the theoretical maximum of oxirane groups in epoxidized soybean oil is 5.5%.

Stripped MSBO from Example 1 and the wax samples shown in Examples 2-6 are dispersed as cold flow additives in B-100 Nexsol Biodiesel supplied by Peter Cremer NA and tested for cloud point following the procedure in ASTM D2500-05, and pour point following the procedure in ASTM D97-08. The results are shown in Table 1. In the following table, as well as throughout the specification and claims, unless otherwise indicated, all parts and percentages are by weight.

TABLE 1

| Additive, wt % | Cloud Point, ° C. | Pour Point, ° C. |
|---|---|---|
| No Additive Stripped MSBO | 0 | −5 |
| 0.031% | −2 | −10 |
| 0.063% | −1 | −12 |
| 0.125% | −1 | −15 |
| 0.25% | −1 | −11 |
| 0.5% | 0 | −8 |
| 1.0% | 0 | −8 |

TABLE 1-continued

| Additive, wt % | Cloud Point, ° C. | Pour Point, ° C. |
|---|---|---|
| Epoxidized MSBO | | |
| 0.031% | 0 | −9 |
| 0.063% | −1 | −12 |
| 0.125% | −2 | −15 |
| 0.25% | −1 | −11 |
| 0.5% | −1 | −9 |
| 1.0% | −1 | −7 |
| HMSBO/Amine Derivative No. 1 | | |
| 0.031% | 0 | −9 |
| 0.063% | 0 | −13 |
| 0.125% | 1 | −15 |
| 0.25% | 2 | −10 |
| 0.5% | 6 | −6 |
| HMSBO/Amine Derivative No. 2 | | |
| 0.031% | −1 | −8 |
| 0.062% | 0 | −15 |
| 0.125% | 0 | −17 |
| 0.25% | 1 | −13 |
| 0.5% | 0 | −5 |
| HMSBO/Amine Derivative No. 3 | | |
| 0.031 | −1 | −10 |
| 0.063 | 0 | −15 |
| 0.125% | 1 | −16 |
| 0.25% | 0 | −14 |
| 0.5% | 0 | −4 |
| HMSBO Acid Wax | | |
| 0.031% | 0 | −8 |
| 0.063% | 0 | −16 |
| 0.125% | 1 | −18 |
| 0.25% | 0 | −15 |
| 0.5% | 1 | −4 |

Cold flow additives consisting of stripped MSBO, unstripped MSBO, and unstripped MSBO which is subjected to metathesis twice (Unstripped 2×MSBO), are tested for pour point in SoyClear 1500 (a double distilled soy methyl ester biodegradable solvent available from Ag Environmental Products LLC), SoyGold 1100 (a soy methyl ester biodegradable solvent available from Ag Environmental Products LLC), Haltermann Diesel (a petroleum based diesel fuel available from Haltermann products identified as 2007 Certification Diesel, product code HF0582, and having a cloud point (ASTM D2500) of −21° F. (−29.4° C.), a pour point (ASTM D97) of −30° F. (−17.8° C.), a sulfur content (ASTM D5453) of 8 ppm, and a 95% distillation point of 333.5° C.), and a 5:95 blend of SoyGold 1100 and Haltermann Diesel. The results are shown in Table 2. In Table 2, all numerical values, except for wt %, are in ° C.

TABLE 2

| Additive, wt % | SoyClear 1500 | SoyGold 1100 | Haltermann Diesel | SoyGold 1100 (5%)/Haltermann Diesel (95%) |
|---|---|---|---|---|
| None Stripped MSBO | −6 | −6 | −36 | −33 |
| 0.06% | — | — | — | −51 |
| 0.1% | — | −6 | <−48 | <−48 |
| 0.5% | −9 | −15 | −60 | −54 |
| 1% | −12 | −18 | −48 | −33 |
| 2% | −15 | −9 | −36 | −30 |

TABLE 2-continued

| Additive, wt % | SoyClear 1500 | SoyGold 1100 | Haltermann Diesel | SoyGold 1100 (5%)/Haltermann Diesel (95%) |
|---|---|---|---|---|
| 3% | −12 | −9 | — | −30 |
| 4% | — | −9 | — | — |
| Unstripped MSBO | | | | |
| 1% | — | −12 | — | — |
| 2% | −12 | — | — | — |
| Unstripped 2X MSBO | | | | |
| 2% | −15 | — | — | — |

The pour point (ASTM D97-08) is measured for stripped MSBO at various concentrations in 100% by weight Haltermann Diesel, 100% by weight SoyClear 1500, and a blend of 5% by weight SoyGold 1100 and 95% by weight Haltermann Diesel. The results are shown in Table 3. In Table 3, all numerical values, except wt %, are in ° C.

TABLE 3

| Stripped MSBO, wt % | 100% Haltermann Diesel | 5% SoyGold 1100/Haltermann Diesel | 100% SoyClear 1500 |
|---|---|---|---|
| 0 | −33 | −27 | 0 |
| 0.1% | −54 | −48 | 0 |
| 0.31% | −57 | −54 | — |
| 0.5% | — | — | −3 |
| 1.0% | — | — | −3 |
| 2.0% | — | — | −6 |
| 3.0% | — | — | −6 |
| 4.0% | — | — | −6 |
| 5.0% | — | — | −6 |

Cold filter plugging point (CFPP) tests (ASTM D6371) are conducted using stripped MSBO dispersed in SoyGold 1100, Haltermann Diesel, and a mixture of 10% by weight SoyGold 1100 and 90% by weight Haltermann Diesel, with the results being shown in Table 4. CFPP tests are used for estimating the lowest temperature at which a fuel will give trouble free flow in certain fuel systems. In Table 4, the CFPP values are in ° C.

TABLE 4

| Stripped | CFPP, ° C. | | |
|---|---|---|---|
| MSBO, Volume % | SoyGold 1100 | Haltermann Diesel | 10% SoyGold 1100/90% Haltermann Diesel |
| 0 | −6 | −27 | −23 |
| 0.5 | −4 | −33 | −34 |
| 1 | −6 | −38 | −29 |
| 2 | −9 | −35 | −31 |

The cetane number (ASTM D613) is determined for stripped MSBO at various concentrations of Halterman Diesel. The cetane number provides a measure of the ignition characteristics of diesel fuel in a compression ignition engine. The cetane number covers the range of 0 to 100, with typical values in the range of 30 to 65. The results are shown in Table 5. The results indicated that the addition of stripped MSBO to the fuel does not result in a deterioration of the cetane number.

TABLE 5

| Stripped MSBO, wt % | Cetane Number |
|---|---|
| 0 | 43.4 |
| 3 | 43.2 |
| 7 | 43.2 |

While the invention has been explained in relation to various embodiments, it is to be understood that various modifications thereof will become apparent to those skilled in the art upon reading the specification. Therefore, it is to be understood that the invention disclosed herein is intended to cover such modifications as fall within the scope of the appended claims.

The invention claimed is:

1. A fuel composition, comprising:

(A) a normally liquid fuel, the normally liquid fuel comprising a middle distillate fuel; and (B) a cold flow improving amount of (i) a metathesized natural oil, the metathesized natural oil comprising a metathesis oligomer and/or metathesis polymer; (ii) a metathesized natural oil derivative; or (iii) a mixture of (i) and (ii) for lowering the cloud point, pour point and/or cold filter plugging point of the normally liquid fuel.

2. The composition of claim 1 wherein (A) comprises a natural oil derived unsaturated carboxylic acid, salt and/or ester.

3. The composition of claim 1 wherein (A) is derived from petroleum or crude oil.

4. The composition of claim 1 wherein (A) is derived from a Fischer-Tropsch process.

5. The composition of claim 1 wherein (A) is derived from coal, natural gas, oil shale, biomass, or a mixture of two or more thereof.

6. The composition of claim 1 wherein (A) comprises a synthetic fuel.

7. The composition of claim 1 wherein (A) comprises kerosene, jet fuel, diesel fuel, fuel oil, heating oil, naphtha, or a mixture of two or more thereof.

8. The composition of claim 1 wherein (A) comprises one or more biofuels.

9. The composition of claim 1 wherein (A) comprises a mixture of a biofuel and a hydrocarbon fuel.

10. The composition of claim 1 wherein (A) comprises a biodiesel/bioalcohol blend, a biodiesel/petroleum middle distillate blend, or a mixture of two or more thereof.

11. The composition of claim 1 wherein (A) comprises a mixture of a natural oil-derived methyl ester and a petroleum middle distillate.

12. The composition of claim 1 wherein (A) has a sulfur content of up to about 0.05% by weight.

13. The composition of claim 1 wherein (A) has a 95% distillation point of up to about 370° C.

14. The composition of claim 1 wherein the metathesized natural oil is the product of a self-metathesis process or a cross-metathesis process.

15. The composition of claim 1 wherein the metathesized natural oil is made by reacting one or more natural oils and/or natural oil derived unsaturated carboxylic acids, salts and/or esters in the presence of a metathesis catalyst to form the metathesized natural oil.

16. The composition of claim 1 wherein the metathesized natural oil is made by reacting (a) one or more natural oils and/or natural oil derived unsaturated carboxylic acids, salts and/or esters with (b) another olefinic compound in the presence of a metathesis catalyst.

17. The composition of claim 15 wherein the natural oil derived unsaturated carboxylic acid, salt and/or ester comprises an unsaturated fatty acid with an alkene chain in the carboxylic acid portion of the molecule of from about 4 to about 30 carbon atoms, a terminal carboxylic acid group, and at least one carbon-carbon double bond in the alkene chain.

18. The composition of claim 15 wherein the natural oil derived unsaturated carboxylic acid, salt and/or ester comprises a metal salt of an unsaturated fatty acid with an alkene chain in the carboxylic acid portion of the molecule of from about 4 to about 30 carbon atoms, and at least one carbon-carbon double bond in the alkene chain, the metal being an alkali metal, an alkaline earth metal, a group IIIA metal, a group IVA metal, a group VA metal, a transition metal, a metal from the lanthanide series, a metal from the actinide series, or a mixture of two or more thereof.

19. The composition of claim 15 wherein the natural oil derived unsaturated carboxylic acid, salt and/or ester comprises an unsaturated fatty ester with an alkene chain in the carboxylic acid portion of the molecule of about 4 to about 30 carbon atoms, a terminal ester group, and at least one carbon-carbon double bond in the alkene chain.

20. The composition of claim 17 wherein the alkene chain in the carboxylic acid portion of the molecule contains one, two, three or four carbon-carbon double bonds.

21. The composition of claim 15 wherein the natural oil derived unsaturated carboxylic acid, salt and/or ester comprises a polyunsaturated fatty acid, a carboxylate salt of a polyunsaturated fatty acid, a polyunsaturated fatty ester, or a mixture of two or more thereof.

22. The composition of claim 19 wherein the unsaturated fatty ester comprises an unsaturated monoester, an unsaturated polyol ester, or a mixture thereof.

23. The composition of claim 22 wherein the unsaturated polyol ester is derived from a polyol containing from 2 to about 10 carbon atoms, and from 2 to about 6 hydroxyl groups.

24. The composition of claim 19 wherein the unsaturated fatty ester comprises an unsaturated glyceride.

25. The composition of claim 24 wherein the unsaturated glyceride comprises an unsaturated monoglyceride, an unsaturated diglyceride, an unsaturated triglyceride, or a mixture of two or more thereof.

26. The composition of claim 15 wherein the natural oil derived unsaturated carboxylic acid, salt and/or ester comprises an unsaturated fatty acid, carboxylate salt of an unsaturated fatty acid and/or an unsaturated fatty ester with an alkene chain in the carboxylic acid portion of the molecule of about 10 to about 24 carbon atoms, and: a carbon-carbon double bond between the $C_9$ and $C_{10}$ carbon atoms in the alkene chain; or a carbon-carbon double bond between the $C_6$ and $C_7$ carbon atoms in the alkene chain; or a carbon-carbon double bond between the $C_{11}$ and $C_{12}$ carbon atoms in the alkene chain; or a carbon-carbon double bond between the $C_{13}$ and $C_{14}$ carbon atoms in the alkene chain; or carbon-carbon double bonds between the $C_9$ and $C_{10}$ carbon atoms and between the $C_{12}$ and $C_{13}$ carbon atoms in the alkene chain; or carbon-carbon double bonds between the $C_9$ and $C_{10}$ carbon atoms, between the $C_{12}$ and $C_{13}$ carbon atoms, and between $C_{16}$ and $C_{16}$ carbon atoms in the alkene chain; or carbon-carbon double bonds between the $C_6$ and $C_7$ carbon atoms, between the $C_9$ and $C_{10}$ carbon atoms, between the $C_{12}$ and $C_{13}$ carbon atoms, and between the $C_{15}$ and $C_{16}$ carbon atoms in the alkene chain.

27. The composition of claim 15 wherein the natural oil comprises vegetable oil, algae oil, fungus oil, animal oil or fat, tall oil, or a mixture of two or more thereof.

28. The composition of claim 15 wherein the natural oil comprises canola oil, rapeseed oil, coconut oil, corn oil, cottonseed oil, olive oil, palm oil, peanut oil, safflower oil, sesame oil, soybean oil, sunflower seed oil, linseed oil, palm kernel oil, tung oil, jatropha oil, mustard oil, camellina oil, pennycress oil, castor oil, coriander oil, almond oil, wheat germ oil, bone oil, lard, tallow, poultry fat, algal oil, yellow grease, fish oil, or a mixture of two or more thereof.

29. The composition of claim 15 wherein the natural oil comprises refined, bleached and/or deodorized natural oil.

30. The composition of claim 29 wherein the refined, bleached and/or deodorized natural oil comprises refined, bleached and/or deodorized soybean oil.

31. The composition of claim 15 wherein the natural oil or natural oil derived unsaturated carboxylic acid, salt and/or ester is partially hydrogenated prior to the reaction in the presence of the metathesis catalyst.

32. The composition of claim 1 wherein the metathesized natural oil comprises from 1 to about 100 metathesis repeating groups.

33. The composition of claim 1 wherein the metathesized natural oil comprises a metathesis dimer, metathesis trimer, metathesis tetramer, metathesis pentamer, metathesis hexamer, metathesis heptamer, metathesis octamer, metathesis nonamer, metathesis decamer, or a mixture of two or more thereof.

34. The composition of claim 1 wherein the metathesized natural oil is made by reacting a natural oil and/or natural oil derivative in the presence of a metathesis catalyst to form a first metathesized natural oil; and then reacting the first metathesized natural oil in a self-metathesis reaction to form another metathesized natural oil, or reacting the first metathesized natural oil in a cross-metathesis reaction with a natural oil and/or natural oil derivative to form another metathesized natural oil.

35. The composition of claim 1 wherein the metathesized natural oil is formed in the presence of a metathesis catalyst, the metathesis catalyst comprising a metal carbene catalyst based upon ruthenium, molybdenum, osmium, chromium, rhenium, and/or tungsten.

36. The composition of claim 1 wherein the metathesized natural oil is formed in the presence of a metathesis catalyst, the metathesis catalyst being represented by the following formula (I)

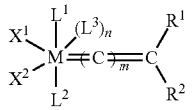

wherein:

M is a Group 8 transition metal;

$L^1$, $L^2$ and $L^3$ are neutral electron donor ligands;

n is 0 or 1, such that $L^3$ may or may not be present;

m is 0, 1, or 2;

$X^1$ and $X^2$ are anionic ligands; and $R^1$ and $R^2$ are independently selected from hydrogen, hydrocarbyl, substituted hydrocarbyl, heteroatom-containing hydrocarbyl, substituted heteroatom-containing hydrocarbyl, and functional groups, wherein any two or more of $X^1$, $X^2$, $L^1$, $L^2$, $L^3$, $R^1$, and $R^2$ can be taken together to form a cyclic group, and further wherein any one or more of $X^1$, $X^2$, $L^1$, $L^2$, $L^3$, $R^1$, and $R^2$ may be attached to a support.

37. The composition of claim 36 wherein M is Ru or Os.

38. The composition of claim 1 wherein the metathesized natural oil is formed in the presence of a metathesis catalyst, the metathesis catalyst being represented by the formula (III)

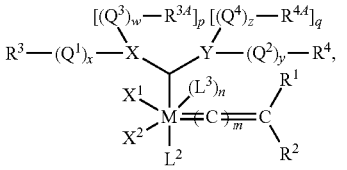

wherein:

M is a Group 8 transition metal;

$L^1$, $L^2$ and $L^3$ are neutral electron donor ligands;

n is 0 or 1, such that $L^3$ may or may not be present;

m is 0, 1, or 2;

$X^1$ and $X^2$ are anionic ligands; and $R^1$ and $R^2$ are independently selected from hydrogen, hydrocarbyl, substituted hydrocarbyl, heteroatom-containing hydrocarbyl, substituted heteroatom-containing hydrocarbyl, and functional groups, wherein any two or more of $X^1$, $X^2$, $L^1$, $L^2$, $L^3$, $R^1$, and $R^2$ can be taken together to form a cyclic group, and further wherein any one or more of $X^1$, $X^2$, $L^1$, $L^2$, $L^3$, $R^1$, and $R^2$ may be attached to a support;

X and Y are independently N, O, S, or P; p is zero when X is O or S; q is zero when Y is O or S; p is 1 when X is N or P; q is 1 when Y is N or P; and $Q^1$, $Q^2$, $Q^3$ and $Q^4$ are independently linkers, and w, x, y and z are independently zero or 1.

39. The composition of claim 1 wherein the metathesized natural oil is formed in the presence of a metathesis catalyst, the metathesis catalyst being represented by one or more of the following formulae

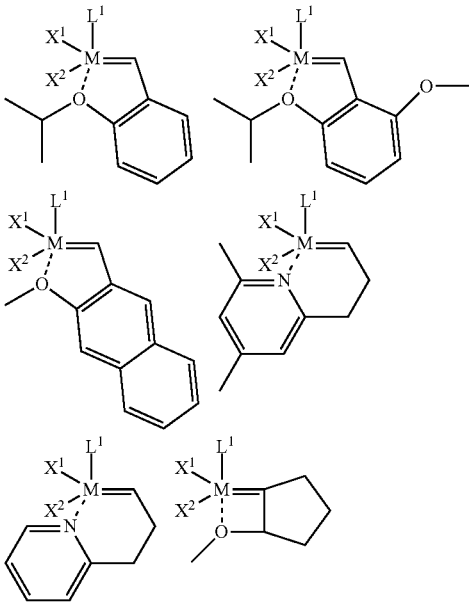

wherein:

$L^1$ is a neutral electron donor ligand;

$X^1$ and $X^2$ are independently anionic ligands; and

M is a Group 8 transition metal.

40. The composition of claim 1 wherein the metathesized natural oil is formed in the presence of a metathesis catalyst, the metathesis catalyst being represented by one or more of the following formulae (VII), (VIII), (IX) or (X):

(VII)

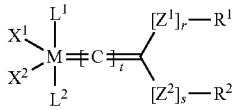

(VIII)

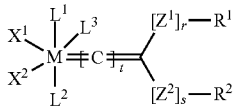

(IX)

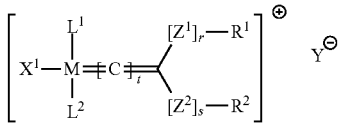

(X)

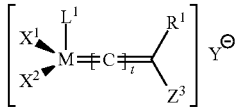

wherein:

M is a Group 8 transition metal;

$L^1$, $L^2$ and $L^3$ are neutral electron donor ligands;

r and s are independently zero or 1;

t is an integer in the range from zero to 5;

$X^1$ and $X^2$ are anionic ligands; and $R^1$ and $R^2$ are independently selected from hydrogen, hydrocarbyl, substituted hydrocarbyl, heteroatom-containing hydrocarbyl, substituted heteroatom-containing hydrocarbyl, and functional groups, wherein any two or more of $X^1$, $X^2$, $L^1$, $L^2$, $L^3$, $R^1$, and $R^2$ can be taken together to form a cyclic group, and further wherein any one or more of $X^1$, $X^2$, $L^1$, $L^2$, $L^3$, $R^1$, and $R^2$ may be attached to a support;

Y is a non-coordinating anion; $Z^1$ and $Z^2$ are independently selected from —O—, —S—, —$NR^2$—, —$PR^2$—, —P(=O)$R^2$—, —P($OR^2$)—, —P(=O)($OR^2$)—, —C(=O)—, —C(=O)O—, —OC(=O)—, —OC(=O)O—, —S(=O)—, and —S(=O)$_2$—; and $Z^3$ is a cationic moiety.

41. The composition of claim 1 wherein the metathesized natural oil is formed in the presence of a metathesis catalyst, the metathesis catalyst being represented by the formula (XII)

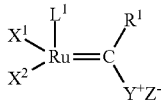

wherein:

$X^1$ and $X^2$ are anionic ligands;

$L^1$ is a neutral electron donor ligand;

$R^1$ is selected from hydrogen, hydrocarbyl, substituted hydrocarbyl, heteroatom-containing hydrocarbyl, substituted heteroatom-containing hydrocarbyl, and functional groups;

Y is a positively charged Group 15 or Group 16 element substituted with hydrogen, $C_1$-$C_{12}$ hydrocarbyl, substituted $C_1$-$C_{12}$ hydrocarbyl; heteroatom-containing $C_1$-$C_{12}$ hydrocarbyl, or substituted heteroatom-containing hydrocarbyl; and $Z^-$ is a negatively charged counterion.

42. The composition of claim 1 wherein the metathesized natural oil is formed in the presence of a metathesis catalyst, the metathesis catalyst being ruthenium (II) dichloro (3-methyl-1,2-butenylidene) bis(tricyclopentylphosphine); ruthenium (II) dichloro (3-methyl-1,2-butenylidene) bis(tricyclohexylphosphine); ruthenium (II) dichloro (phenylmethylene) bis(tricyclohexylphosphine); ruthenium (II) [1,3-bis-(2,4,6-trimethylphenyl)-2-imidazolidinylidene) dichloro (phenylmethylene) (triphenylphosphine); ruthenium (II) dichloro (vinyl phenylmethylene) bis(tricyclohexylphosphine); ruthenium (II) dichloro (tricyclohexylphosphine) (o-isopropoxyphenylmethylene); and/or ruthenium (II) (1, 3-bis-(2, 4, 6,-trimethylphenyl)-2-imidazolidinylidene) dichloro (phenylmethylene) (bis 3-bromopyridine).

43. The composition of claim 1 wherein the metathesized natural oil is formed in the presence of a metathesis catalyst, the metathesis catalyst being represented by structures 12, 14 or 16, where Ph is phenyl, Mes is mesityl, and Cy is cyclohexyl:

12

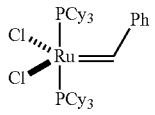

14

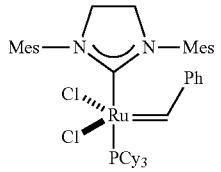

16

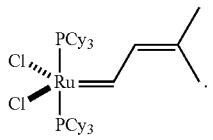

44. The composition of claim 1 wherein the metathesized natural oil is formed in the presence of a metathesis catalyst, the metathesis catalyst being represented by structures 18, 20, 22, 24, 26 or 28 where Ph is phenyl, Mes is mesityl, py is pyridyl, Cp is cyclopentyl and Cy is cyclohexyl:

18

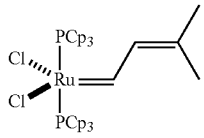

-continued

20

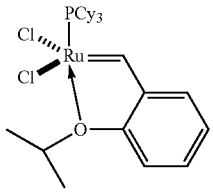

22

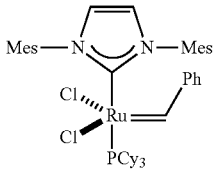

24

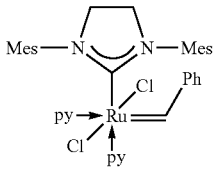

26

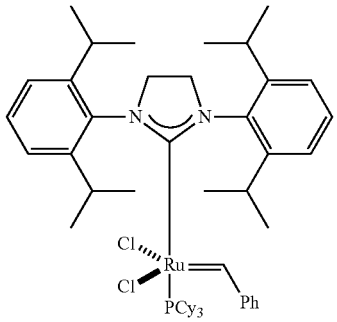

28

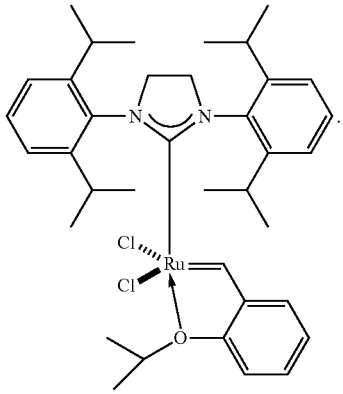

45. The composition of claim 1 wherein the metathesized natural oil is formed in the presence of a metathesis catalyst, the metathesis catalyst being represented by structures C823, C627, C682, C697, C712, or C827 and where Cy is cyclohexyl C823 in C827

C823

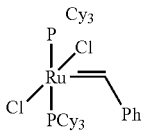

-continued

C827

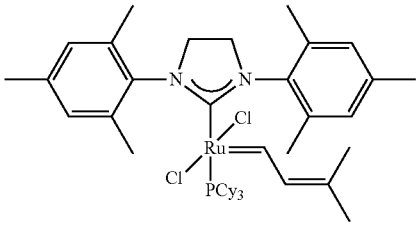

C627

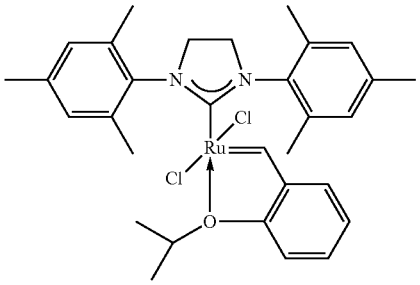

C712

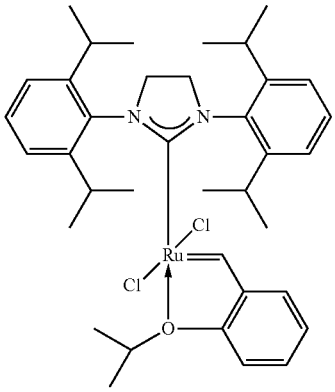

C697

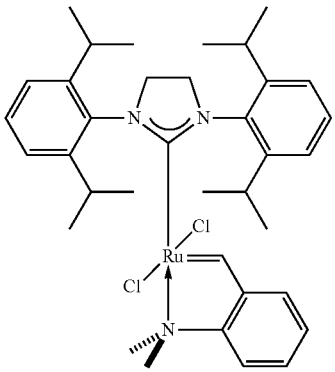

-continued

C682

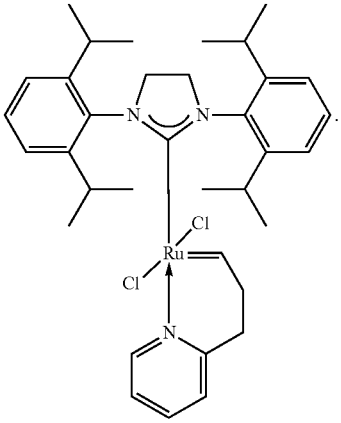

46. A fuel composition, comprising:

(A) a middle distillate fuel comprising a biofuel; and (B) a cold flow improving amount of (i) a metathesized soybean oil, the metathesized soybean oil comprising a metathesis oligomer and/or metathesis polymer; (ii) a metathesized soybean oil derivative; or (iii) a mixture of (i) and (ii) for lowering the cloud point, pour point and/or cold filter plugging point of the fuel.

47. A fuel composition, comprising:

(A) a middle distillate fuel comprising a mixture of a biofuel and a hydrocarbon fuel; and (B) a cold flow improving amount of (i) a metathesized soybean oil, the metathesized soybean oil comprising a metathesis oligomer and/or metathesis polymer; (ii) a metathesized soybean oil derivative; or (iii) a mixture of (i) and (ii) for lowering the cloud point, pour point and/or cold filter plugging point of the fuel.

48. The composition of claim 46 wherein the metathesized soybean oil is the product of a self-metathesis process or a cross-metathesis process.

49. The composition of claim 46 wherein the metathesized soybean oil is made by reacting one or more of soybean oil and/or soybean oil derived unsaturated carboxylic acids, salts and/or esters in the presence of a metathesis catalyst to form the metathesized soybean oil.

50. The composition of claim 46 wherein the metathesized soybean oil is made by reacting (a) one or more soybean oils and/or soybean oil derived unsaturated carboxylic acids, salts and/or esters with (b) another olefinic compound in the presence of a metathesis catalyst.

51. The composition of claim 46 wherein the soybean oil comprises refined, bleached and/or deodorized soybean oil.

52. The composition of claim 46 wherein the metathesized soybean oil comprises from 1 to about 100 metathesis repeating groups.

53. The composition of claim 46 wherein the metathesized soybean oil comprises a metathesis dimer, metathesis trimer, metathesis tetramer, metathesis pentamer, metathesis hexamer, metathesis heptamer, metathesis octamer, metathesis nonamer, metathesis decamer, or a mixture of two or more thereof.

54. The composition of claim 46 wherein the metathesized soybean oil is formed in the presence of a metathesis catalyst, the metathesis catalyst comprising a metal carbene catalyst based upon ruthenium, molybdenum, osmium, chromium, rhenium, and/or tungsten.

* * * * *